US011285480B1

(12) United States Patent
Logue et al.

(10) Patent No.: US 11,285,480 B1
(45) Date of Patent: Mar. 29, 2022

(54) RAPID CHEMICAL TESTING ASSEMBLY AND METHODS THEREOF

(71) Applicant: Analytical and Diagnostic Solutions, LLC, Aurora, SD (US)

(72) Inventors: Brian A. Logue, Aurora, SD (US); Randy E. Jackson, Brookings, SD (US)

(73) Assignee: Analytical and Diagnostic Solutions, LLC, Aurora, SD (US)

( * ) Notice: Subject to any disclaimer, the term of this patent is extended or adjusted under 35 U.S.C. 154(b) by 212 days.

(21) Appl. No.: 16/728,303

(22) Filed: Dec. 27, 2019

Related U.S. Application Data

(60) Provisional application No. 62/785,570, filed on Dec. 27, 2018.

(51) Int. Cl.
*B01L 3/00* (2006.01)
*B01L 5/02* (2006.01)

(52) U.S. Cl.
CPC ..... *B01L 3/50273* (2013.01); *B01L 5/02* (2013.01); *B01L 2200/16* (2013.01); *B01L 2300/0627* (2013.01); *B01L 2300/0861* (2013.01); *B01L 2400/0406* (2013.01); *B01L 2400/0475* (2013.01); *B01L 2400/06* (2013.01)

(58) Field of Classification Search
CPC .... B01L 3/50273; B01L 5/02; B01L 2200/16; B01L 2300/0627; B01L 2300/0861; B01L 2400/0406; B01L 2400/0475; B01L 2400/06
See application file for complete search history.

(56) References Cited

U.S. PATENT DOCUMENTS

2015/0093838 A1* 4/2015 Landers ..... B32B 38/145 436/180
2017/0199152 A1* 7/2017 Briman ..... G01N 33/5438
2020/0046821 A1* 2/2020 Bajaj ..... A61K 39/092

* cited by examiner

*Primary Examiner* — Jennifer Wecker
(74) *Attorney, Agent, or Firm* — Dewitt LLP

(57) ABSTRACT

A testing assembly for the rapid detection of a desired chemical from a sample, the testing assembly having a sample collection device for obtaining the sample and depositing the sample into a chemical capture cartridge that operably engages with a sensing device, the chemical capture cartridge utilizing the microdiffusion of reagents to isolate the desired chemical from the sample and react the desired chemical to form a detectible complex that can be detected and measured. The testing assembly can be portable and can rapidly diagnose a toxic industrial chemical exposure in just a few minutes, preferably about a minute or less for cyanide exposure using a blood sample from a subject onsite. The testing assembly can be used to determine the presence and/or concentration of a toxic industrial chemical in a variety of samples, including biological, environmental, and industrial samples.

20 Claims, 31 Drawing Sheets

RAPID CHEMICAL TESTING ASSEMBLY AND METHODS THEREOF

RELATED APPLICATION INFORMATION

This application claims the benefit of U.S. Provisional Application No. 62/785,570, filed Dec. 27, 2018, the contents of which are fully incorporated herein by reference.

TECHNICAL FIELD

The present invention is directed to a testing assembly for the rapid and simple detection of a desired chemical, more particularly a portable testing assembly that can obtain a sample and isolate the desired chemical from the remainder of the sample in order to rapidly determine the presence or absence of the chemical in the sample. The present invention is more particularly directed to a portable testing assembly that can rapidly diagnose a chemical exposure in a few minutes or less, preferably allowing rapid onsite determination of a chemical exposure for optimal response and action.

BACKGROUND

In the U.S., over 100,000 chemicals are used in industrial settings on a daily basis, some never tested for safety as it relates to environmental and/or human exposure. The Occupational Safety and Health Administration (OSHA) defines toxic industrial chemicals ("TICs") as industrial chemicals that pose chemical hazards (e.g., carcinogen, corrosive, reproductive effects, etc.) or physical hazards (e.g., flammable, explosive, reactive, etc.), and are manufactured, stored, transported, and used industrially throughout the world. Workers in many occupations are at risk for exposure to these chemicals, as are emergency first responders.

In our everyday environment, a person can be exposed to numerous toxic chemicals that can affect our health and can even be deadly if exposure is not detected quickly enough to allow appropriate response time and action. Such chemicals include, but are not limited to, cyanide, hydrogen sulfide ("$H_2S$"), ammonia ("$NH_3$"), hydrofluoric acid ("HF"), carbon disulfide ("$CS_2$") and azide ("$N_3^-$"). Permissible exposure limits for these example TICs set by OSHA and recommended exposure limits set by the National Institute for Occupational Safety and Health (NIOSH), with OSHA reported as an 8-hour time-weighted average and NIOSH reported as 10-hour time-weighted average, are shown in Table 1 below:

TABLE 1

Occupational Exposure Limits for some exemplary TICs

| TIC | OSHA PEL (ppm) | NIOSH REL (ppm) |
|---|---|---|
| CN | 10 | 4.7 |
| $H_2S$ | 20 | 10 |
| $NH_3$ | 50 | 25 |
| HF | 3 | 3 |
| $CS_2$ | 20 | 1 |
| $N_3^-$ | 0.1 ($NH_3$)<br>0.3 mg/m$^3$ ($NaN_3$) | NA |

Cyanide exists in gaseous and solid forms and is often present as an aqueous solution. Hydrogen cyanide ("HCN"), potassium and sodium cyanide, and mercury, copper, gold, and silver cyanide are all common forms of cyanide that are used in industrial or commercial use. In addition, a number of cyanide-containing compounds, known as cyanogens may release cyanide during metabolism. These include, but are not limited to, cyanogen chloride and cyanogen bromide (gases with potent pulmonary irritant effects), nitriles (R—CN), and the vasodilator, sodium nitroprusside.

Industry widely uses nitriles as solvents and in the manufacturing of plastics. Nitriles may release HCN during burning or when metabolized after absorption by the skin or gastrointestinal tract. Cyanide is also a common reagent for many chemical processes including mineral extraction, electroplating, and the synthesis of synthetic fibers, with over 1.4 million tons of cyanide produced yearly to accommodate the industrial need for cyanide. Other potential sources of cyanide exposure include accidental exposure from certain insecticides and in workplaces involved in metal polishing, nitroprusside manufacture, and consumption of certain food items, such as cassava seeds. Historically, cyanide has also been used as a chemical warfare agent and poison.

Depending on its form, cyanide may cause toxicity through inhalation, ingestion, dermal absorption, or parenteral administration. Chronic and acute exposure to cyanide can result in toxic, and sometimes fatal levels of cyanide in a victim. Chronic exposure to lower levels of cyanide over a long period results in increased blood cyanide levels, which can result in weakness and a variety of symptoms, including permanent paralysis, brain lesions, hypothyroidism, and miscarriages. Other effects include mild liver and kidney damage. Acute exposure can result from inhalation of cyanide and can cause coma with seizures, apnea, and cardiac arrest, with death following in a matter of minutes. At lower doses, loss of consciousness may be preceded by general weakness, giddiness, headaches, vertigo, confusion, and perceived difficulty in breathing. At the first stages of unconsciousness, breathing is often sufficient or even rapid, although the state of the person progresses towards a deep coma, sometime accompanied by pulmonary edema, and finally cardiac arrest. A cherry red skin color that changes to dark may be present as the result of increased venous hemoglobin oxygen saturation.

While the manufacture, use, and transportation of cyanide increases possibility of exposure, cyanide exposure and toxicity occurs most frequently in those who suffer smoke inhalation from residential or industrial fires. Combustion of certain synthesized and natural compounds produce HCN. Combustion of natural materials (e.g., cotton, paper, and wool) and synthetic materials (e.g., acrylonitrile and nylon) can produce between 6.3-150 mg of HCN gas per gram of material when burned, which can result in toxic levels of gaseous HCN if inhaled. Yearly, there are 23,000 smoke inhalation victims, 16,000 of which are from house fires. Of those 23,000 smoke inhalation victims, between 5,000 and 10,000 of those cases are lethal.

Workers in occupations such as mining, oil and gas extraction, agriculture, water-related industries, and many other industries are at risk for hydrogen sulfide exposure. $H_2S$ smells of rotten eggs and just 2-3 breaths of concentrated gas can cause "knockdown" (i.e., sudden unconsciousness and collapse resulting from breathing $H_2S$). Available literature suggests that $H_2S$ exposure is underreported, because poisonings are mostly reported following acute exposures that end in death, with lower dose exposure not typically reported. Exposure to $H_2S$ typically originates from occupational exposure, exposure due to accidental $H_2S$ gas production/release, or suicide. For example, $H_2S$ is a constant threat in the oil and gas industry, with up to 30% of natural gas containing $H_2S$.

Ammonia is one of the most commonly produced chemicals in the U.S. and its main industrial use is as a fertilizer for agricultural purposes. Other industrial uses of $NH_3$ are as a refrigerant gas, for purification of water supplies, and in the manufacture of plastics, explosives, textiles, pesticides, etc. $NH_3$ is also used in household (5-10% aqueous solutions) and industrial-strength (25% or higher) cleaning solutions. Because of the large amount of $NH_3$ produced for industrial purposes, and the fact that it is also naturally produced, exposure to $NH_3$ in low doses is common. Moreover, the widespread use of $NH_3$ in agriculture and other industrial locations increases risk of exposure from an accidental release or from a deliberate terrorist attack. High dose $NH_3$ exposure typically results from occupational exposure. For example, in August of 2010 in Alabama, a total of 152 industrial workers were sent to the hospital for $NH_3$ vapor exposure. Of those, 31 were admitted to the hospital, and another 4 were placed in intensive care. Additionally, in August of 2013, a liquid ammonia leak killed 15 and injured another 26 in Shanghai, China.

Hydroflouric acid (HF) is a highly corrosive gas or liquid and is used for a multitude of industrial applications. HF can be found in refrigerants, herbicides, plastics, fluorescent light bulbs, and electrical components. HF is commonly used in glass etching, as well as a cracking catalyst in oil refineries. Additionally, HF can be used for etching enamel, cleaning purposes, and manufacture of silicon semiconductors. It is estimated that 60% of the industrial HF use is for the production of refrigerants. Dermal exposure can cause significant issues, as fluoride acts as a calcium scavenger, interrupting several important physiological and biological processes. This ultimately causes electrolyte imbalances and fatal heart rhythms over time. Several incidents of accidental exposure to HF have been reported in Korea. For example, in September 2012, five workers were killed, and another 18 injured, including emergency responders, when 8 tons of HF was released at a chemical plant in Gumi. In January 2013, 2005 liters of HF was released at a factory in Cheongju, injuring 1, and in a separate incident, one worker was killed as a result of a HF leak at a Samsung Electronics computer chip plant in Hwaseong.

Carbon disulfide is commonly used in the textile industry to produce viscose rayon and cellophane, comprising approximately 75% of its use. $CS_2$ is also used as a solvent for phosphorus, sulfur, selenium, bromine, iodine, fats, resins, rubber, and asphalt. $CS_2$ is extremely toxic to the human nervous system and cardiovascular system. Because the effects of $CS_2$ are non-specific, it is necessary to confirm exposure via biological analysis. $CS_2$ exposure occurs mainly by inhalation. $CS_2$ is denser than air and the odor threshold is approximately 200 to 1,000 times lower than the OSHA PEL, so significant exposures can occur below the odor threshold. Even when $CS_2$ exposure is limited, it can have long-term health effects. In May of 2015, eight Chinese factory workers were killed and another two workers were hospitalized following a $CS_2$ leak.

Azide is used in several areas of industry. For example, $N_3^-$ is used in automobile airbags. When a vehicle collides with another, an electrical charge causes the $N_3^-$ to explode, releasing $N_2$ to inflate the airbag. Additionally, $N_3^-$ is used as a pesticide, as a chemical preservative in hospitals and laboratories, and in detonators and other explosive materials. $N_3^-$ is used to create azide containing molecules, which react rapidly with other substances by displacement of the azide group, giving rise to many organic compounds. $N_3^-$ reacts with moisture to produce $HN_3$(g). Similar to $H_2S$, although $HN_3$ does have a strong odor, it is highly toxic and the odor may not provide enough of a warning to prevent toxic outcomes. In April of 2010, five customers were poisoned by iced tea which contained sodium azide at a Texas restaurant. Of those present for emergency care, two required hospitalization.

The main mechanism of action resulting in the toxicity of CN, $H_2S$, and $N_3^-$ is based on their affinity towards the iron atom in the heme A group of cytochrome C oxidase. Each of these toxic agents attack cytochrome C oxidase, resulting in inhibition of ATP production, causing cellular hypoxia and cytotoxic anoxia, potentially resulting in death. At very low concentrations, $H_2S$ does exert some beneficial effects, but it is normally considered a highly toxic compound. Each of these agents is readily absorbed by inhalation, ingestion or dermally and is rapidly acting. While the most pressing toxicity of each of these compounds is acute, there is growing concern over the long-term health effects of each of these TICs. For example, even a single $H_2S$ exposure event can induce long-term physiological effects.

The human body has significant concentrations of $NH_3$ already in the blood (<40 μM) The body can convert $NH_3$ to urea efficiently under normal circumstances. When an $NH_3$ exposure occurs, an increase of blood $NH_3$ to 100 μM can cause loss of consciousness, with a blood ammonium concentration of 200 μM associated with coma and convulsions. The toxicity of $NH_3$ is caused by its effect on the oxidative deamination of glutamate to $NH_3$ and ketoglutarate, as catalyzed by glutamate dehydrogenase. Because the reaction is reversible, increased $NH_3$ concentrations push the reaction towards glutamate instead of ketogutarate. This depletes ketoglutarate and slows the citric acid cycle and the rate of ATP production. Because ATP production is slowed, a disruption in ion transport across nerve cells occurs, potentially causing seizures and/or coma, and may ultimately result in death. Recent research also suggests that $NH_3$ affects the transport of potassium into the brain's glial cells, which causes these cells to absorb excessive amounts of potassium and chloride. Moreover, chronic exposure to $NH_3$ can cause a number of outcomes, including respiratory diseases.

HF(g) is highly corrosive and can immediately and permanently damage lungs and the corneas of the eyes, causing respiratory irritation or hemorrhage. Aqueous HF contact is initially painless, but ultimately causes tissue death from burns as fluoride ions penetrate the skin. Systemic effects can occur from any type of exposure and include nausea, vomiting, gastric pain, cardiac arrhythmia, tetany, decreased myocardial contractility, cardiovascular collapse, ventricular fibrillation, and potentially death. These effects are due to fluoride's interference with calcium metabolism and can affect the levels of calcium, magnesium, and potassium in the blood. Symptoms may be delayed for several days, especially in the case of exposure to dilute solutions of HF. Chronic exposure to HF can result in skeletal fluorosis, a chronic metabolic bone and joint disease, increased sensitivity to minor fluoride exposures (e.g., from water or toothpaste), and renal insufficiency.

Acute exposure to $CS_2$ vapors is irritating to the eyes, mucous membranes, and respiratory epithelium. Acute neurological effects may result from all routes of exposure and may include headache, confusion, psychosis, coma, and potential death. $CS_2$ converts to dithiocarbamates metabolically, which may be responsible for the neurotoxic effects seen. While mechanisms of toxicity are still being debated, they are likely caused by direct reaction of $CS_2$ with amine or thiol functional groups of cellular constituents and reactive $CS_2$ metabolites (e.g., dithiocarbamates) which covalently bind to cell macromolecules. Dithiocarbamate metabolites can inactivate metalloenzymes via chelation and, as with $CS_2$, they can directly react with amines and thiols of cellular components. Chronic $CS_2$ exposure can have neurological and cardiovascular effects, as well as potential reproductive effects in men and women, renal toxicity, and increased sensitivity to light.

Diagnosis of TIC toxicity is a crucial factor in preventing the onset of severe reactions, however, TIC toxicity is often difficult to detect, which leads to delayed or presumptive diagnosis. For example, cyanide detection requires rapid testing in order to reverse its toxic and deadly effects. With TIC exposure, and specifically cyanide exposure, toxicity is often difficult to detect. Early symptoms include headaches, dizziness, fast heart rate, shortness of breath, and vomiting, which are symptoms commonly seen for multiple ailments. For example, cyanide toxicity may be suspected in a person following a house fire who has a decreased level of consciousness, low blood pressure, or high blood lactate. The toxic effects of cyanide exposure can be seen at a blood concentration of 19.2 μM and death can occur at blood concentrations of 115 μM. Death can occur within 5-60 minutes depending upon the route and level of cyanide exposure. Blood levels of cyanide can be measured, but current diagnostic methods can take too much time to properly diagnose and allow timely treatment for someone that has been exposed.

Current TIC tests require biological samples from a potential exposure victim to be gathered and tested, typically via a sophisticated laboratory-based method. These samples are typically large volume IV blood samples that are sent to a laboratory for analysis. Therefore, retrieval of a biological sample generally requires trained medical personnel to arrive to the exposure victim and draw venous samples. Therefore, there is typically a latency in blood retrieval, which can be detrimental to the health of a victim. The laboratory analysis of a gathered sample also depends on the lab and the method of analysis used. Laboratory analysis of a sample typically takes hours to run and requires sophisticated techniques. Results from a laboratory analysis of potential TIC exposure typically take 24 hours or more to report.

With specific reference to cyanide, currently available cyanide tests require use of test strips, multiple reagents and/or buffers, and time to determine cyanide concentrations. While several tests exist for aqueous solution, these tests are not blood tests. Tests are available from Macherey-Nagel GmbH & Co. KG, which is headquartered in Duren, Germany. One test, Quantofix™ cyanide test strips, require a separate vessel, a test solution, buffers, and test strips. The process requires that the vessel be rinsed before each use, test solutions and buffers are added with intermittent mixing, and test strips are dipped in the solution. Results are based on a subjective observation of color changes of a test strip and are not available for at least several minutes. Another test, Cyantesmo™ paper, detects cyanides in aqueous solutions and extracts, but requires at least 15 minutes of reaction time for before a reading is ready. Visocolor™ ECO cyanide test kit requires multiple reagents and at least 15 minutes for the test to develop.

Additionally, MilliporeSigma, headquartered in Burlington, Mass., manufactures two cyanide detection tests. One test, MQuant® cyanide test strips, measures levels of cyanide in a solution by using a mixture of reagents and test strips to compare a used test strip with a color indicator. However, only readily dissociable cyanides are detectable. Mcolortest® system is an alternative test, but like many others, requires multiple reagents, color comparison of results, and time. Again, these tests are not used for blood analysis.

These aforementioned methods for TIC and cyanide exposure analysis generally require an objective observation of comparing color charts for determining cyanide levels in a submitted sample. Additionally, these testing methods generally require multiple reagents, vessels and mixing tools, all of which are separate and prone to being lost or contaminated. Further, these diagnostic methods can take time for the results to develop, which may be time that is needed to effectuate a proper response and action for an exposed victim.

Presently, there are no commercially available detection tools for onsite, rapid cyanide analysis of suspected exposure. Because the effects of TICs, such as cyanide, can be rapid and deadly, a system for rapid and accurate diagnosis of TIC exposure from a bodily fluid, such as blood, is needed. There is also a need in the industry for fast, efficient and cost-effective sampling for diagnostic and health monitoring of chemical compounds exposures.

SUMMARY

The present invention is directed at a testing assembly that can isolate a desired chemical from a collected sample for the rapid detection of the desired chemical compound or component. In some aspects, the testing assembly meets the needs in the industry of a system that is portable, fast, efficient, and cost-effective. In some aspects, the present invention is directed towards a testing assembly that includes a sample collection device, a chemical capture cartridge, and a sensing device. In some aspects, the sample collection device can be used to obtain a sample to be inserted into the chemical capture cartridge, the chemical capture cartridge having a sample chamber and a capture chamber where the sample is subjected to one or more reagents to facilitate isolation of the desired chemical component from the remaining portion of the sample to the extent the desired chemical component is present, and if present, be detected and quantified, if necessary, using the sensing device.

In some aspects, the present invention is directed to a testing assembly for the detection of a desired chemical analyte in a sample, the testing assembly comprising a sample collection device, a chemical capture cartridge and a sensing device, the chemical capture cartridge comprising a chamber plate having a sample chamber and a capture chamber, a reagent plate having at least a first reagent bubble and a second reagent bubble, the first reagent bubble comprising a first liquid reagent and the second reagent bubble comprising a second liquid reagent, and at least one reagent channel plate located between the chamber plate and the reagent plate. In some aspects, the at least one reagent channel plate comprises at least a first reagent channel that is configured to provide fluid communication between the sample chamber of the chamber plate and at least the first reagent bubble. In some aspects, the at least one reagent channel plate comprises at least a second reagent channel that is configured to provide fluid communication between the capture chamber of the chamber plate and at least the second reagent bubble. In some aspects, the sample chamber configured to provide a headspace gas that is capable of being in fluid communication with the capture chamber. In some aspects, the sample collection device is configured to obtain the sample, insert the sample into the sample chamber of the chemical capture cartridge, and provide a cap for at least the sample chamber of the chemical capture cartridge. In some aspects, the sample chamber of the chemical capture cartridge is configured to react the sample with at least the first liquid reagent to provide a headspace gas having the desired chemical analyte, the headspace gas having the desired chemical analyte capable of being transferred to the capture chamber, and the capture chamber of the chemical capture cartridge is configured to react the desired chemical analyte with at least the second liquid reagent to provide a desired detectable complex. In some aspects, the sensing device comprises an excitation source and a detector, wherein the excitation source is configured to cause the desired detectable complex to emit a detectible signal, the detector is configured to detect the detectible signal, and the sensing device is capable of providing a signal indicating the presence or absence of the desired chemical analyte.

In some aspects, the sample collection device comprises a plunger having at least one elongated leg extending from a top portion and operably connected with a first body, a second body and a third body, wherein the second body is located between the first and third bodies, the first body having a central aperture containing a valve, the second body having a central aperture that is capable of receiving a capillary holder projection of the third body. In some aspects, a capillary tube is located within the capillary holder projection of the third body, the capillary tube having a proximate end extending out a bottom portion of the third body and a distal end extending through the capillary holder projection. In some aspects, a wash solution is contained within a wash solution bubble, the wash solution bubble located between the plunger and the first body.

In some aspects, the plunger is configured to be operated between an undepressed position and a depressed position, wherein the capillary tube in the undepressed position is configured to not operably engage with the valve, and wherein the capillary tube in the depressed position is configured to operably puncture the valve and wash solution bubble.

In some aspects, the capillary holder projection is configured to operably slide within a central aperture of the second body when the plunger is converted from the undepressed position to the depressed position.

In some aspects, the second body comprises an air channel configured to provide an external fluid connection between the capillary tube and an exterior atmosphere when the plunger is in the undepressed position. In some aspects, the external fluid connection allows capillary action of the sample collection device to draw the sample within the capillary tube in the undepressed position. In some aspects, the external fluid connection is configured to be sealed by the capillary holder projection in the depressed position.

In some aspects, a volume of the sample that can be drawn into the capillary tube and inserted into the sample chamber is between about 5 microliters and about 300 microliters, preferably about 10 to about 100 microliters, preferably about 25 to about 75 microliters, more preferably about 40 to about 60 microliters. In some aspects, the wash solution bubble is configured to be punctured by the distal end of the capillary tube and rinse the sample out of the capillary tube and into the sample chamber when the plunger is converted from the undepressed position to the depressed position.

In some aspects, chemical capture cartridge comprises at least one air channel plate located between the at least one reagent channel plate and the chamber plate. In some aspects, the at least one air channel plate comprises an external gas flow channel, wherein the external gas flow channel provides a fluid connection between the sample chamber and an external gas source. In some aspects, the external gas source is ambient air. In some aspects, the external gas source is inserted into the solution contained within the sample chamber. In some aspects, the external gas flow channel comprises at least one air channel outlet proximately located the lower portion of the sample chamber that contains fluid during normal operation. In some aspects, the external gas flow channel comprises a plurality of air channel outlets proximately located the lower portion of the sample chamber containing fluid during normal operation. In some aspects, the fluid comprises the sample and at least one reagent. In some aspects, the at least one reagent is capable of reacting with the desired analyte in the sample and transforming into a gas that can be contained within the headspace gas located above the fluid.

In some aspects, the at least one air channel plate further comprises a headspace gas channel, wherein the headspace gas channel provides a fluid connection between the headspace of the sample chamber and the capture chamber. In some aspects, the headspace gas channel comprises at least one headspace gas outlet proximately located the lower portion of the capture chamber that contains fluid during normal operation. In some aspects, the fluid comprises at least one reagent that can react with the gas contained within the headspace gas as it is transferred into the capture chamber and form a detectible complex.

In some aspects, the sample collection device can be used to obtain a blood sample. In some aspects, the sample collection device can be used to obtain an aqueous or solid sample, or a biological sample other than blood. In some aspects, the sample collection device can be used to obtain a liquid sample. In some aspects, the liquid sample is blood, saliva, water or oil, which contains the desired chemical analyte to be detected.

In some aspects, the desired chemical analyte in the sample is a toxic industrial chemical. In some aspects, the desired chemical analyte is cyanide, hydrogen sulfide, ammonia, hydrofluoric acid, carbon disulfide, azide, sulfur dioxide, chlorine, phosgene, 1,3-butadiene, arsine, phosphine, formaldehyde or methyl isocyanate.

In some aspects, the desired detectable complex formed in the capture chamber is a fluorometric probe that is capable of providing a fluorescence wavelength.

In some aspects, the present invention is directed to a testing assembly that can rapidly diagnose the presence of some analytes in 5 minutes or less, in some aspects 4 minutes or less, in some aspects 3 minutes or less, in some aspects 2 minutes or less, in some aspects 90 seconds or less, and in some other aspects a minute or less, from a sample.

In some aspects, the present invention is directed to a testing assembly that can rapidly detect the presence, and in some aspects the quantity, of cyanide in 90 seconds or less, and in some other aspects a minute or less, in some aspects between about 30 seconds and 90 seconds, and in some other aspects between about 45 seconds and about 60 seconds, from a sample of a subject, preferably a blood sample.

In some aspects, the present invention is directed to a portable testing assembly that can rapidly diagnose an analyte related to a chemical exposure at a desired location in a range of about 30 seconds to about 5 minutes, in some aspects between about 35 seconds and about 4 minutes, in some aspects about 40 seconds and about 2 minutes, in some aspects about 40 seconds and about 90 seconds, and in some other aspects about 45 seconds and 60 seconds. In some aspects, the present invention is directed to a portable diagnostic assembly that can be used onsite of a suspected chemical exposure site in order to rapidly diagnose a chemical exposure by detecting an analyte in about 5 minutes or less, preferably between about 30 seconds and about 4 minutes, preferably between about 30 seconds and about 3 minutes, preferably between about 30 seconds and about 2 minutes, preferably about 30 seconds and about 90 seconds, more preferably about 30 seconds and about 60 seconds.

In some aspects, the present invention is directed to a portable testing assembly that can rapidly detect the presence or absence of cyanide in 2 minutes or less, preferably between about 30 seconds and about 90 seconds, and more preferably about 30 seconds and 60 seconds, in order to diagnosis cyanide exposure in a timely manner to facilitate proper response and action, including any exposed victims and the site of the exposure.

In some preferred aspects, the present invention is directed to a testing assembly for the detection of cyanide in a sample. In some aspects, the testing assembly comprises a sample collection device capable of collecting a sample volume between about 5 microliters and about 300 microliters, a chemical capture cartridge, and a sensing device. In some aspects, the chemical capture cartridge comprises a chamber plate having a sample chamber for receiving the sample and a capture chamber. In some aspects, the chemical capture cartridge comprises a reagent bubble plate having a plurality of reagent bubbles, each reagent bubble containing between about 5 microliters and about 5 milliliters of a separate reagent including at least one acid reagent, at least one base reagent, at least one napththalene-2-3-dialdeyde (NDA) reagent, and at least one taurine reagent. In some aspects, the chemical capture cartridge comprises at least one reagent channel plate located between the chamber plate and the reagent plate, wherein the at least one reagent channel plate comprises at least one reagent channel configured to provide fluid communication between the sample chamber of the chamber plate and the at least one acid reagent bubble, and wherein the at least one reagent channel plate comprises at least one reagent channel configured to provide fluid communication between the capture chamber of the chamber plate and each of the at least one base, NDA and taurine reagent bubbles. In some aspects, the chemical capture cartridge comprises at least one air channel plate located between the at least one reagent channel plate and the chamber plate, wherein the at least one air channel plate comprises an external gas flow channel configured to provide a fluid connection between an external gas source and the sample chamber, and wherein the at least one air channel plate comprises a headspace gas channel configured to provide a fluid connection between the headspace of the sample chamber and the capture chamber. In some aspects, the sample collection device is configured provide a cap for at least the sample chamber of the chemical capture cartridge and discharge the sample into the sample chamber. In some aspects, the sample chamber of the chemical capture cartridge is configured to react the sample with at least the acid reagent to provide a headspace gas comprising hydrogen cyanide, and a volume of the external gas source is configured to transfer the headspace gas from the sample chamber to a mixture of the base, NDA and taurine reagents in the capture chamber, which hydrogen cyanide gas reacts with to form a detectible cyanide complex. In some aspects, the sensing device comprises an excitation source and a detector for indicating the presence or absence of cyanide. In some aspects, the testing assembly is capable of providing an analysis in less than about 60 seconds with a detection limit of about 2 μM.

In some aspects, the present invention is directed to a device for the detection of cyanide in a sample, the device comprising a chamber plate having a sample chamber for receiving a sample and a capture chamber. In some aspects, the device comprises a reagent bubble plate having a plurality of reagent bubbles, each reagent bubble containing between about 5 microliters and about 5 milliliters of a separate reagent, the separate reagents including at least one acid reagent, at least one base reagent, at least one napththalene-2-3-dialdeyde (NDA) reagent, and at least one taurine reagent. In some aspects, the device comprises at least one reagent channel plate located between the chamber plate and the reagent plate, wherein the at least one reagent channel plate comprises at least one reagent channel configured to provide fluid communication between the sample chamber of the chamber plate and the at least one acid reagent bubble, and wherein the at least one reagent channel plate comprises at least one reagent channel configured to provide fluid communication between the capture chamber of the chamber plate and each of the at least one base, NDA and taurine reagent bubbles. In some aspects, the device comprises at least one air channel plate located between the at least one reagent channel plate and the chamber plate, wherein the at least one air channel plate comprises an external gas flow channel configured to provide a fluid connection between an external gas source and the sample chamber, and wherein the at least one air channel plate comprises a headspace gas channel configured to provide a fluid connection between the headspace of the sample chamber and the capture chamber. In some aspects, the sample chamber of the chemical capture cartridge is configured to react the sample with at least the acid reagent to provide a headspace gas comprising hydrogen cyanide, wherein the hydrogen cyanide in the headspace gas is capable of being transferred into the liquid mixture of the base, NDA and taurine reagents in the capture chamber, which can then react with the liquid mixture to form a detectible cyanide complex.

In some aspects, the present invention is directed to a method of detecting a toxic industrial chemical. In some aspects, the desired chemical analyte to be detected is cyanide, hydrogen sulfide, ammonia, hydrofluoric acid, carbon disulfide, azide, sulfur dioxide, chlorine, phosgene, 1,3-butadiene, arsine, phosphine, formaldehyde or methyl isocyanate. In some aspects, the method of detecting the desired chemical analyte comprises obtaining a sample that may contain the desired chemical analyte. In some aspects, the sample is obtained using the sample collection device of the present invention. In some aspects, the sample is drawn into the capillary tube of the sample collection device of the present invention. After being drawn into the capillary tube, the sample collection device can be secured onto the chemical capture cartridge, such that at least the sample collection device seals the top of the sample chamber. The sample can be injected into the sample chamber by putting pressure on the plunger and converting the plunger from the undepressed state to the depressed state, which slidably moves the capillary tube through the valve and punctures the wash solution reagent bubble, thereby injecting the sample from the sample collection device into the sample chamber, along with the wash solution. The plurality of reagent bubbles of the sample can also be punctured, which causes the plurality of reagent solutions to flow into the respective sample and capture chambers. The external gas flow, which preferably comprises ambient air or an inert gas, can be flowed through the sample chamber transferring any reacted product contained in the headspace gas from the sample chamber to the capture chamber, wherein the reagent solution in the capture chamber can react with the desired analyte to form a detectible analyte complex. The detectible analyte complex can be excited using an excitation source, which then allows the excitated wavelength to be detected. In some aspects, the detectible analyte complex is a fluorometric probe that provides a detectible fluorescent signal upon excitation. In some aspects, the method detection method can be conducted in about 60 seconds or less, which detection method includes the steps of inserting the sample into the sample chamber, inserting the reagent solutions into the respective sample and capture chambers, reacting the desired analyte of the sample in the sample chamber to form an analyte gas within the headspace gas, flowing the headspace gas from the sample chamber into the reagent mixture of the capture chamber wherein the analyte gas reacts with the reagent mixture to form the detectible analyte complex, excitation of the detectible analyte complex and detection of a fluorescent signal.

The above summary is not intended to describe each illustrated embodiment or every implementation of the subject matter hereof, but instead to provide a summary of the present invention. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1A:
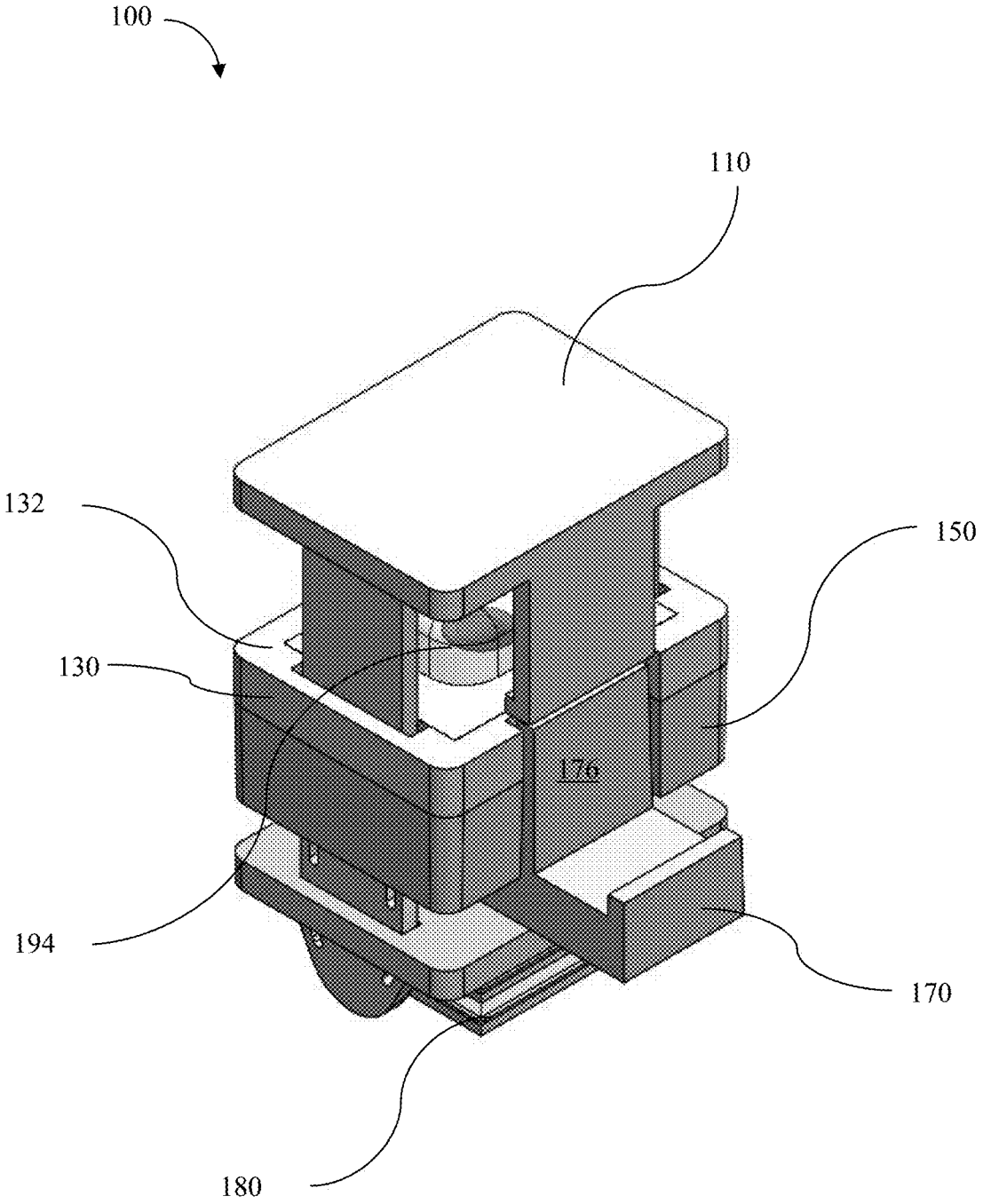
FIG. 1A is a top perspective view of a sample collection device before sample deposition according to certain embodiments of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Unless the context indicates otherwise the following terms shall have the following meaning and shall be applicable to the singular and the plural:

The terms "a," "an," "the," "at least one," and "one or more" are used interchangeably. Thus, for example, a cartridge that contains "a" reagent means that the cartridge may include "one or more" reagents.

The term "acid" means any chemical substance that has a pH of less than 7.

The term "base" means any chemical substance that has a pH of more than 7.

The term "sensing device" means an instrument which is used to detect biological, chemical or physical events of a sample. A reader can detect, but is not limited to detection of, intensity, absorbance, fluorescence, luminescence, time-resolved fluorescence, fluorescence polarization, and light scattering and nephelometry of a sample. Depending on the desired detection, a reader may include an appropriate filter and multiple well formats. The types of detection may be optionally and preferably controlled using software and a suitable database.

The term "sample" refers to a specimen for scientific testing or analysis, including, but not limited to, a fluid specimen from a subject, such as a blood or saliva specimen from an animal, and a fluid or swab specimen collected from an innate object.

The term "sample chamber" refers to an enclosed space or cavity into which a sample is placed.

The term "UV-VIS based confirmatory analysis" when used with respect to a method for sample analysis refers to use of absorption spectroscopy or reflectance spectroscopy in the ultraviolet-visible spectral region. Sample analysis may be performed by measuring the absorption or reflectance of electronic transitions in a certain spectrum. With reference to sample analysis, UV/VIS can include determination of the kinetics or rate constant of a chemical reaction.

The term "headspace transfer" means an aliquot of a volatile material in a vapor or gas phase located above a liquid or solid sample being conveyed to another location by a pressure drop, capillary action, carrier gas flow, purge and trap, and the like.

The present invention is directed at a chemical diagnostic assembly that can isolate a desired chemical from a collected sample for the rapid detection of the desired chemical compound or component. In some aspects, the diagnostic assembly comprises a sample collection device 100, a chemical capture cartridge 200, and a sensing device 300. In some aspects, the sample collection device 100 can be used to obtain a sample to be inserted into the chemical capture cartridge 200 to isolate the desired chemical component from the remaining portion of the sample to the extent the desired chemical component is present, and if present, be detected using the sensing device 300. While the chemical diagnostic assembly of the present invention, including the sample collection device 100, chemical capture cartridge 200, and sensing device 300, in the following description is disclosed with respect to cyanide detection, the present invention is applicable to collecting, isolating and/or detecting various other chemical compounds and components, including, but not limited to the toxic industrial chemicals hydrogen sulfide, ammonia, hydrofluoric acid, carbon disulfide and/or azide, and the like.

Referring now to FIGS. 1A-1D and 2A-2D, a sample collection device 100 is illustrated. The sample collection device 100 generally comprises a plunger 110 operably connected with a main top body 130, a main bottom body 150 and a capillary cap 180. The plunger 110 can also operably engage with a depression stop 170. Sample collection device 100 can also optionally comprise a capillary tube 192 and a reagent component 194, such as a wash solution bubble.

Figure 3A:
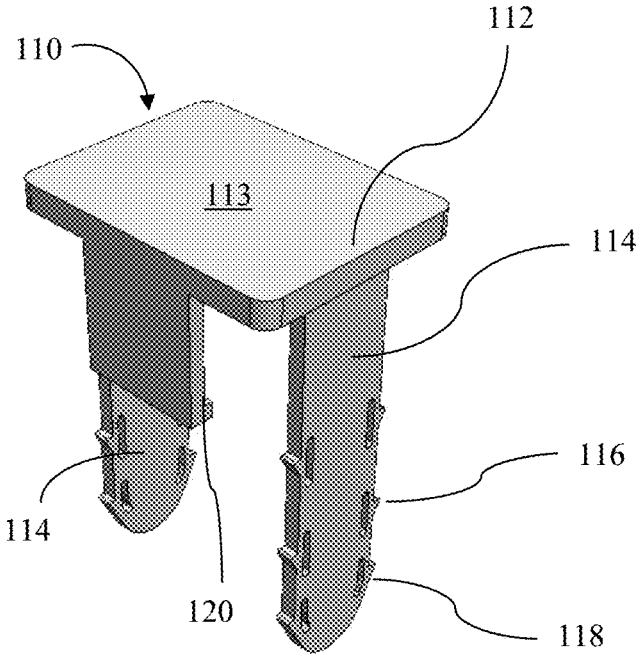
FIG. 3A is a perspective view of a plunger of the sample collection device in FIGS. 1A and 2A according to certain embodiments of the present invention.
Figure 3B:
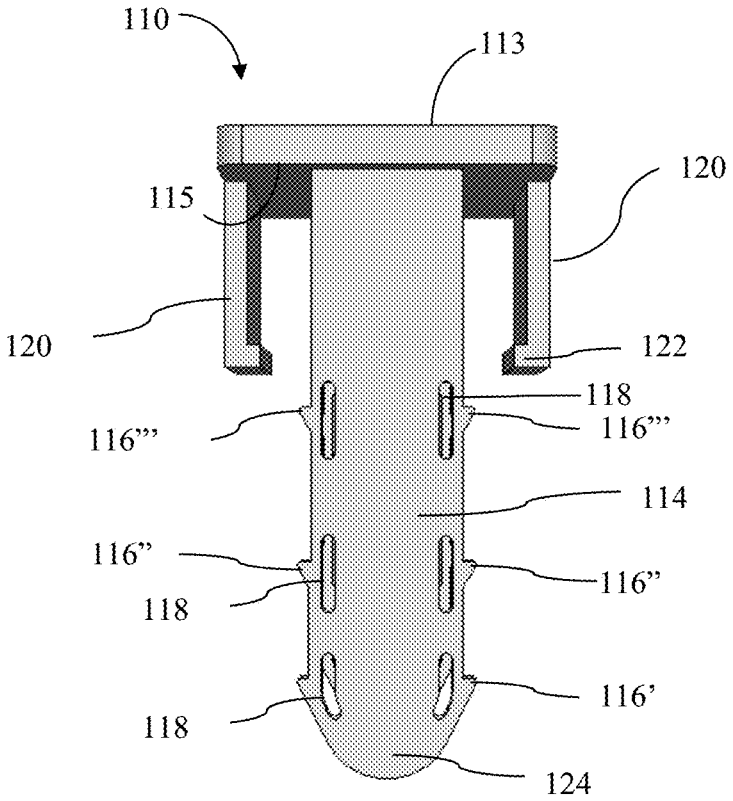
FIG. 3B is a side view of the plunger of FIG. 3A according to certain embodiments of the present invention.

Referring to FIGS. 3A and 3B, plunger 110 generally comprises a top portion 112 having at least one elongated leg 114 extending from the top portion 112 in a substantially perpendicular configuration. Top portion 112 may also have at least one stop leg 120 extending from the top portion 112 in a substantially perpendicular configuration.

Top portion 112 generally has a top surface 113 that may have a generally smooth surface. In some aspects, the plunger 110 has two or more elongated legs 114 extending from the top portion 112 in a direction opposite the top surface 113. In some aspects, as shown in FIGS. 3A and 3B, the plunger 110 has two elongated legs 114 extending from the top portion 112, the two elongated legs 114 being on opposing sides of the top portion 112 from each other. The one or more elongated legs 114 are a length such that they are capable of extending at least partially through each of the other components of the sample collection device 100 as seen in FIGS. 1B and 2C.

Each elongated leg 114 is shown as having one or more protruding tabs 116 proximate the peripheral edge of the elongated leg 114 between the top portion 112 and a distal end 124. In some aspects, each elongated leg 114 has opposing protruding tabs 116 proximate the peripheral edge of the elongated leg 114. In some aspects, each elongated leg 114 has two or more pairs of opposing protruding tabs 116 proximate the peripheral edge of the elongated leg 114 located between the top portion 112 and the distal end 124. In some aspects, each elongated leg 114 has three pairs of opposing protruding tabs 116 proximate the peripheral edge of the elongated leg 114 located between the top portion 112 and the distal end 124. In use, the protruding tabs 116 help to align plunger 110 as it is inserted through apertures or slots of other components comprising the sample collection device 100 and keep plunger 110 locked in an unpressed position prior to plunger 110 being pressed to depose a sample and also locked in a pressed position after plunger 110 has been pressed to depose a sample.

Figure 1B:
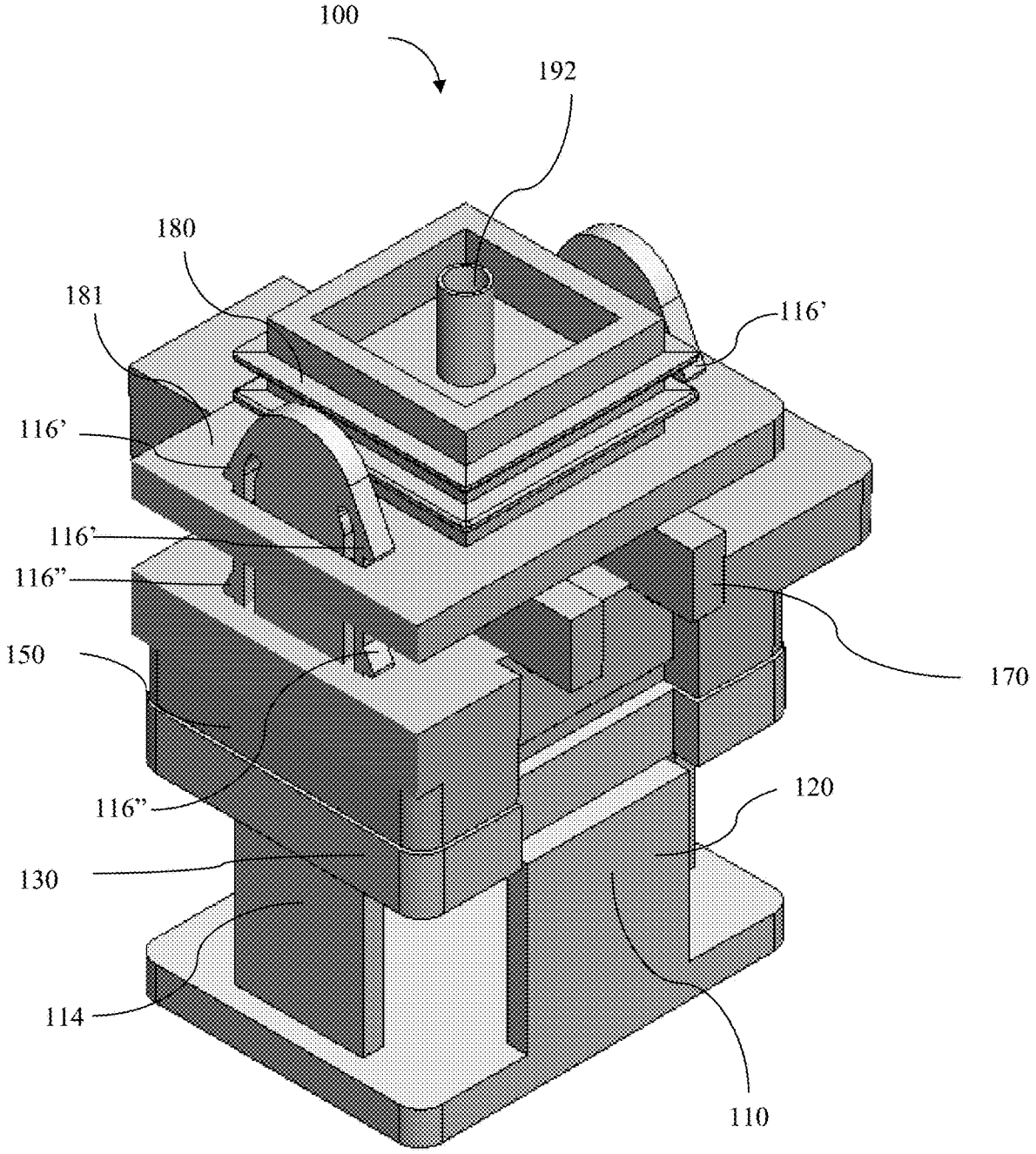
FIG. 1B is a bottom perspective view of the sample collection device in FIG. 1A according to certain embodiments of the present invention.
Figure 2A:
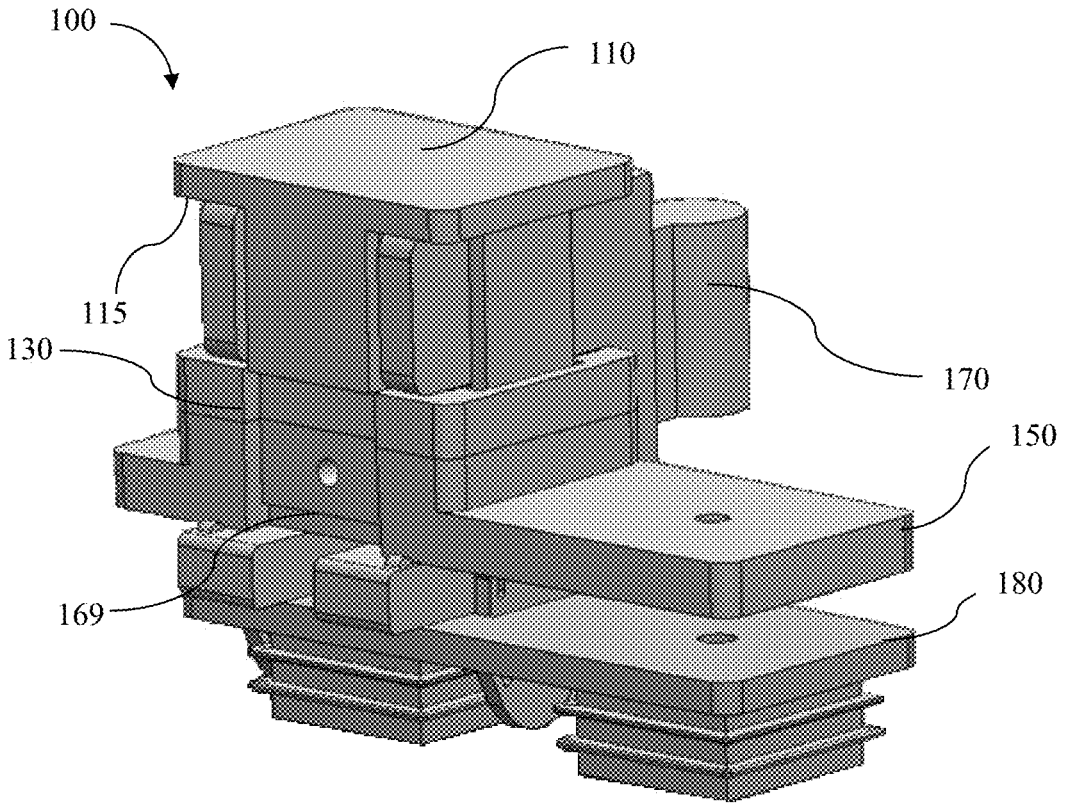
FIG. 2A is a top perspective view of a sample collection device before sample deposition according to certain embodiments of the present invention.
Figure 2B:
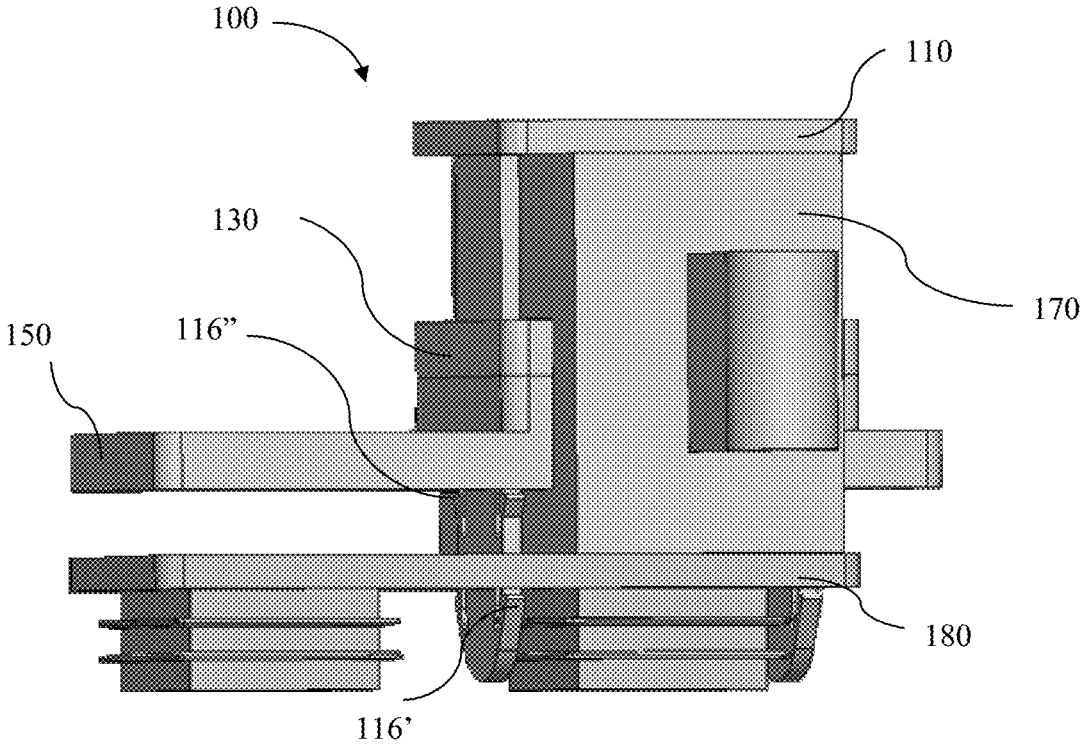
FIG. 2B is a side perspective view of the sample collection device in FIG. 2A according to certain embodiments of the present invention.
Figure 2C:
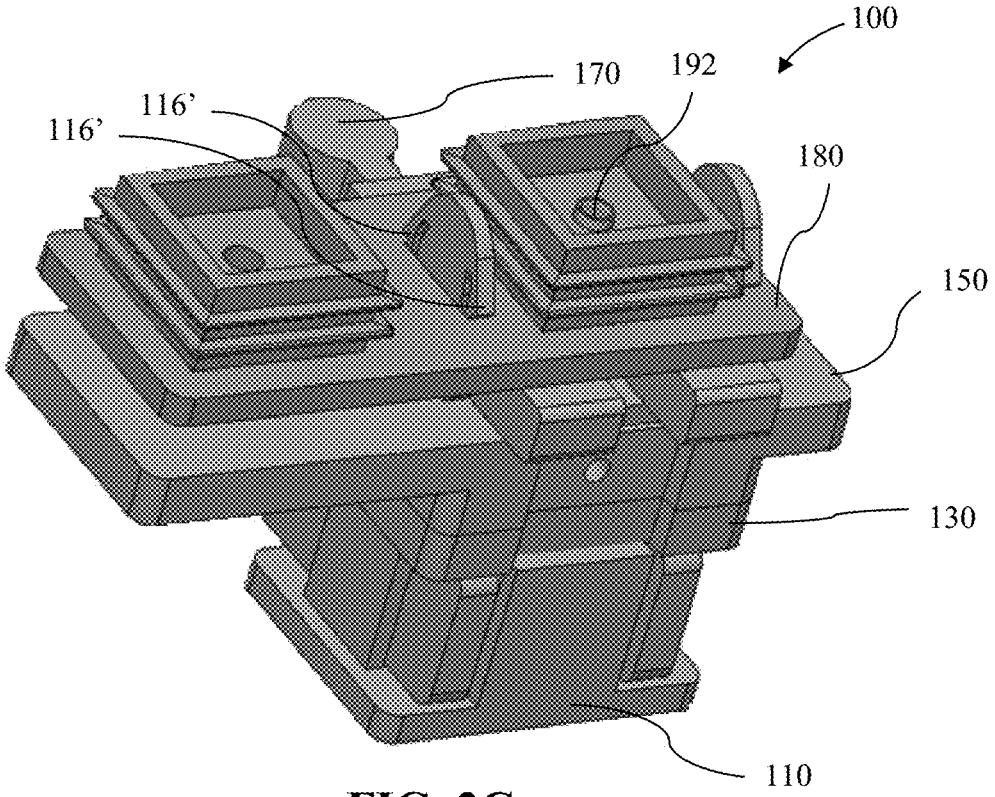
FIG. 2C is a bottom perspective view of the sample collection device of FIG. 2A according to certain embodiments of the present invention.

For example, as shown in FIGS. 1B and 2C, each pair of protruding tabs 116 are configured to have an angled or serrated shape that functions as a locking mechanism in one direction but allows the plunger 110 to be moved in the opposite direction. For instance, protruding tabs 116 are configured to allow the elongated legs 114 of the plunger 110 to be pushed in a direction towards capillary cap 180, but prohibits the plunger 110 from being pulled away from capillary cap 180 or moved in a direction away from the capillary holder and cap and towards the top surface 113 of the plunger 110.

FIGS. 1B and 2B-2C also show two pair of protruding tabs 116 on elongated leg 114, with one pair of protruding tabs 116' proximate the distal end 124 being located on a bottom surface 181 of capillary cap 180 and the second pair of tabs 116" located between a top surface 154 of capillary cap 180 and the bottom surface of the main bottom body 150. The configuration of the pair of protruding tabs 116' proximate the distal end 124 prohibits the plunger 110 from being pulled away from capillary cap 180 or moved in a direction away from capillary cap 180 and towards the top surface 113 of the plunger 110. Similarly, the second pair of protruding tabs 116" located between the top surface of capillary cap 180 and the bottom surface of the main bottom body 150 prohibits the plunger 110 from being pulled away from the main bottom body 150 or moved in a direction away from the main bottom body 150 and towards the top surface 113 of the plunger 110.

The pair of protruding tabs 116''' located closest to the top surface in FIGS. 3A and 3B operably engage the bottom surface of capillary cap 180 when the plunger 110 is fully depressed during normal operation. When the plunger 110 is fully depressed, the pair of elongated legs 114 are pushed through slots 186 until the tabs 116''' located closest to the top surface are pushed through the bottom surface of the capillary cap 180 and operably engage with the bottom surface, as shown best in FIG. 1C, prohibiting the plunger 110 from being pulled away from the main bottom body 150 or moved in a direction away from the main bottom body 150 and towards the top surface 113 of the plunger 110.

As shown in FIG. 3B, elongated legs 114 may also comprise slots 118 proximate each protruding tab 116. In some aspects, each elongated leg 114 has two or more pairs of opposing slots 118 proximate protruding tabs 116 which are proximate the peripheral edges of the elongated leg 114. In some aspects, each elongated leg 114 has two or more pairs of opposing slots 118 proximate protruding tabs 116. In some aspects, each elongated leg 114 has three pairs of opposing slots 118.

Slots 118 may be apertures extending through elongated leg 114 and/or partial depressions that do not extend through elongated leg 114. Slots 118 may be configured to have an elongated shape extending from the length of protruding tab 116. In use, slots 118 are configured to allow the material of elongated leg 114 to flex when force or pressure is exerted on protruding tab 116 during normal use. In some aspects if the material of elongated legs 114 is rigid, a pair of slots 118 on opposing sides of elongated legs 114 proximate protruding tabs 116 will allow inward flex of the material as protruding tabs 116 are depressed inward towards slots 118, which allows the elongated legs 114 to freely move through slots of other components, such as slots 156, 186, during depression of plunger 110. In some aspects, slots 118 may also allow depression of a pair of protruding tabs 116 for removal of plunger 110 after use of sample collection device 100.

In some aspects, the plunger 110 has two or more stop legs 120 extending from the top portion 112 in a direction opposite the top surface 113. In some aspects, as shown in FIGS. 3A and 3B, the plunger 110 has two stop legs 120 extending from the top portion 112, the two stop legs 120 being on opposing sides of the top portion 112 from each other. In use, stop legs 120 help to align plunger 110 as it is inserted through components comprising sample collection device 100, function as a safety stopping mechanism preventing plunger 110 from being depressed until desired and/or functions as a locking device once plunger 110 is depressed. According to an embodiment, stop legs 120 are a length such that they are capable of extending at least partially through the width of main top body 130 and main bottom body 150 of sample collection device 100, as shown in FIG. 1C, such that protruding tabs 116''' operably engage the bottom surface of capillary cap 180 when plunger 110 is in the depressed position.

As shown in FIGS. 3A and 3B, each stop leg 120 is configured to have a ledge portion 122 providing an "L" shaped configuration at the end opposing top surface 113 that can function as a stopping mechanism towards the depressed position when operably engaged with depression stop 170, as shown in FIG. 1A, but allows plunger 110 to be moved in the opposite direction, to the extent protruding tabs 116 are not operably engaged in a locking position. For instance, according to an embodiment shown in FIGS. 1A-1D, prior to sample insertion stop legs 120 are configured to allow plunger 110 to be pushed in a direction towards capillary cap 180, but operable engagement with elongated peak 176 of depression stop 170 functions as a safety mechanism preventing such depression. According to this embodiment, engagement of stop legs 120 with elongated peak 176 allows a space between the bottom surface of plunger 110 and top surface 132 of main top body 130, as shown best in FIG. 1A. According to this embodiment, this configuration allows reagent component 194 to be inserted in sample collection device 100. This configuration also enables air flow for capillary 192 for sample collection as discussed in more detail below.

According to another embodiment shown in FIGS. 2A-2D, stop legs 120 do not operably engage with an elongated peak 176 of depression stop 170. Instead, bottom surface 115 of top portion 112 operably engages with depression stop 170 to function as a safety mechanism preventing depression of plunger 110. According to this embodiment, engagement of bottom surface 115 with at least one elongated leg 175 allows a space between the bottom surface of plunger 110 and top surface 132 of main top body 130, as shown best in FIG. 2A. According to this embodiment, this configuration allows reagent component 194 to be inserted in sample collection device 100. This configuration also enables air flow for capillary 192 for sample collection as discussed in more detail below.

Figure 1C:
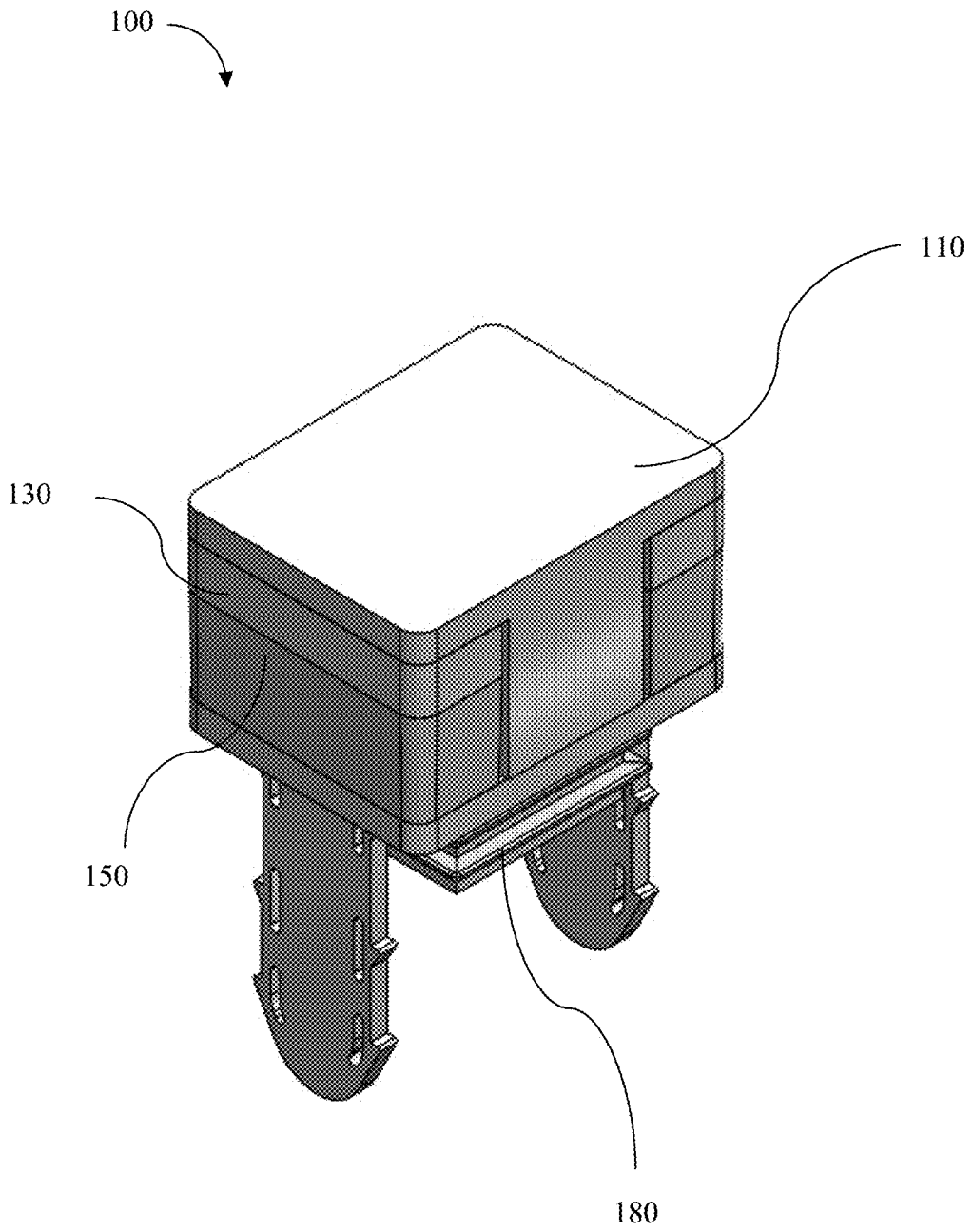
FIG. 1C is a top perspective view of the sample collection device of FIG. 1A after sample deposition according to certain embodiments of the present invention.

When depression stop 170 is removed from collection device 100 and plunger 110 is moved to the depressed position, such as shown in FIG. 1C, the "L" shaped configuration of ledge 122 operably engages with main bottom body 150 to prohibit plunger 110 from being pulled away from capillary cap 180 or moved in a direction away from capillary cap 180 and towards top surface 113 of plunger 110. As shown in FIG. 1C, the configuration of ledge 122 allows stop legs 120 to operably engage indent 168 and ledge 169 of main bottom body 150, which are shown in FIGS. 5A-5E. In some aspects, when plunger 110 is in the depressed position, stop legs 120 operably engage a structure, shown as ledge 169 of main bottom body 150, to lock plunger in the depressed position and prohibit plunger 110 from being pulled away from the main bottom body 150 or moved in a direction away from the main bottom body 150 and towards the top surface 113 of plunger 110.

During normal operation the pair of stop legs 120 in FIG. 1C operably engage the bottom surface 154 of main bottom body 150 when the plunger 110 is fully depressed. In some aspects, when plunger 110 is fully depressed, the pair of stop legs 120 is inserted into sample collection device 100 parallel to components of sample collection device 100 and operably engage with ledge 169 of the main bottom body 150, which with the locking mechanism of protruding tabs 116' as discussed above, prohibit plunger 110 from being pulled away from the main bottom body 150 and towards the top surface of the plunger 110.

When protruding tabs 116 and stop legs 120 are operably engaged with the bottom surface 154 of main bottom body 150 in the depressed state, such as illustrated in FIG. 1C, sample collection device 100 may form a seal when operably engaged with chemical capture cartridge 200. For instance, engagement of protruding tabs 116' with the bottom surface of capillary cap 180 and ledge 122 with indent 168 and ledge 169 prohibits plunger 110 from accidentally disengaging with components of sample collection device 100. In one aspect, engagement of protruding tabs 116' with the bottom surface of capillary cap 180 and the engagement of stop legs 120 with ledge 169 of the main bottom body 150 forms a seal between components of sample collection device 100. In the sealed configuration, sample collection device 100 can then function as a sealed cap for chemical capture cartridge 200 when sample collection device 100 is operably engaged with chemical capture cartridge 200 as shown in FIGS. 15A-16C. According to an embodiment, the seal formed between the components of device 100 prevents air, debris, or other potential contaminants from unintentionally entering sample collection device 100.

Figure 4A:
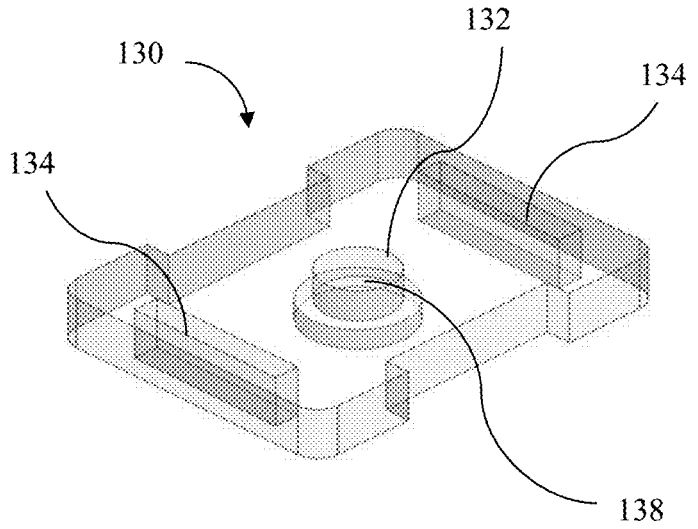
FIG. 4A is a transparent top perspective view of a main top body of the sample collection device in FIGS. 1A and 2A according to certain embodiments of the present invention.
Figure 4B:
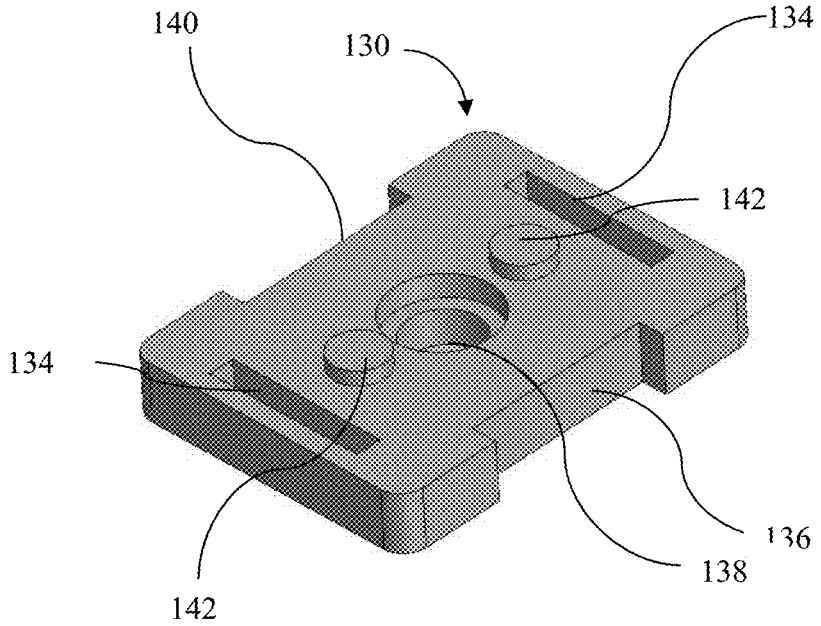
FIG. 4B is a perspective bottom view of the main top body of FIG. 4A according to certain embodiments of the present invention.

Referring now to FIGS. 4A and 4B, main top body 130 is shown. Main top body 130 generally comprises a top surface 132, one or more slots 134, one or more indents 136, central aperture 138, bottom surface 140, and one or more projections 142. Top surface 132 generally has a surface that operably couples with the bottom surface of plunger 110. In some aspects, top surface 132 is generally flat and smooth. In some aspects, top surface 132 generally has the same surface area and dimensions as bottom surface of plunger 110 so that in use top surface 132 and top surface 113 of plunger 110 are substantially aligned. In some aspects, top surface 132 may have a slight inset configured to receive reagent component 194 within inset to prevent reagent component 194 from shifting during normal operation. In an alternative aspect, top surface 132 can be configured to attach or engage with a site of attachment on reagent component 194.

In some aspects, as shown in FIGS. 4A-4B, main top body 130 has one or more slots 134, the one or more slots being on opposing sides of the main top body 130 from each other. In some aspects slots 134 are substantially rectangular in shape. In an alternative aspect, slots 134 are a shape such that they are capable of receiving elongated legs 114 as seen in FIGS. 1A and 2A. In use, slots 134 help guide and align elongated legs 114 as they are inserted through components of the sample collection device 100.

In some aspects main top body 130 may also have one or more projections 142 located on the bottom surface of main top body 130. In some aspects, as shown in FIGS. 4A-4B, main top body 130 has two projections 142 extending from bottom surface of main top body 130, the two projections 142 being on opposing sides of the bottom surface from each other.

As shown in FIG. 4B, projections 142 are configured to have a round shape, although other geometric shapes are contemplated. In some aspects, projections 142 function as a positioning mechanism for main top body 130. For instance, dimensions of projections 142 are such that each projection 142 is capable of extending into or at least partially engaging with depression 166 of main bottom body 150, which prevents main top body 130 and main bottom body 150 from shifting with respect to each other during normal use. In certain aspects, projections 142 act as positioning guides for main top body 130 as it engages with main bottom body 150 to stabilize the components of sample collection device 100 as other components of sample collection device 100 are assembled and used.

Figure 1D:
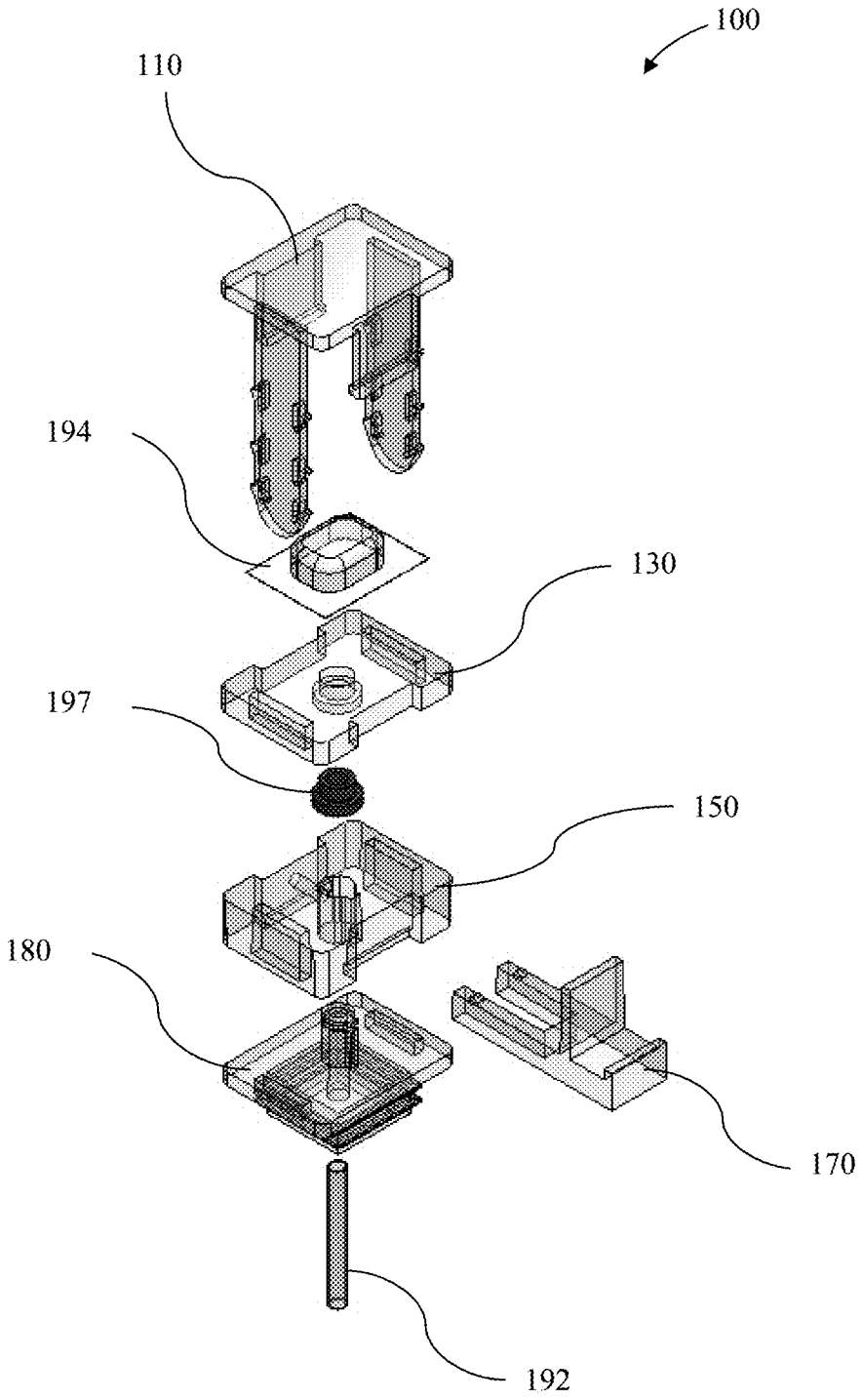
FIG. 1D is an exploded transparent view of the sample collection device of FIG. 1A according to certain embodiments of the present invention.
Figure 2D:
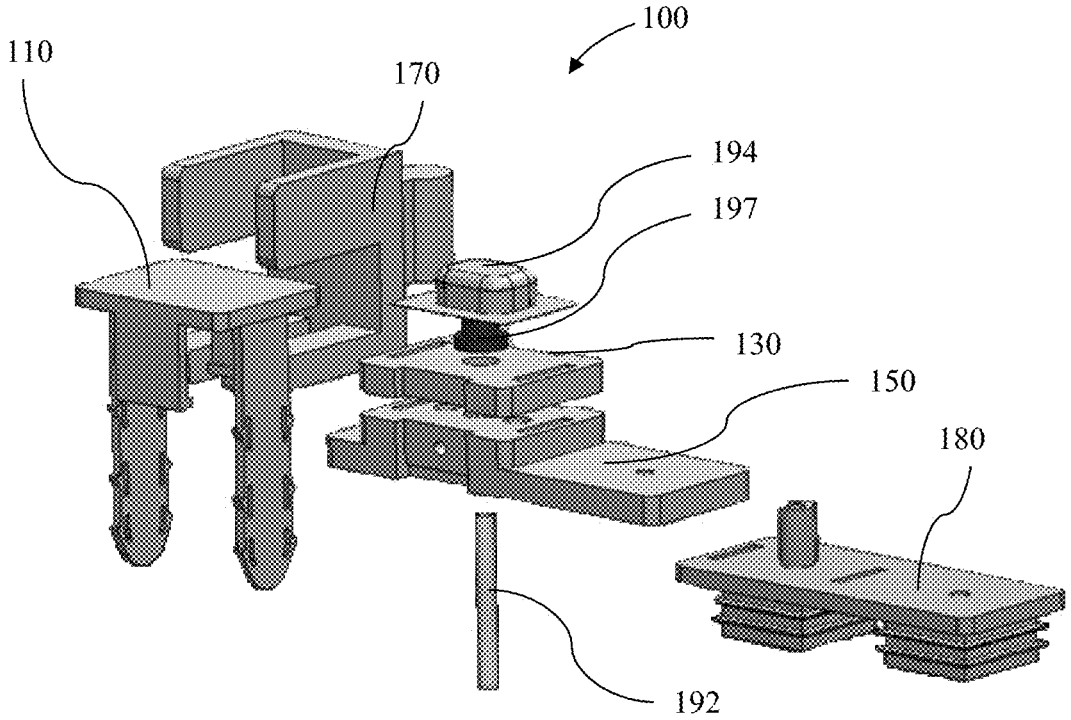
FIG. 2D is an exploded perspective view of the sample collection device of FIG. 2A according to certain embodiments of the present invention.
Figure 10:
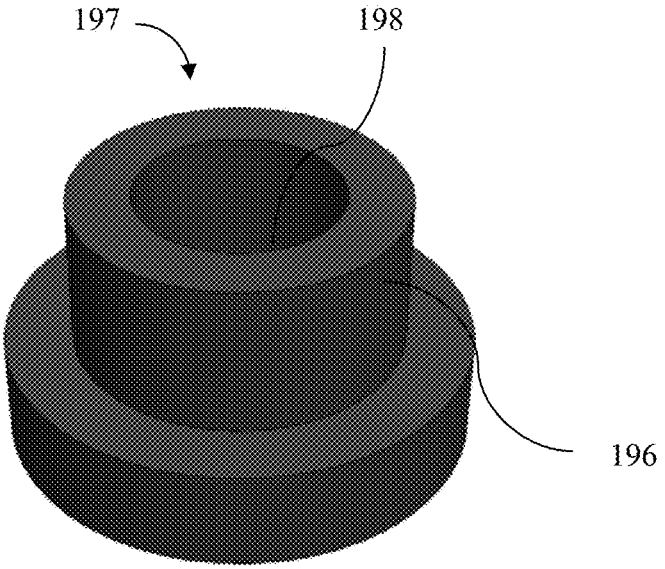
FIG. 10 is a perspective view of a valve of the sample collection device in FIGS. 1A and 2A according to certain embodiments of the present invention.

Main top body 130 also may comprise an aperture 138, which is shown in FIGS. 4A-4B to be centrally located within main top body 130. In some aspects, aperture 138 may be circular in shape, although other geometric shapes are contemplated. In some aspects, aperture 138 is configured to receive valve 197, which is shown in FIGS. 1D, 2D and 10. As shown in the exploded view sample collection device 100 of FIGS. 1D and 2D, during normal use aperture 138 receives a valve 197 from the bottom surface of the main top body 130.

As seen in FIGS. 4A-4B, main top body 130 may also comprise one or more indents 136 on the side surface. Main top body 130 is shown having one or more indents 136 proximate the peripheral edge of the elongated side of main top body 130. In some aspects, main top body 130 has opposing indents 136 proximate the peripheral edge of components the elongated side of main top body 130. During normal use, indents 136 can serve as an alignment guide for components of depression stop 170. For example, as shown in FIGS. 1A and 1B, at least one indent 136 is configured to receive elongated peak 176 of depression stop 170. In some aspects, at least one indent 136 operably engages with elongated peak 176 prevents depression stop 170 from shifting during normal use when the plunger 110 is in the unpressed position. Indents 136 also help guide stop legs 120 as plunger 110 is inserted through apertures or slots of other components of sample collection device 100.

In some alternative aspects, which are not shown, plunger 110 may have one stop leg 120 having ledge 122 and an opposing elongated stop leg 120 without ledge 122, and main top body 130 may have one indent 136 on one side and a slot replacing indent 136 on the opposite side, such that the depression stop 170 is side specific. In some aspects, the one indent 136 operably guides stop leg 120 and slot may operably guide the opposing elongated leg as plunger 110 is inserted through apertures or slots of other components of sample collection device 100. In some aspects, such as shown in FIGS. 2A-2D, stop legs 120 do not operably engage with depression stop 170, but instead are located between elongated legs 175.

Referring now to FIGS. 5A-5E showing different embodiments of main bottom body 150, which generally comprises a top surface 152, a bottom surface 154, one or more slot 156, air channel 158, aperture 160, ridge 162, air channel 164, one or more depressions 166, one or more indents 168, and one or more ledges 169. In some aspects, such as the embodiment shown in FIGS. 5B-5E, main bottom body 150 may also comprise elongated body portion 163 and aperture 164.

Top surface 152 and bottom surface 154 are generally a smooth surface and can comprise the same surface area and dimensions as the bottom surface of main top body 130 and top portion 112 of plunger 110. In some aspects, such as shown in FIG. 5C, top surface 152 be tiered, such that at least a portion of the top surface 152 comprises the same surface area and dimensions as the bottom surface of main top body 130 and top portion 112 of plunger 110, while an elongated body portion 163 may have a separate plane than top surface 152. In some other aspects, top surface 152 and elongated body portion 163 are integral such that they are in the same plane.

In certain preferred aspects, top surface 152 also has the same contour as bottom surface of main top body 130, such that the main top body 130 and main bottom body 150 may operably couple during normal use. In some aspects, a thin layer of adhesive may be applied between at least a portion of top surface 152 of main bottom body 150 and at least a portion of the bottom surface of main top body 130 to securely attach main top body 130 to main bottom body 150. The adhesive may also form a seal between main top body 130 to main bottom body 150. In some aspects, as shown in FIGS. 5A and 5C-5E, main bottom body 150 one or more slots 156, preferably two slots 156 being on opposing sides of main bottom body 150 from each other. In some aspects slots 156 are substantially rectangular in shape, although other geometric shapes are contemplated to be configured with the shape of elongated legs 114 of plunger 110. In some aspects, slots 156 are a comparable shape to operably receive elongated legs 114 as seen in FIGS. 1B and 2C. In use, slots 156 help guide and align elongated legs 114 as they are inserted through components of the sample collection device 100.

Figure 5A:
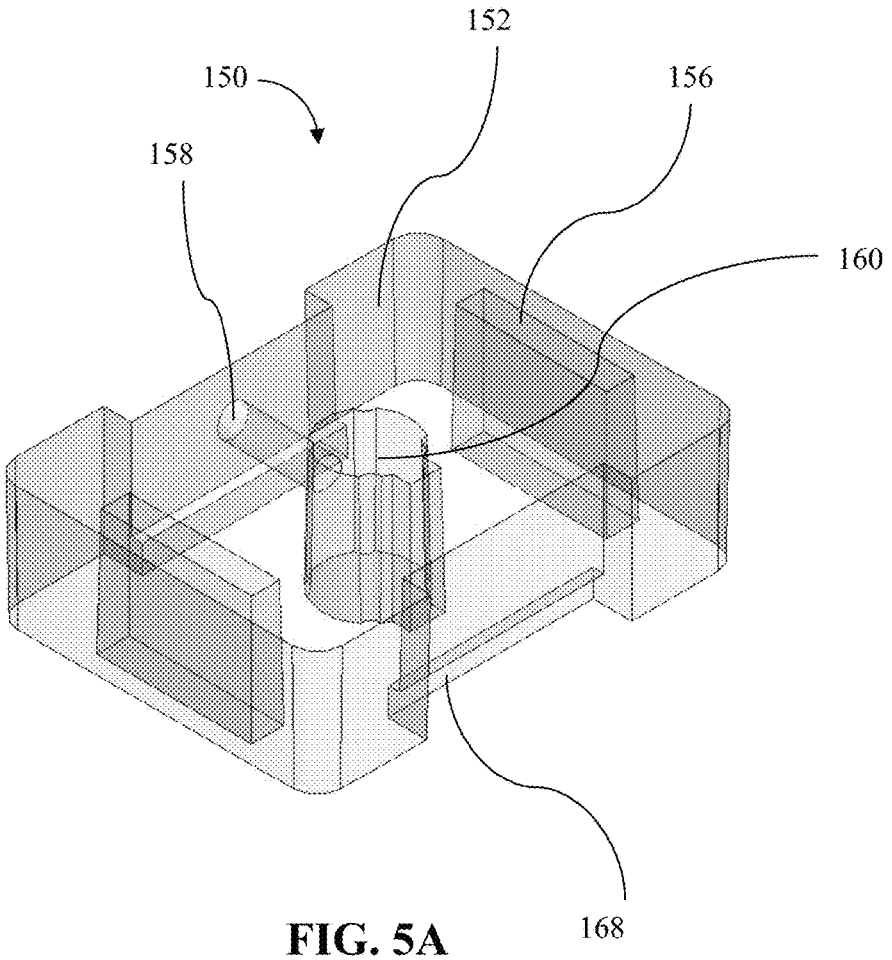
FIG. 5A is a transparent top perspective view of a main bottom body of the sample collection device in FIG. 1A according to certain embodiments of the present invention.
Figure 5B:
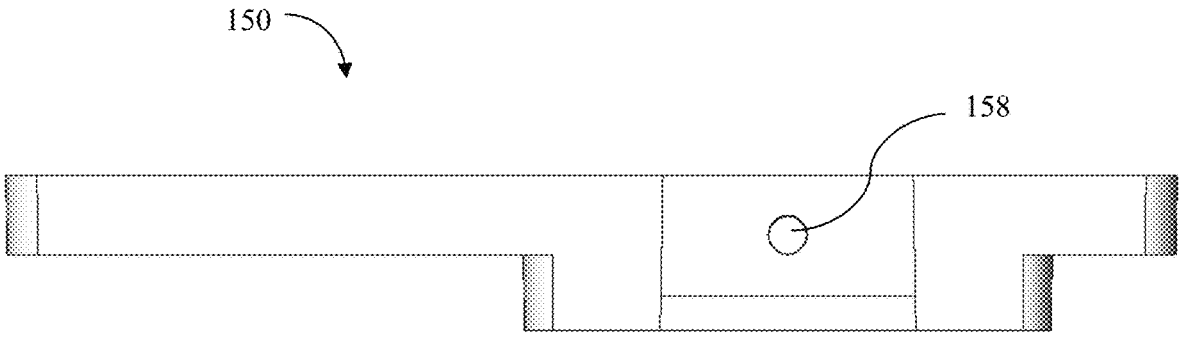
FIG. 5B is a side view of a main bottom body of a main bottom body of the sample collection device in FIG. 2A according to certain embodiments of the present invention.
Figure 5C:
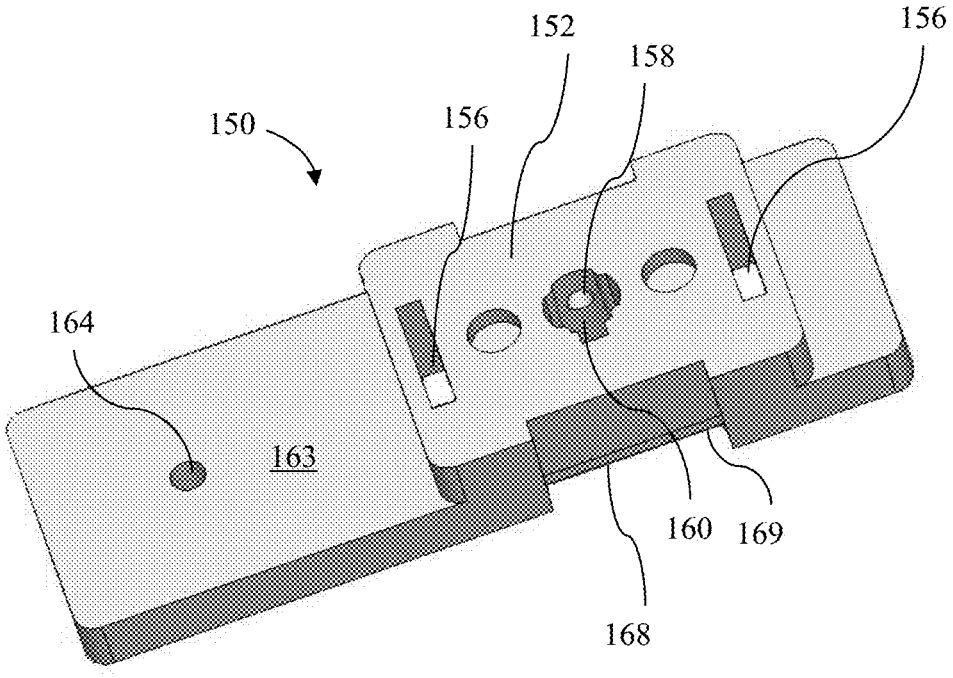
FIG. 5C is a top perspective view of the main bottom body of the sample collection device in FIG. 2A according to certain embodiments of the present invention.
Figure 5D:
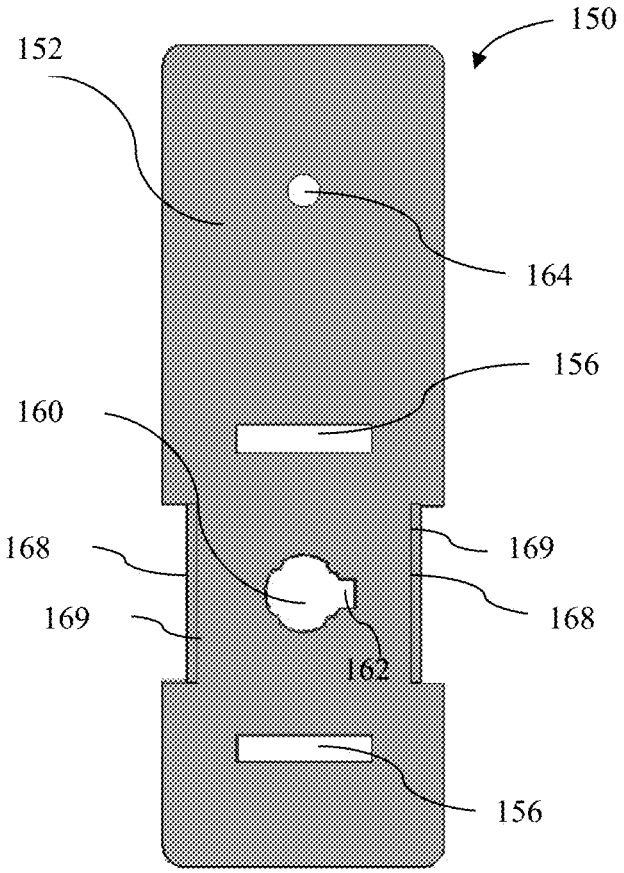
FIG. 5D is a bottom view of the main bottom body of FIG. 2A according to certain embodiments of the present invention.
Figure 5E:
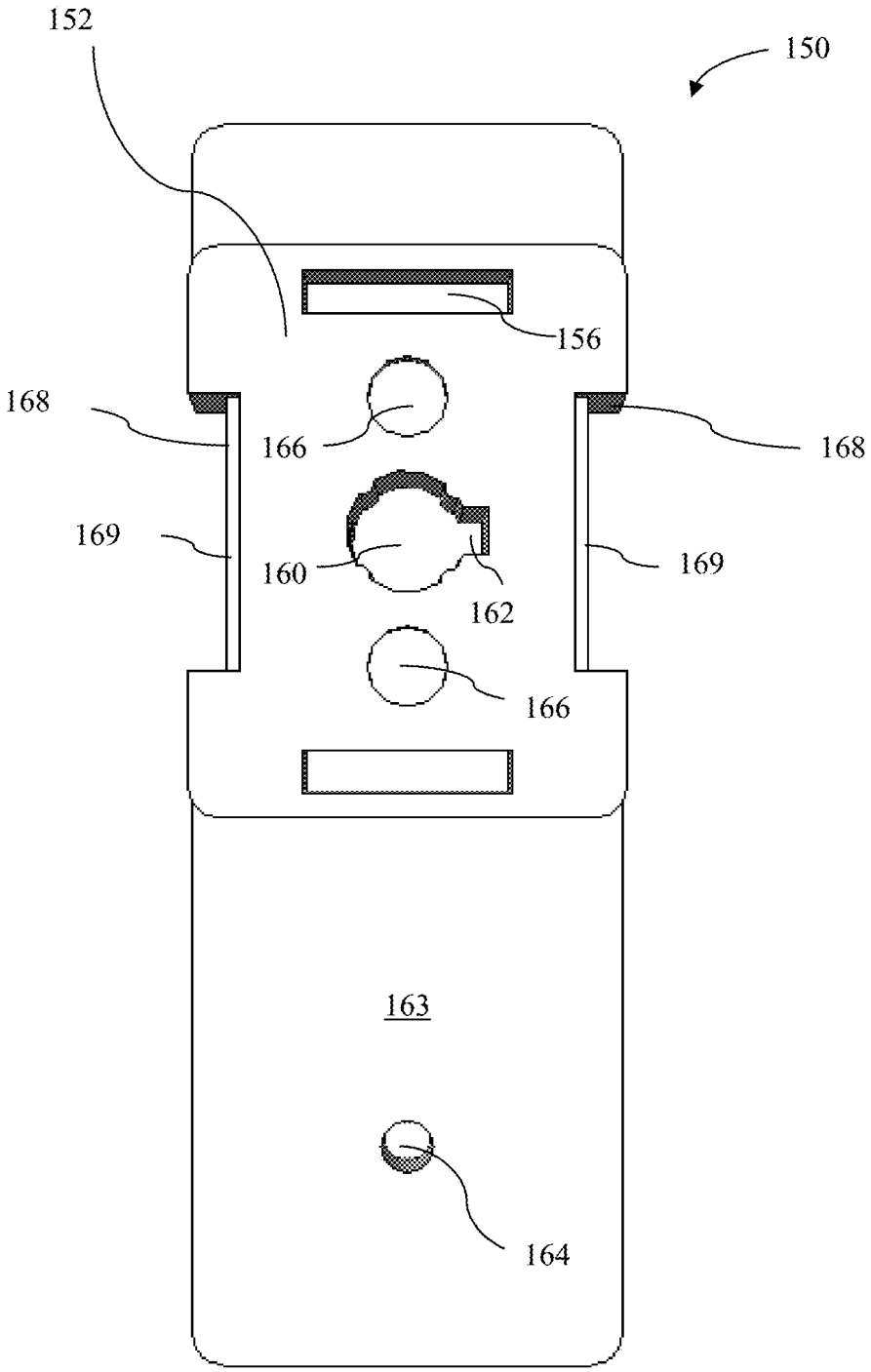
FIG. 5E is a top view of the main bottom body of FIG. 2A according to certain embodiments of the present invention.

Main bottom body 150 may comprise an aperture 160, as shown in FIGS. 5A and 5B-5E, which may be centrally located within the top surface 152 of the main bottom body 150. In some aspects, aperture 160 may be centrally located within one end of main bottom body 150, as shown in FIGS. 5C-5E. Aperture 160 may be substantially circular in shape, although other geometric shapes are contemplated. In some aspects, as shown in FIGS. 5A and 5C-5E, aperture 160 may have a contoured shaped, such as ridges around the aperture 160 periphery. For example, aperture 160 can comprise a rectangular-shaped ridge 162 as best shown in FIG. 5D-5E. In use, aperture 160 is configured to receive capillary holder 191 of capillary cap 180. In some aspects, rectangular ridge 162 is configured to receive and guide capillary holder 191 and helps secure capillary holder 191 from rotating or moving about components of sample collection device 100 during normal use. In some aspects, the contoured shape of aperture 160, such as the ridges and rectangular ridge 162, may guide capillary holder 191 of the capillary cap 180 and guide capillary 192 during the depressing of the plunger 110 motion to puncture dome valve 197 of the reagent component 194.

FIGS. 5A and 5C-5E also shows main bottom body 150 comprising one or more indents 168. Main bottom body 150 is shown in FIGS. 5A and 5C-5E having two indents 168, each indent 168 proximate the peripheral edge of the elongated edge of main bottom body 150. In some aspects, main bottom body 150 has opposing indents 168 proximate the peripheral edge of the elongated edge of main bottom body 150. According to certain aspects, indents 168 can also comprise a ledge 169. In some aspects ledge 169 is proximate the peripheral edge of indent 168. In some aspects, indent 168 and ledge 169 are each configured to have a coupling "L" shape. For example, the "L" shaped configuration of indent 168 and ledge 169 allows the "L" shape of stop legs 120, shown in FIG. 3B, to operably engage with main bottom body 150 such that ledge 122 "clips" into indent 168 and ledge 169 when plunger 110 is in the depressed position, such as shown in FIG. 1C. In some aspects, the operable connection of stop legs 120 with ledge 169 prohibits plunger 110 from being pulled away from the main bottom body 150 or moved in a direction away from the main bottom body 150 and towards the top surface 113 of plunger 110 when plunger 110 is in the depressed position.

In some aspects main bottom body 150 may also have one or more depressions 166, such as the two depressions, shown in FIGS. 5C and 5E, extending into main bottom body 150. The two depressions 166 may be on opposing sides of aperture 160 on the top surface 152 from each other. The two depressions 166 are configured to have a round shape that functions as a positioning mechanism with respect to the main top body 130. In some aspects, each depression 166 is configured to receive a corresponding projection 142 of main top body 130. During normal use, the coupling of each depression 166 with a corresponding projection 142 to prevent shifting of the two components during normal use. In certain aspects, projections 142 act as positioning guides for main top body 130 as it engages with main bottom body 150 to stabilize the components of sample collection device 100 as other components of sample collection device 100 are assembled and used.

Main bottom body 150 may also comprise air channel 158, which as shown in FIGS. 5A-5C, is configured to provide fluid connection between aperture 160 and the exterior of the main bottom body 150 proximate the peripheral edge of indent 168, such that air channel 158 traverses through main bottom body 150 to aperture 160. During normal use, air channel 158 allows a fluid connection between capillary tube 192 and the exterior atmosphere to enable a sample to be drawn into capillary tube 192 while plunger 110 is in the undepressed position.

Referring now to FIGS. 5B-5E, main bottom body 150 may also comprise an elongate portion 163. As seen in FIGS. 5C-5E, elongate portion 163 of main bottom body 150 may comprise an aperture 164 providing an air channel that operably couples with capture chamber 286 when the sample collection device 100 is operably coupled with chemical capture cartridge 200.

Figure 6A:
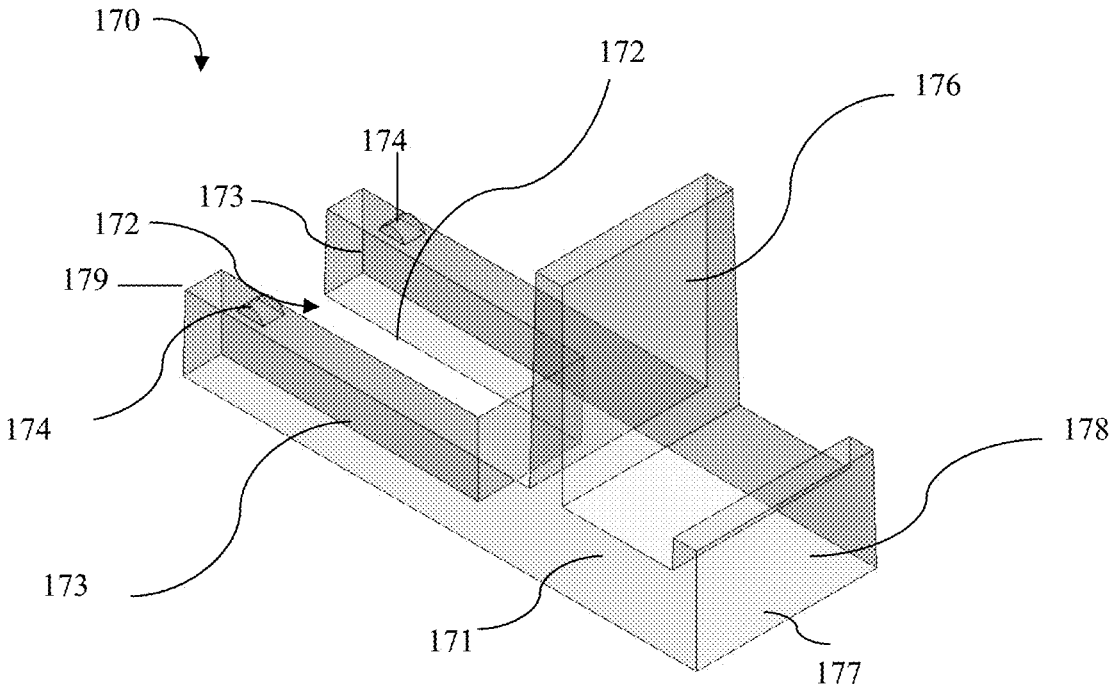
FIG. 6A is a transparent perspective view of a depression stop of the sample collector in FIG. 1A according to certain embodiments of the present invention.
Figure 6B:
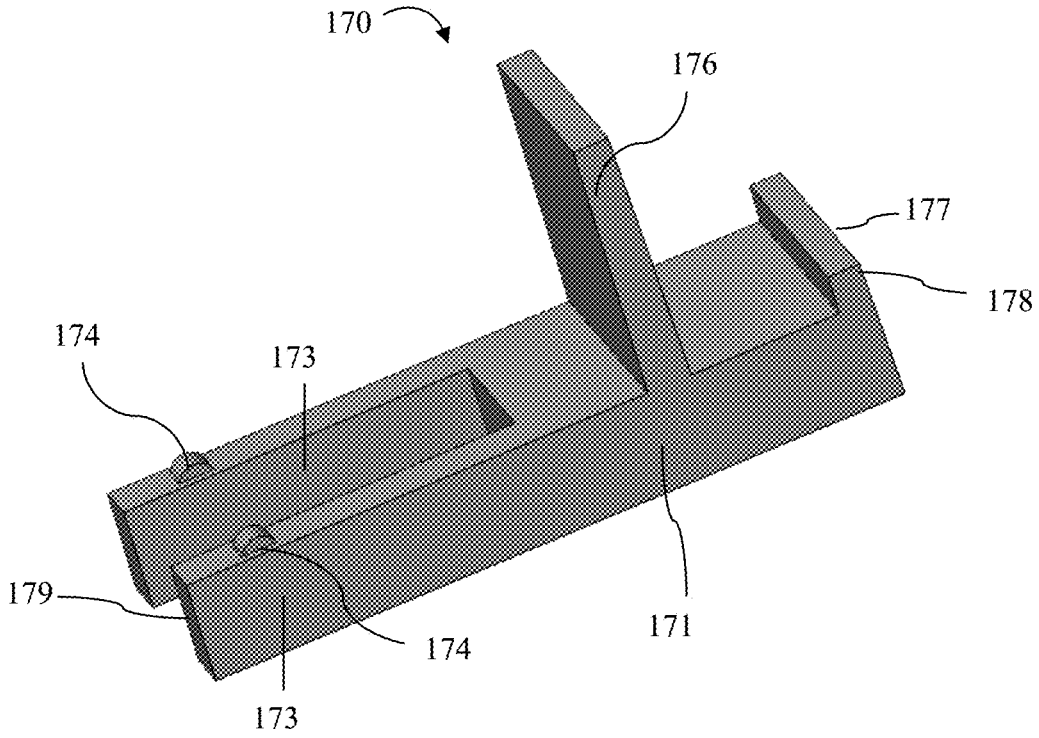
FIG. 6B is a perspective view of the depression stop of FIG. 6A according to certain embodiments of the present invention.

Referring to FIGS. 6A and 6B, one embodiment of depression stop 170 is illustrated. Depression stop 170 generally comprises a main body portion 171 having at least one elongate leg 173 extending in a substantially perpendicular configuration to elongated peak 176. Depression stop 170 may also have a second elongated peak 178 proximate a distal end 177 of depression stop 170 also in a substantially perpendicular configuration to one or more elongated legs 173. In some aspects, elongated peak 176 extends further than second elongated peak 178 from the main body portion 171. In some aspects, elongated peak 176 and second elongated peak 178 extend from main body portion 171 in a substantially parallel configuration. In some aspects, depression stop 170 has at least two elongated legs 173 spaced apart from each other, as shown in FIGS. 6A-6B, and in a substantially parallel configuration. The space between elongated legs 173 provides center slot 172, such that during normal operation elongated legs 173 are located on opposite sides of aperture 160 and corresponding capillary holder 191 and capillary tube 192.

Figure 6C:
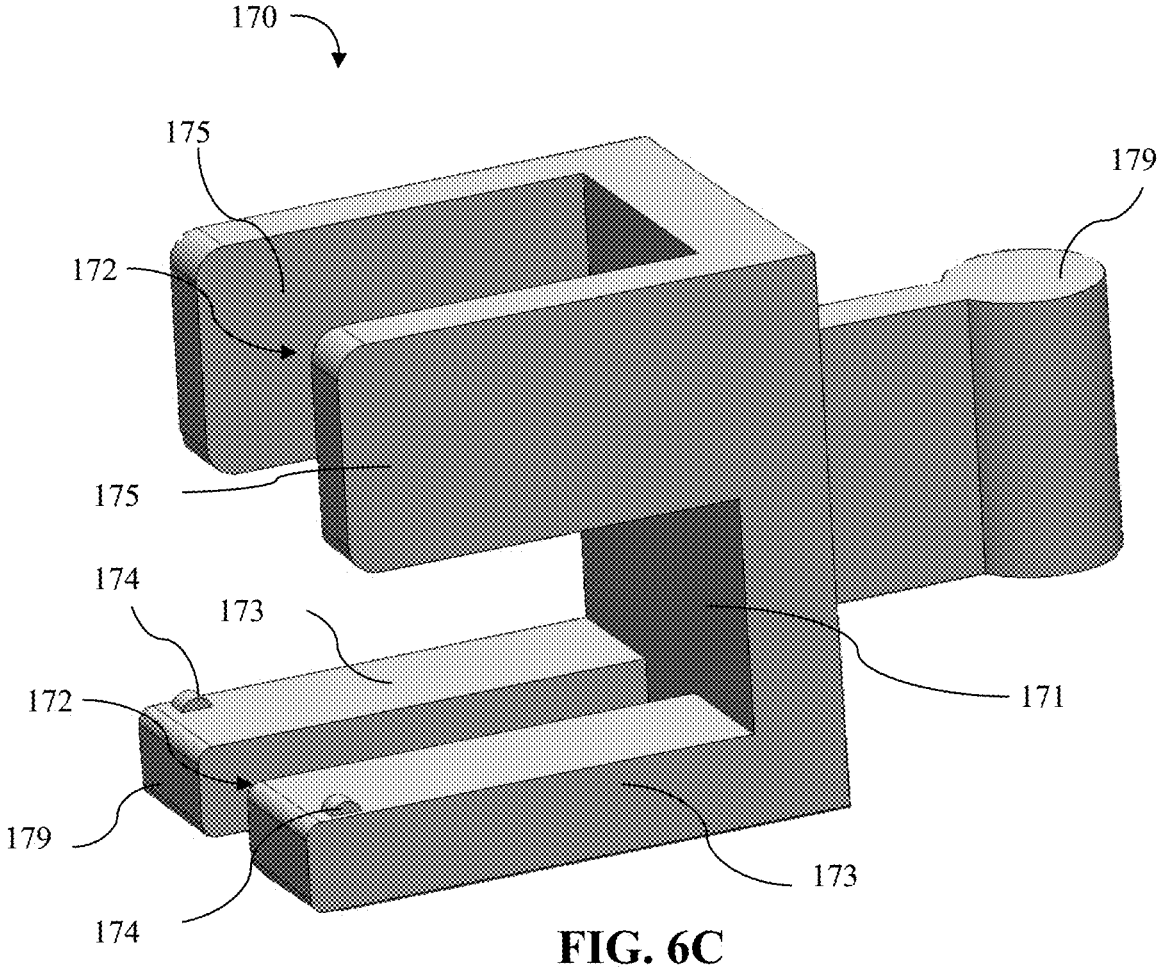
FIG. 6C is a perspective view of a depression stop of the sample collector in FIG. 2A according to certain embodiments of the present invention.

Referring now to FIG. 6C, another of depression stop 170 is illustrated. Depression stop 170 generally comprises a main body portion 171 having at least one elongate leg 173 and at least one elongate leg 175, each of elongate legs 173, 175 extending in a substantially perpendicular configuration to main body portion 171. In this embodiment, main body portion extends between elongate legs 173, 175, such that there is spacing provided between elongate legs 173, 175. Depression stop 170 may also have a handle portion 179 extending in a substantially perpendicular configuration to main body portion 171 in a direction opposite elongate legs 173, 175. In some aspects, handle portion 179 has a configuration to allow a user to be able to grab and pull depression stop 170. In some aspects, depression stop 170 has at least two elongated legs 173 spaced apart from each other, as shown in FIG. 6C, and in a substantially parallel configuration. The space between elongated legs 173 provides center slot 172, such that during normal operation elongated legs 173 are located between elongated legs 114 but on opposite sides of aperture 160 and corresponding capillary holder 191 and capillary tube 192. In some aspects, depression stop 170 also has at least two elongated legs 175 spaced apart from each other, as shown in FIG. 6C, and in a substantially parallel configuration. The space between elongated legs 175 provides approximately the same center slot 172, such that during normal operation elongated legs 175 are located between elongated legs 114 but on opposite sides of bubble pack 194.

In FIGS. 6A-6C each elongated leg 173 is shown as having a protruding bump 174 located the proximate end 179 of depression stop 170. In some aspects, each elongated leg 173 has one protruding bump 174. In some alternative aspects, each elongated leg 173 has more than one protruding bump 174. During normal use, each protruding bump 174 helps to prevent premature removal of depression stop 170. For instance, when depression stop 170 is operably located between the bottom surface 154 of main bottom body 150 and the top portion 181 of capillary cap 180, such that elongated peak 176 is operably engaged with indents 136, 168 of the main top body 130 and main bottom body 150, respectively, as shown in FIGS. 1A and 1B, protruding bumps 174 operably engage with the ledge 169 of opposing indent 168 to prevent the depression stop 170 from inadvertently being removed during normal operation while plunger 110 is in the undepressed position.

In some aspects, elongated legs 173 are a length such that they are capable of extending at least partially through other components of sample collection device 100 as seen in FIGS. 1A-1B and 2A-2C. In certain aspects, elongated legs 173 have a length that transverses the width of the bottom surface 154 of main bottom body 150 and the top portion 181 of capillary cap 180 when the depression stop 170 is operably engaged between the main bottom body 150 and the capillary cap 180 during normal use when plunger 110 is in the undepressed position.

According to certain aspects, elongated peak 178 or handle portion 179 function as a griping mechanism for insertion and removal of depression stop 170 during normal use. In some aspects as shown in FIGS. 1A-1B, elongated peak 176 is configured to operably engage with the bottom surface of a short leg 120 when depression stop 170 is inserted between main bottom body 150 and capillary cap 180. In some aspects, engagement of top surface of elongated peak 176 and bottom surface of short leg 120 prohibits premature compression of components of device 100. In some other aspects, as shown in FIGS. 2A-2C, elongated legs 173 of depression stop 170 are inserted between main bottom body 150 and capillary cap 180 and elongated legs 175 of depression stop 170 are inserted between main top body 130 and bottom surface 115, which prohibits premature compression of components of device 100.

Figure 7A:
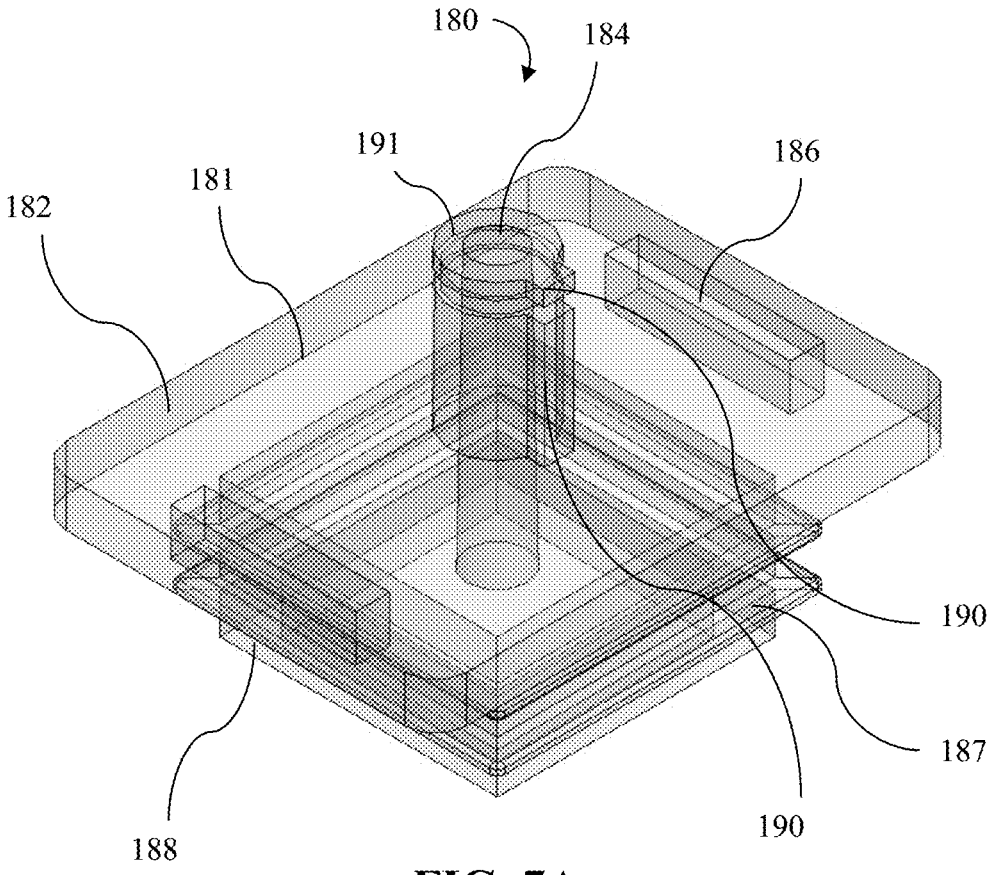
FIG. 7A is a transparent top perspective view of a capillary holder and cap of the sample collection device in FIG. 1A according to certain embodiments of the present invention.
Figure 7B:
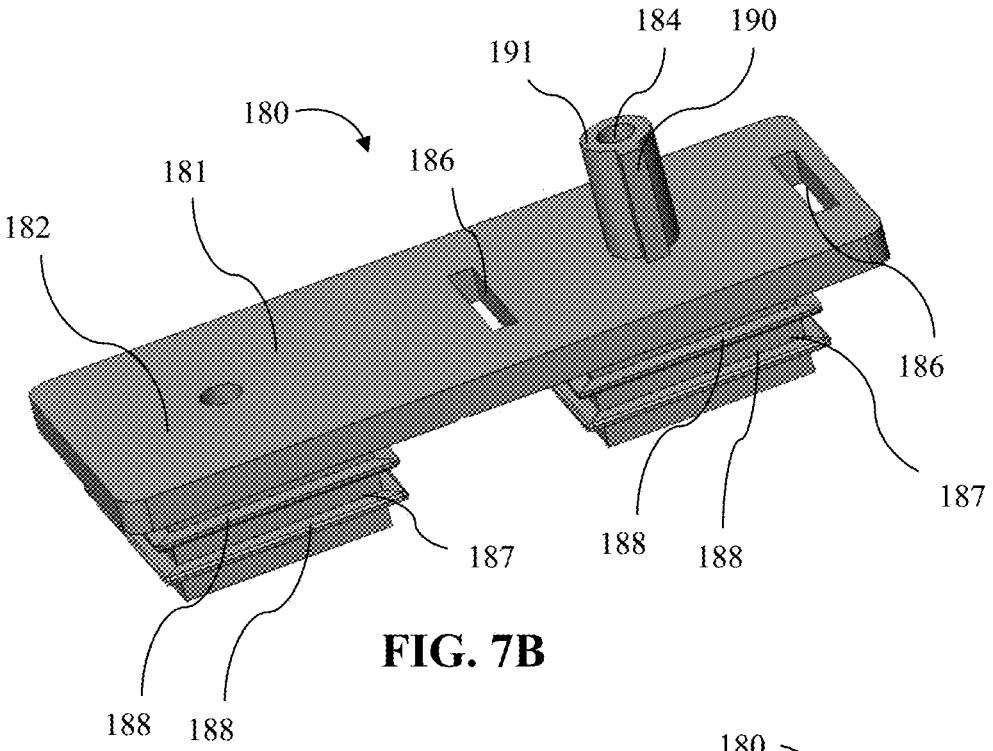
FIG. 7B is a top perspective view of a capillary holder and cap of the sample collection device in FIG. 2A according to certain embodiments of the present invention.
Figure 7C:
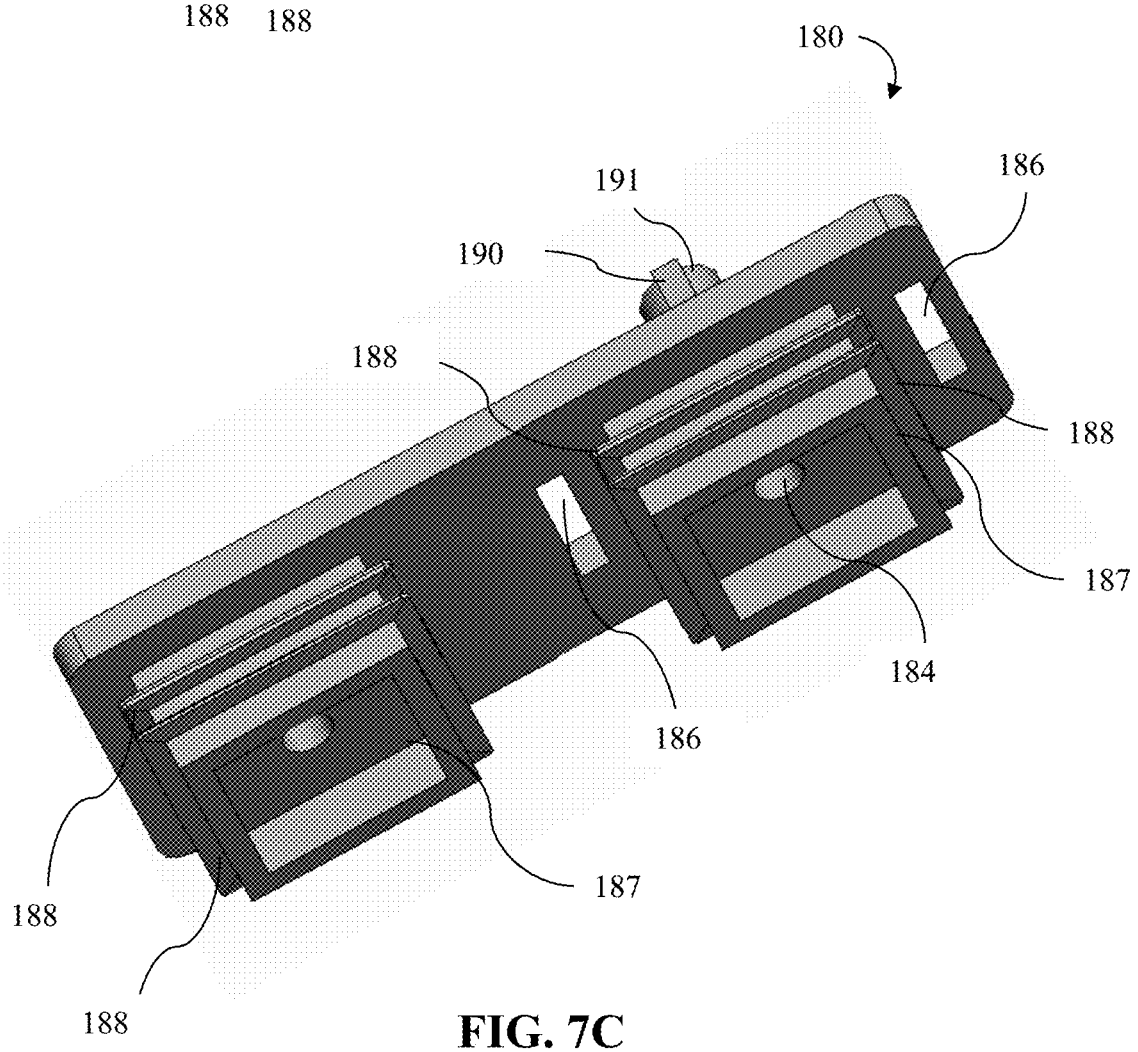
FIG. 7C is a bottom perspective view of a capillary holder and cap of the sample collection device in FIG. 2A according to certain embodiments of the present invention.

Referring now to FIGS. 7A-7C showing capillary cap 180 generally comprising top portion 181, top surface 182, capillary aperture 184, one or more slots 186, one or more bottom projections 187 each having one or more fins 188, and capillary holder 191 having a ridge 190.

Figure 8:
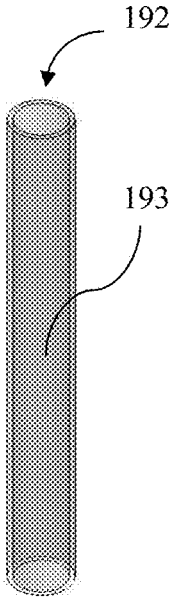
FIG. 8 is a transparent perspective view of a capillary tube of the sample collection device in FIGS. 1A and 2A according to certain embodiments of the present invention.

Top portion 181 generally has a top surface 182 that may have a smooth surface. In some aspects, top surface 182 has the same configuration and contour as the bottom surface 154 of the main bottom body 150. In some aspects, capillary cap 180 has a capillary holder 191 projecting from top portion 181 in a direction extending away from and perpendicular with top surface 182. In some aspects, capillary holder 191 has a capillary aperture 184 having a generally configured in a circular shape to receive at least a top portion of capillary tube 192, which is depicted in FIG. 8.

In some aspects, capillary holder 191 has a ridge 190, which has a corresponding shape and contour as ridge 162 of aperture 160 of the main bottom body 150. In some aspects ridge 190 is rectangular in shape, which can be received by the rectangular-shaped ridge 162 of aperture 160. In some aspects, at least a portion of capillary holder 191 is capable of being inserted into aperture 160 of main bottom body 150. During normal use, ridge 190 is capable of operably coupling with ridge 162 of aperture 160 to function as a locking mechanism when the capillary cap 180 and main bottom body 150 are pressed together and operably engaged. For instance, ridge 190 selectively engages with ridge 162 of aperture 160 of main bottom body 150, which functions to lock capillary holder in place and prevents capillary holder 191 from moving or rotating within aperture 160.

As shown in FIG. 7A, capillary cap 180 may also have a bottom projection 187 extending in a direction opposite top surface 182. In some other aspects, as shown in FIGS. 7B-7C, capillary cap 180 has two bottom projections 187 extending in a direction opposite top surface 182. Each bottom projection 187 is a length such that it is capable of extending at least partially through chemical capture cartridge 200 as seen in FIGS. 15A-15D. In some aspects, one bottom projection 187 operably engages with the top opening of sample chamber 288 while the other bottom projection 187 operable engages with the top opening of capture chamber 286.

Bottom projections 187 are shown as having one or more fins 188. According to certain aspects, the one or more fins 188 are proximate the periphery of each bottom projection 187 and extend from each bottom projection 187 in a direction parallel to top surface 182. In some aspects, fins 188 are spaced in successive rows such that there is a space between each fin 188. Fins 188 are such a length that bottom projection 187 can be inserted into the respective chamber (286, 288) of chemical capture cartridge 200, such that fins 188 during normal use function to align and secure capillary cap 180 as it is inserted into chemical capture cartridge 200. In some aspects when capillary cap 180 is inserted in chemical capture chamber 200, fins 188 form a seal between capillary cap 180 and the respective chamber 286, 288 of chemical capture cartridge 200 and prevent flow of air or other components into or out of the chemical capture cartridge 200.

In some aspects, as shown in FIGS. 7A-7C, capillary cap 180 has one or more slots 186, preferably two slots 186 on opposing sides of the capillary cap 180. In some aspects slots 186 are substantially rectangular in shape. In an alternative aspect, slots 186 are a shape such that they are capable of receiving elongated legs 114 as seen in FIGS. 1A and 2A. In use, slots 186 help guide and align elongated legs 114 as they are inserted through components of sample collection device 100.

During normal use, elongated legs 173 of depression stop 170 are inserted between capillary cap 180 and main bottom body 150, as shown in FIGS. 1A and 2A, such that center slot 172 formed between elongated legs 173 straddles aperture 160 having capillary holder 191 partially inserted therein. When depression stop 170 is removed and plunger 110 is moved from the unpressed position to the depressed position, main bottom body 150 and capillary cap 180 are pressed together with capillary holder 191 and capillary tube 192 projecting further into aperture 160 with capillary holder 191 sealing air channel 158. Based upon the foregoing disclosure, one of ordinary skill will appreciate that the insertion of depression stop 170 with elongated legs 173 between the main bottom body 150 and capillary cap 180 creates a space between main bottom body 150 and capillary cap 180. In some aspects, this space prevents full insertion of capillary holder 191 through main bottom body 150 prior to plunger 110 depression. In some aspects, this space functions to allow air flow through air channel 158 of main bottom body 150 and fluid connection between capillary 192 in capillary holder 191 and the exterior atmosphere, which allows a sample to be drawn into capillary 192 by capillary action prior to capillary holder 191 being completely inserted through aperture 160. In some other aspects, the space functions to allow capillary action through capillary tube 192.

Sample collection device 100 may be used with a capillary tube 192, which is shown in FIG. 8, with a top portion of the capillary tube 192 operably engaged within capillary holder 191 and a bottom portion of the capillary tube 192 extending from the bottom portion of capillary cap 180, such that a sample can be drawn into capillary tube 192. In some aspects, capillary tube 192 is generally comprised of a material suitable for collection of a sample into sample collection device 100. In some aspects, capillary tube 192 is comprised of tubular glass, metal, plastic, or other suitable materials for the sample to be collected.

Figure 9:
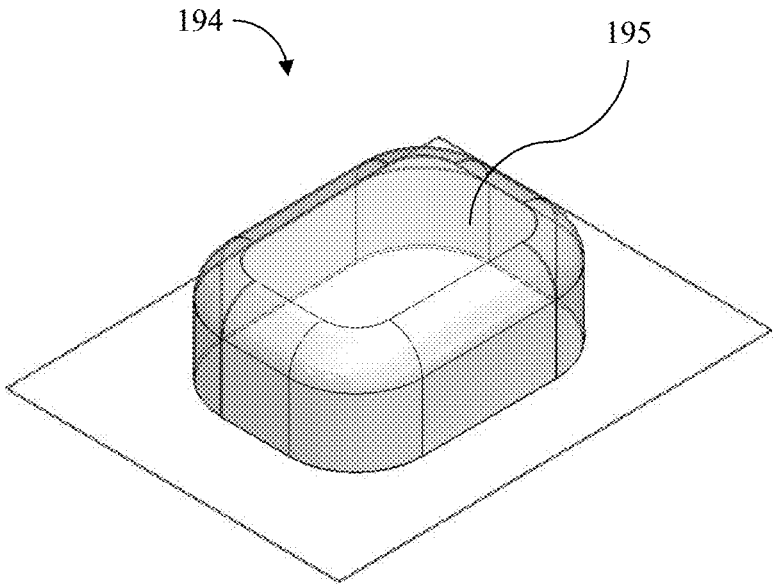
FIG. 9 is a transparent perspective view of a wash reagent bubble of the sample collection device in FIGS. 1A and 2A according to certain embodiments of the present invention.

The sample collection device 100 may contain a solution reagent component 194 shown in FIG. 9, which can be inserted between plunger 110 and the top surface of top main body 130. The reagent component 194 may be configured to be inserted within an inset on the top surface 132 of main top body 130. Reagent component 194 generally has the same surface area and dimensions as top portion 114 of plunger 110. During normal use, a layer or film of adhesive may be applied between the top surface 132 of main top body 130 and the bottom surface 196 of reagent component 194. One of ordinary skill in the art will appreciate that the adhesive may be selected for a particular application. The reagent component 194 contains a wash solution and/or dilution solution for use with the sample collection device 100. The particular solution within the reagent component 194 can be selected for a particular application. For example, the solution can be deionized water, a buffer solution, or any other solution to rinse the sample in the capillary tube 192 into the sample chamber 288 of cartridge 200.

As shown in FIGS. 1D and 2D, sample collection device 100 may have valve 197 located between main top body 130 and main bottom body 150. In some aspects, valve 197 can be seated within aperture 138, such that aperture 138 may be configured to have a shape capable of receiving valve 197. In some aspects, aperture 138 is shaped to receive valve 197 having the shape of two concentric stacked circles with one circle smaller in size than the other circle. In some aspects, valve 197 may be comprised of silicone or other acceptable elastomeric material. In some aspects, valve 197 has a central aperture allowing fluid communication between the top surface 132 having reagent component 194 and the main bottom body 150. In some aspects, valve 197 is sealed and can be punctured by the top portion of capillary tube 192 during depression of plunger 110 to the depressed position. When plunger 110 is depressed into the depressed position, the top portion of capillary tube 192 may also puncture reagent component 194 allowing the sample contained within capillary tube 192 to be washed out of the capillary tube. In some aspects, the sample is washed into the sample chamber 288 of chemical capture cartridge 200.

Referring now to FIGS. 11A-11D, during normal use sample collection device 100 may be operably coupled to chemical capture cartridge 200, such that the sample collected within sample collection device 100 can be deposed into chemical capture cartridge 200. Chemical capture cartridge 200 generally comprises a bubble protector slide 210, reagent bubble plate 212, bubble protector plate 220, reagent channel plate 240, channel spacer 260, air channel plate 268, and chamber plate 280.

As depicted in FIGS. 11B and 12D-13, bubble protector slide 210, reagent bubble plate 212, bubble protector plate 220, reagent channel plate 240, channel spacer plate 260, air channel plate 268, and chamber plate 280 are configured to allow fluid connection between various components, including one or more reagents from the reagent bubble plate 212 to the chamber plate 280 and air or other desired gas or fluid from the air channel plate 268 to desired chambers within the chamber plate 280. Each of the bubble protector slide 210, reagent bubble plate 212, bubble protector plate 220, reagent channel plate 240, channel spacer plate 260, air channel plate 268, and chamber plate 280 are also configured to provide the chemical capture cartridge 200 with an overall square or rectangular shaped configuration, although other shapes are contemplated.

Figure 15A:
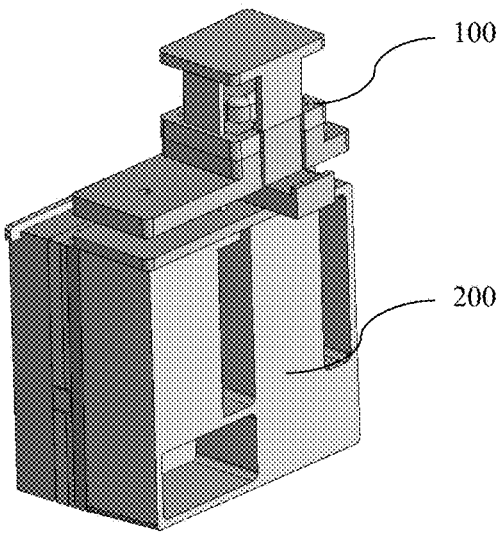
FIGS. 15A-15D are perspective views of the sample collection device of FIG. 1A operably connected to the cartridge of FIG. 11A for a chemical detection device according to certain embodiments of the present invention.
Figure 15B:
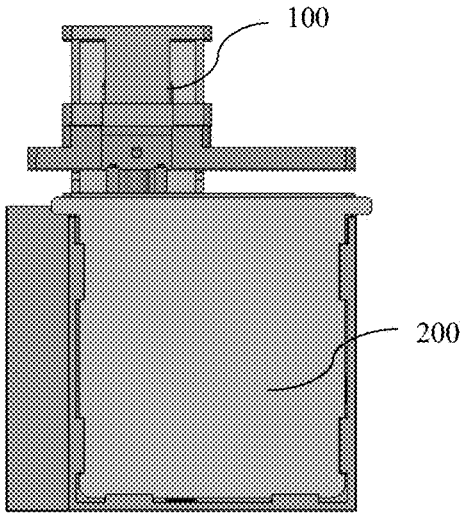
Figure 15C:
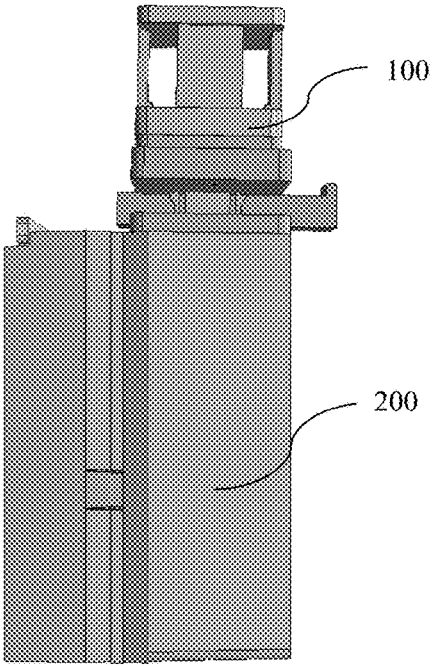
Figure 15D:
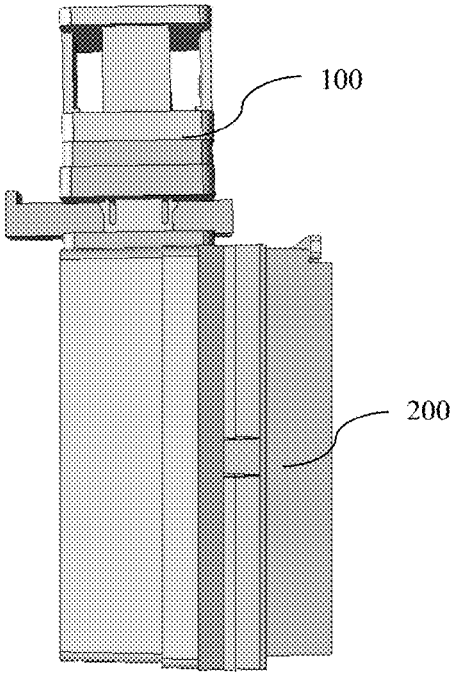
Figure 16A:
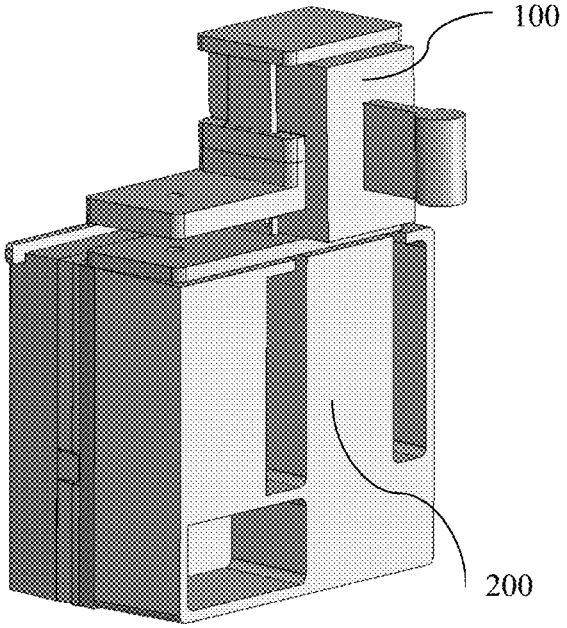
FIGS. 16A-16C are perspective views of the sample collection device of FIG. 2A operably connected to the cartridge of FIG. 11A for a chemical detection device according to certain embodiments of the present invention.
Figure 16B:
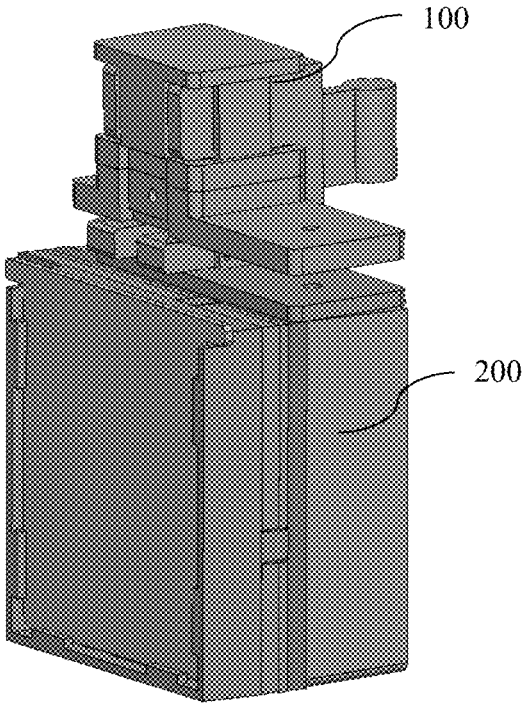
Figure 16C:
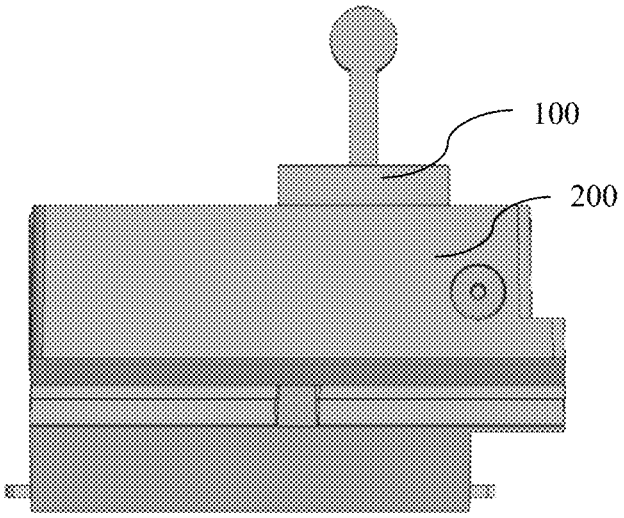

In some aspects, bubble protector slide 210, as shown in FIGS. 11A-13, 15B and 16B is generally square in shape. In some aspects, bubble protector slide 210 has one or more flanges that operably engage with bubble protector plate 220, as shown in FIG. 15B. In some aspects, best shown in FIGS. 10B and 15B, bubble protector slide 210 has two flanges. In some aspects, bubble protector slide 210 has two flanges with each flange extending in opposite directions from two opposing top corners of bubble protector slide 210. During normal use, bubble protector slide 210 operably engages by sliding within a channel of bubble protector plate 220, which functions to also hold bubble plate 220 within bubble protector plate 220.

Figure 11A:
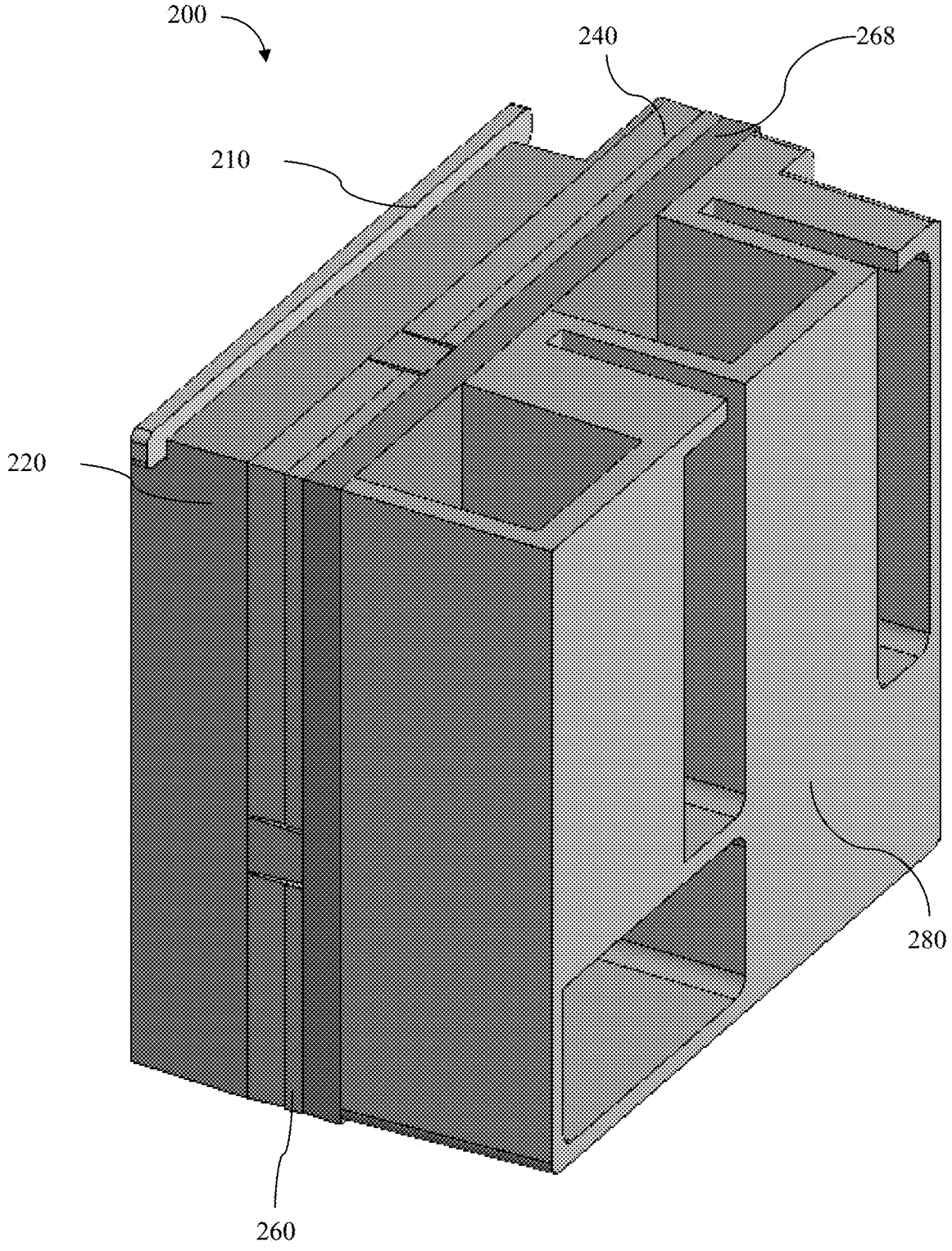
FIG. 11A is a top side perspective view of a cartridge according to certain embodiments of the present invention.
Figure 11B:
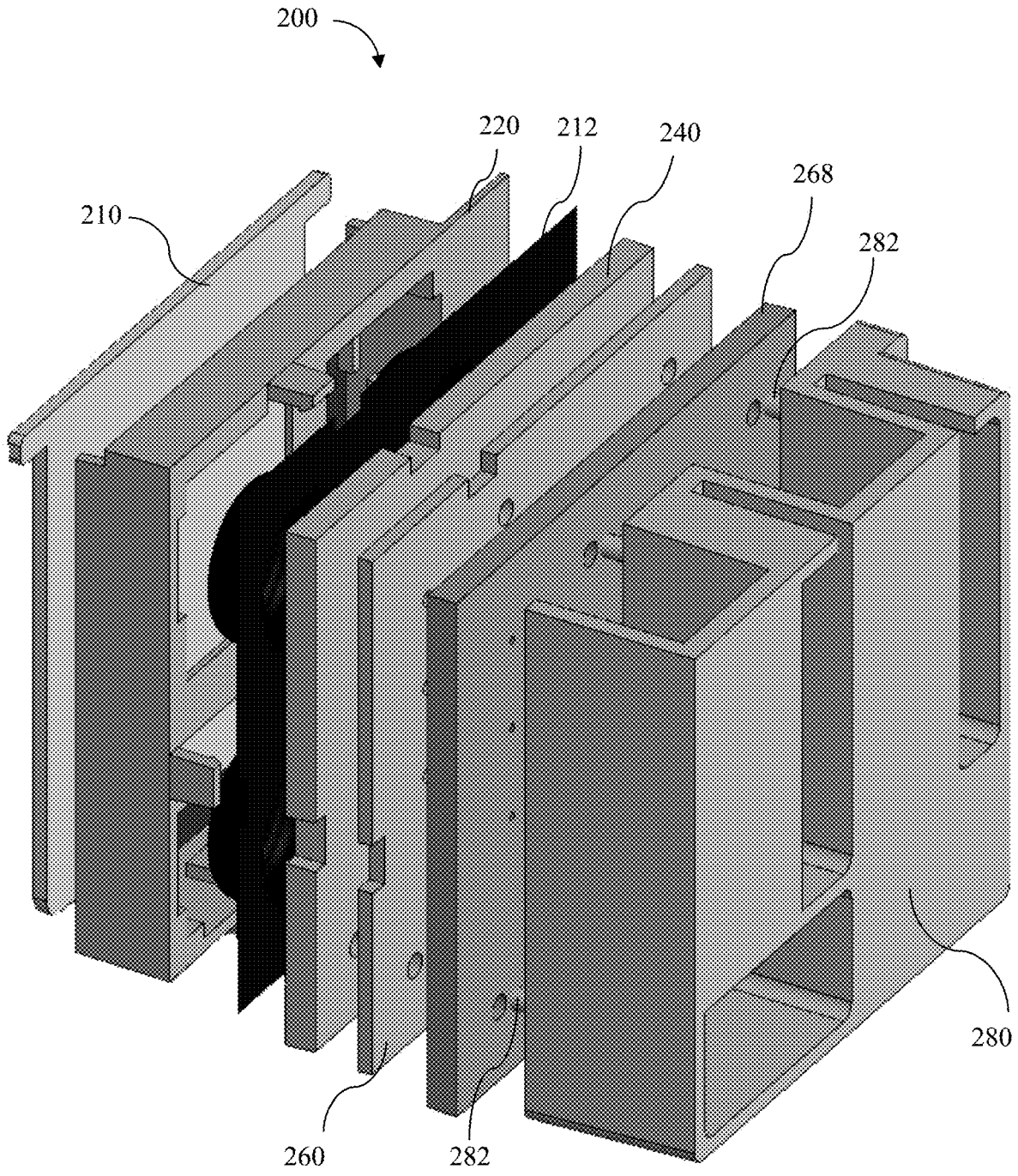
FIG. 11B is an exploded top side perspective view of the cartridge in FIG. 11A according to certain embodiments of the present invention.
Figure 11C:
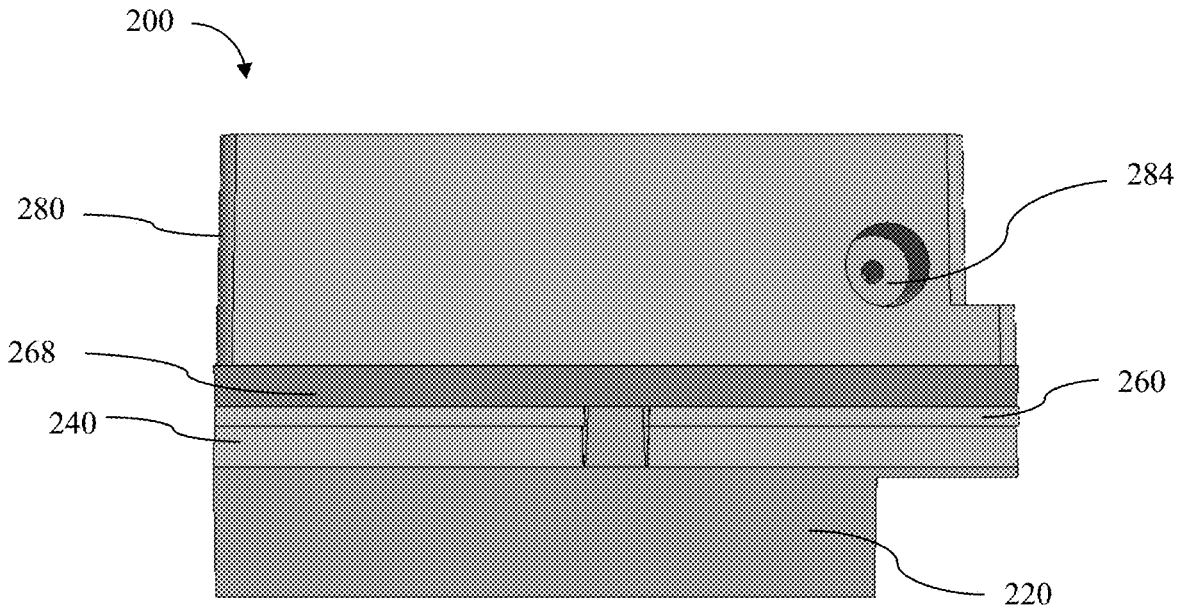
FIG. 11C is bottom view of the cartridge in FIG. 11A according to certain embodiments of the present invention.
Figure 11D:
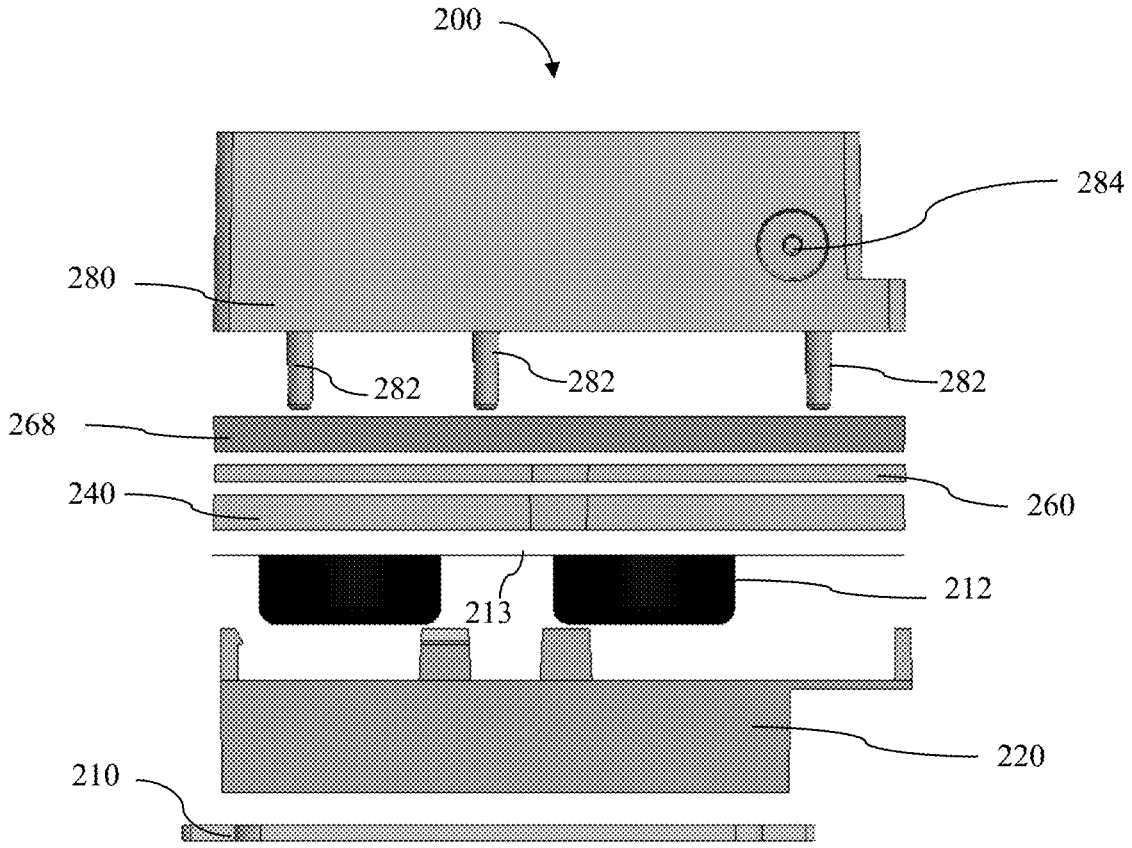
FIG. 11D is a bottom exploded top view of the cartridge in FIG. 11A according to certain embodiments of the present invention.
Figure 12A:
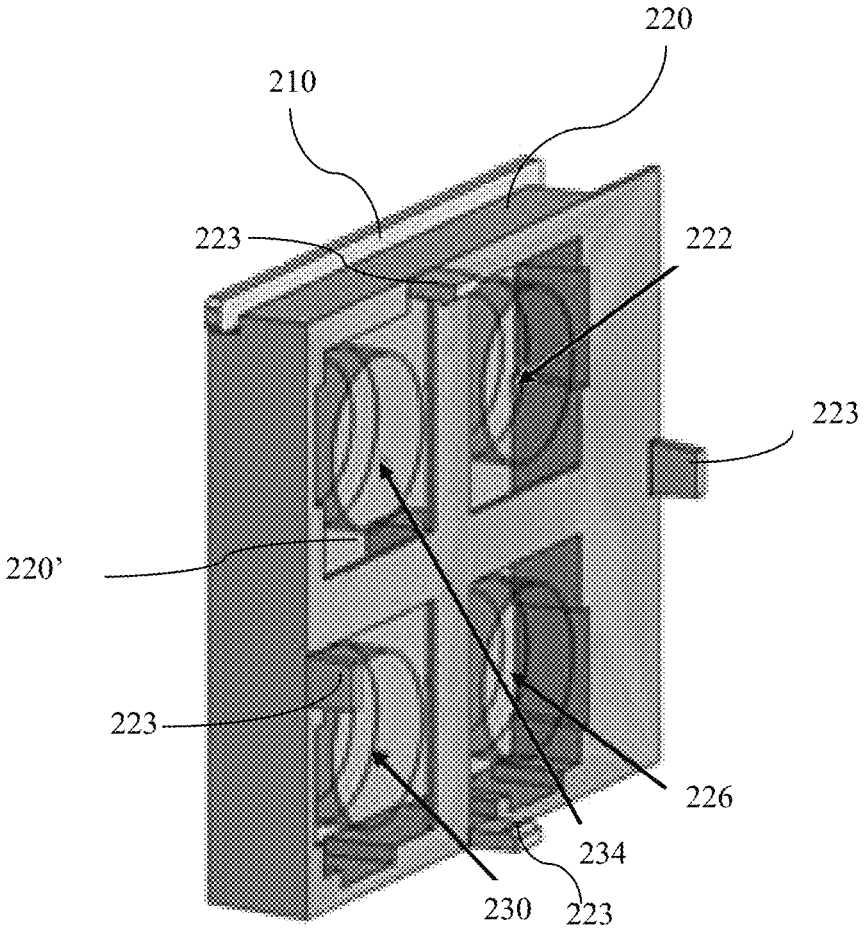
FIG. 12A is a partial transparent perspective view of a portion of a plate coupling of the cartridge in FIG. 11A according to certain embodiments of the present invention.
Figure 12B:
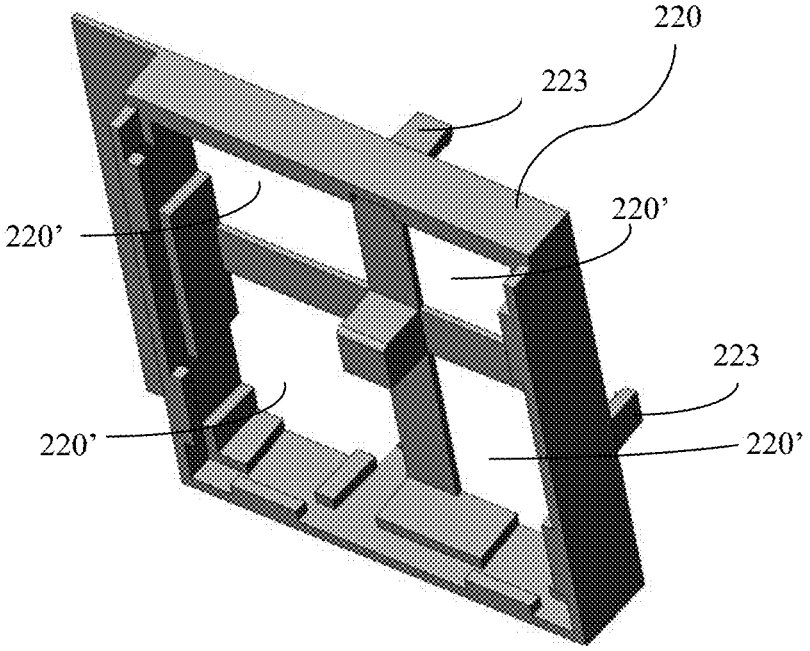
FIG. 12B is a backside perspective view of a bubble protector plate of the cartridge in FIG. 11A according to certain embodiments of the present invention.
Figure 12C:
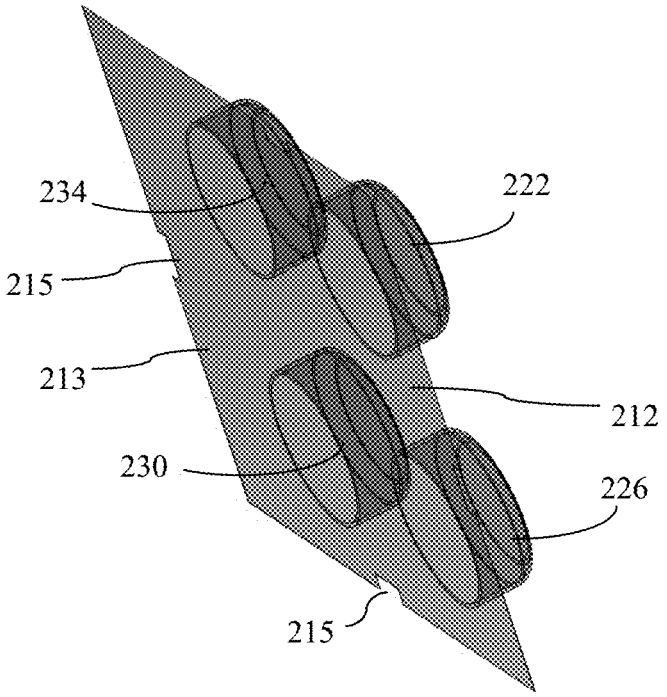
FIG. 12C is a perspective view of a bubble plate of the cartridge in FIG. 11A according to certain embodiments of the present invention.

Referring now to FIGS. 11B, 11D, 12A and 12C, reagent bubble plate 212 may be configured to be coupled between bubble protector plate 220 and reagent channel plate 240. In some aspects, reagent bubble plate 212 has one or more reagent bubbles, in some aspects two or more reagent bubbles, and as shown in FIGS. 12A and 12C four reagent bubbles depicted as 222, 226, 230, and 234. In some aspects, each reagent bubble 222, 226, 230, and 234 has a geometric shape and volume capable of holding a liquid reagent therein. As shown in FIG. 11D, the reagent bubble plate 212 has a flat face 213 that operably engages with reagent channel plate 240, such that the protruding portion of each reagent bubble 222, 226, 230, and 234 extends towards bubble protector slide 210. In some preferred aspects, each reagent bubble 222, 226, 230, and 234 has a cylindrical shape or bubble shape that protrudes from the flat face 213. Reagent bubble plate 212 may be configured to have one or more recesses 215, as shown in FIG. 12C, that function to give space to clips 223 of operable connect bubble protector plate.

In some aspects, each reagent bubble 222, 226, 230, and 234 houses a reagent within the reagent bubble. In some aspects, the reagents within each reagent bubble 222, 226, 230, and 234 may be the same or different among the various reagent bubbles. One of ordinary skill will appreciate that the type of reagent in each reagent bubble will depend upon the specific chemical being tested. In some aspects, each reagent bubble 222, 226, 230, and 234 can house between about 5 μL and about 5 mL, in some aspects between about 10 μL and about 1 mL, in some other aspects between about 15 μL and about 750 and in some other aspects between about 20 μL and about 500 μL.

In some preferred aspects relating cyanide detection, reagent bubble plate 212 of FIGS. 12A and 12C comprises taurine in reagent bubble 222 (Taurine bubble 222), an acid in reagent bubble 226 (acid bubble 226), a base in reagent bubble 230 (base bubble 230), and Napththalene-2-3-di-aldeyde (NDA) in reagent bubble 234 (NDA bubble 234).

In some aspects, bubble protector plate 220, as shown in FIGS. 11A-12B may be generally rectangular in shape. As shown in FIGS. 12A-12B, bubble protector plate 220 may further comprise one or more cutouts 220' that are open space areas corresponding to one or more reagent bubbles of reagent bubble plate 212. In some aspects, cutouts 220' are generally rectangular in shape, although other geometric shapes, such as the shape of the reagent bubbles in a larger size, are contemplated. In some aspects, bubble protector plate 220 may one cutout, in some aspects two cutouts, in some aspects three cutouts, and in some preferred aspects as shown in FIGS. 12A-12B four cutouts corresponding to the four reagent bubbles of reagent bubble plate 212, and in some alternative aspects the same number of cutouts as reagent bubbles of the reagent bubble plate 212. In some aspects each cutout 220' may be positioned proximate a quadrant section of bubble protector plate 220. For instance, each cutout 220' is positioned such that each cutout 220' may have an exterior perimeter and an interior perimeter formed from bubble protector plate 220.

Bubble protector plate 220 is shown in FIGS. 12A-12B as having one or more clips 223 proximate the peripheral edge of the bubble protector plate 220 and located between the corners of bubble protector plate 220. In some aspects, each clip 223 projects outward from bubble protector plate 220 in a configuration perpendicular to the face of bubble protector plate 220. During normal use, clips 223 help to couple bubble protector plate 220 to other components of chemical capture device 200, such as reagent channel plate 240 and channel spacer plate 260, as best shown in FIG. 13.

As shown in FIGS. 12A-12B, one or more of the clips 223 may be configured to have an angled or serrated shape that functions as a locking mechanism in one direction, but allows bubble protector plate 220 to be removed in the opposite direction. For instance, one or more clips 223 are configured to allow bubble protector plate 220 to be pushed in a direction towards reagent channel plate 240 and channel spacer plate 260 and operably engage with reagent channel plate 240 and channel spacer plate 260, but prohibits bubble plate protector 220 from being pulled away from plate coupling 221.

Figure 13:
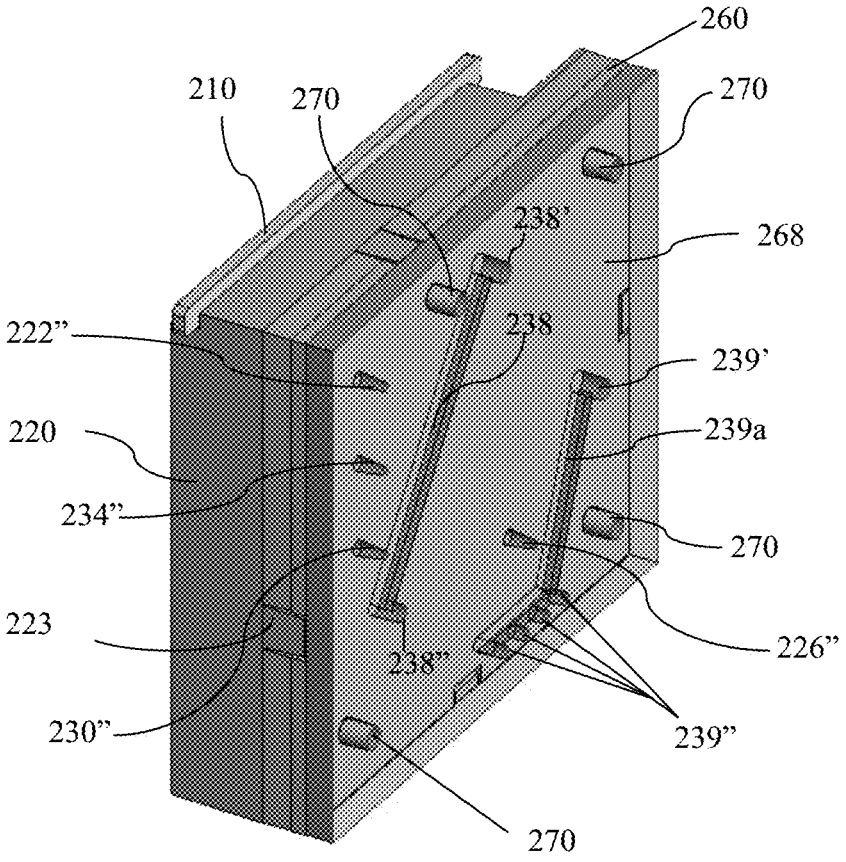
FIG. 13 is a partial transparent perspective view of a plate coupling of the cartridge in FIG. 11A according to certain embodiments of the present invention.

FIG. 13 shows a perspective view of a fluid plate coupling 221. In some aspects, plate coupling 221 comprises the one or more fluid handling plates between bubble plate 212 and chamber 280. In some aspects, plate coupling 221 comprises reagent channel plate 240, channel spacer plate 260 and air channel plate 268 coupled together. FIG. 13 shows plate coupling 221 operably engaged with bubble protector plate 220 and bubble protector slide 210. In some aspects channel plate 240, channel spacer 260 and air channel plate 268 are coupled to allow fluid connection between reagent bubble plate 212 and chamber plate 280, which is shown in FIGS. 12A and 13 having reagent bubbles 222, 226, 230, and 234 to illustrate the fluid connectivity. While discussed in more detail below, reagent channel plate 240 comprises one or more channels corresponding to each reagent bubble 222, 226, 230, and 234, channel spacer plate 260 has a connection channel connecting each of the reagent channels of reagent channel plate 240 with air channel plate 268 and chamber channels 286, 288 in chamber plate 280.

As shown in FIG. 13, plate coupling may also have one or more alignment holes 270. In some aspects, plate coupling has two or more alignment holes 270. In some aspects, as shown in FIG. 13, plate coupling has four alignment holes 270 generally configured to extend in an inward direction from the face of air channel plate 268 through channel spacer plate 260 and into reagent channel plate 240. During normal use, alignment holes 270 are configured to receive alignment pegs 282 and help align chamber plate 280 with plate coupling 221 during assembly, as shown best in FIGS. 11B and 11D. In some aspects, fasteners, such as a screw, are inserted through alignment holes 270 to connect chamber plate 280 with plate coupling 221.

Plate coupling may also be configured to have one or more recess configured to couple with clips 223 of bubble protector plate 220, which allows the bubble protector plate 220 to be snapped onto plate coupling as a locking mechanism. For instance, recesses are configured to allow plate coupling and bubble protector plate 220 to be operably engaged and prohibits the plate coupling and bubble protector plate 220 from being disconnected from each other during normal operation.

Referring now to the fluid connectivity of plate coupling. FIGS. 12A-13 show plate coupling with a plurality of channels that fluidly connect the reagent bubbles of reagent bubble plate 212 and chamber plate 280, as well as air channels, inlets and outlets of air channel plate 268.

Figure 12D:
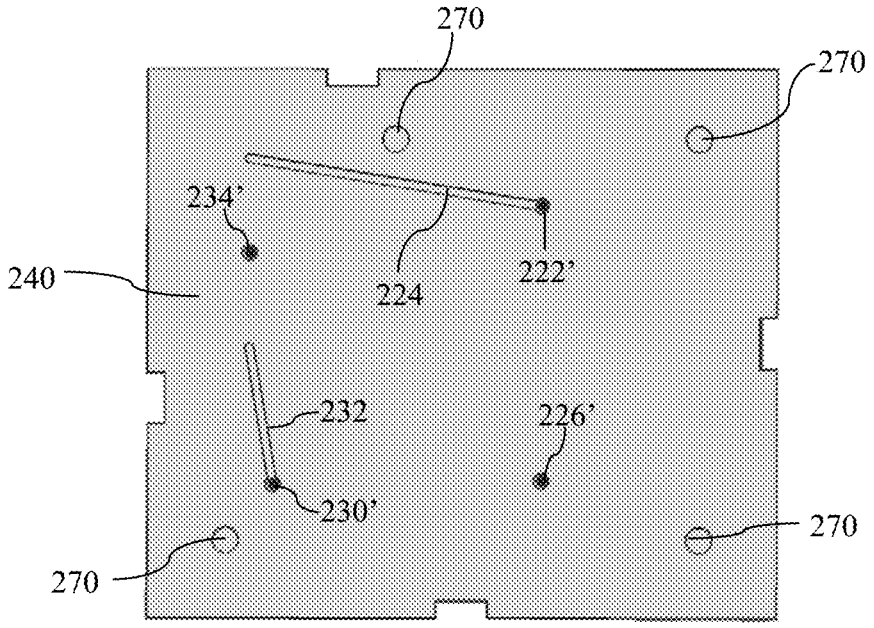
FIG. 12D is a plan view of a reagents channel plate of the cartridge in FIG. 11A according to certain embodiments of the present invention.
Figure 12E:
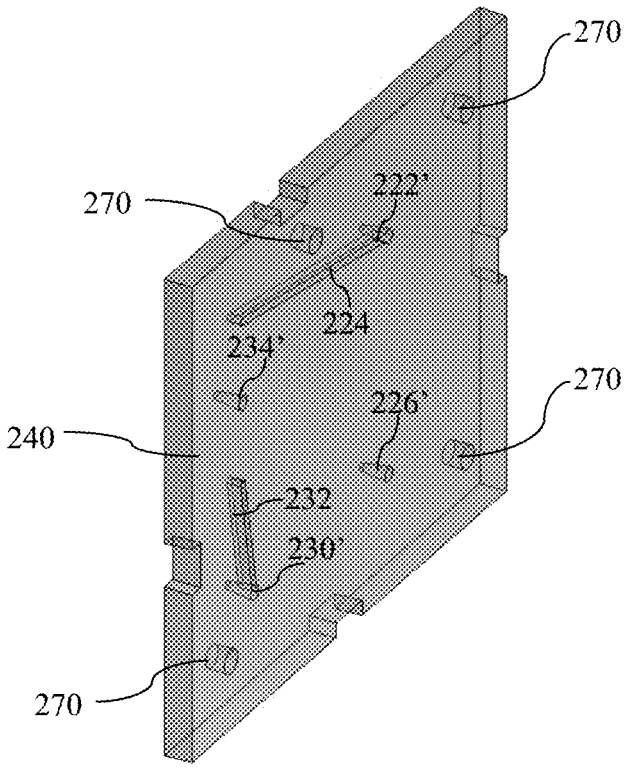
FIG. 12E is a top perspective view of the reagents channel plate of FIG. 12D according to certain embodiments of the present invention.

Referring now specifically to the reagent fluid connection between bubble plate 212 and chamber plate 280, as shown in FIGS. 12D-12E, reagent channel plate 240 has a plurality of reagent inlets 222', 226', 230' and 234' corresponding to each of reagent bubbles 222, 226, 230 and 234, respectively. In some aspects, each of reagent inlets 222', 226', 230' and 234' are apertures extending from the side corresponding to reagent bubble plate 212 of reagent channel plate 240 to the other side corresponding to channel spacer plate 260. During normal operation, reagent inlets 222', 226', 230' and 234' allow the corresponding reagent from reagent bubble plate 212 to flow from reagent bubble plate 212 through at least a portion of reagent channel plate 240. In some aspects, reagent inlet 222' corresponds with Taurine bubble 222, reagent inlet 226' corresponds with acid bubble 226, reagent inlet 230' corresponds with base bubble 230, and reagent inlet 234' corresponds with NDA bubble 234, such that the foregoing reagents are able to flow from reagent bubble plate 212 to flow from reagent bubble plate 212 through at least a portion of reagent channel plate 240.

Figure 12F:
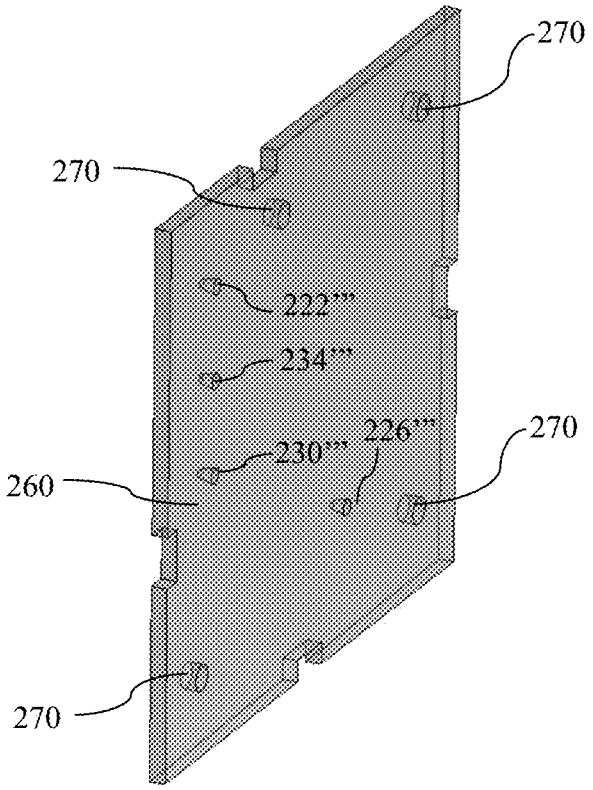
FIG. 12F is a top perspective view of the channel spacer plate of FIG. 11A according to certain embodiments of the present invention.
Figure 12G:
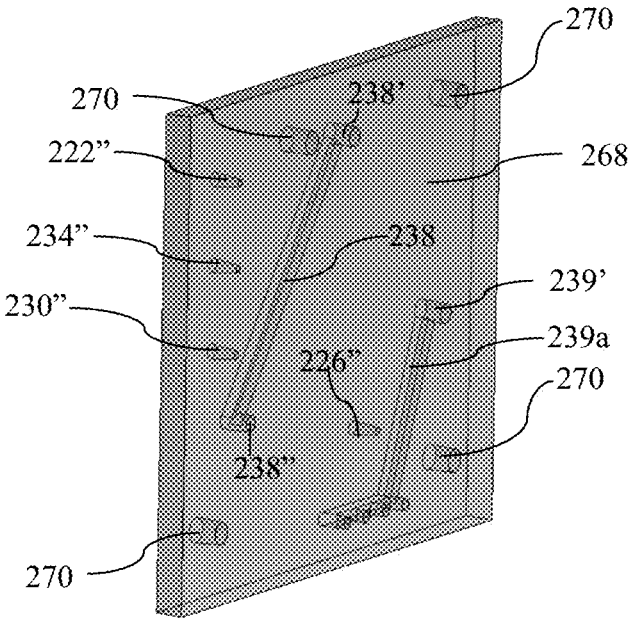
FIG. 12G is a top perspective view of the air channel plate of FIG. 11A according to certain embodiments of the present invention.

Reagent channel plate 240 may also contain one or more reagent channels corresponding to reagent bubble plate 212 and the desired flow to chamber plate 280. For instance, as shown in FIGS. 12D-12E, reagent bubble 222 also has corresponding reagent channel 224 that is in fluid connection with fluid inlet 222', and reagent bubble 230 also has corresponding reagent channel 232. Reagent channels 224 and 232 can comprise channels on the surface of reagent channel plate 240 that faces spacer plate 260, such that reagent channel plate 240 and spacer plate 260 operably engaged in direct contact with each other provides enclosed reagent chambers between the two plates. Reagent channels 224 and 232 allow the respective reagents in reagent bubble 222 and 230 to flow into correspondingly desired location of chamber plate 280, as discussed in more depth below. While FIGS. 12F and 13 illustrate the respective reagent outlets 230", 234" and 222" being stacked in a vertical plane as a result of the configuration of reagent channels 232 and 224 with respect to inlet 234', reagent channels 232 and 232 may also be configured such that reagent outlets 222", 234" and 230" are located generally adjacent to one another in a horizontal plane.

Referring now to FIG. 12E, spacer plate 260 is shown as having apertures 222", 234", 230'" and 226", which provide fluid connectivity between the respective inlets and channels of reagent channel plate 240 and air inlet plate 268. Referring now to FIG. 12F, air channel plate 268 also comprises reagent outlets 222", 226", 234" and 230", corresponding to apertures 222", 226", 234'" and 230'"', respectively, of spacer plate 260. Referring now to FIG. 13, which illustrates reagent outlets 222", 234" and 230" in a generally adjacent configuration, plate coupling 221 is shown with the respective inlets, channels and outlets in the transparent view of reagent channel plate 240, channel spacer plate 260 and air channel plate 268.

In certain aspects, reagent bubble 222 is in fluid connection with fluid outlet 222" via fluid inlet 222' and reagent channel 224 of reagent channel plate 240, aperture 222'" of spacer plate 260 and then outlet 222" of air channel plate 268. In certain aspects, reagent inlet 222' corresponds with Taurine bubble 222, such that reagent outlet 222" is in fluid connection with Taurine bubble 222.

In certain aspects, reagent bubble 226 is in fluid connection with fluid outlet 226" via fluid inlet 226' of reagent channel plate 240, aperture 226'" of spacer plate 260, and then outlet 260" of air channel plate 268. In certain aspects, reagent inlet 226' corresponds with acid bubble 226, such that reagent outlet 226" is in fluid connection with acid bubble 226.

In certain aspects, reagent bubble 230 is in fluid connection with fluid outlet 230" via fluid inlet 230' and reagent channel 232 of reagent channel plate 230, aperture 230'" of spacer plate 260 and then outlet 230" of air channel plate 268. In certain aspects, reagent inlet 230' corresponds with base bubble 230, such that reagent outlet 230" is in fluid connection with base bubble 230.

In certain aspects, reagent bubble 234 is in fluid connection with fluid outlet 234" via fluid inlet 234' of reagent channel plate 240, aperture 234'" of spacer plate 260, and then outlet 234" of air channel plate 268. In certain aspects, reagent inlet 234' corresponds with NDA bubble 234, such that reagent outlet 234" is in fluid connection with NDA bubble 234.

Figure 14A:
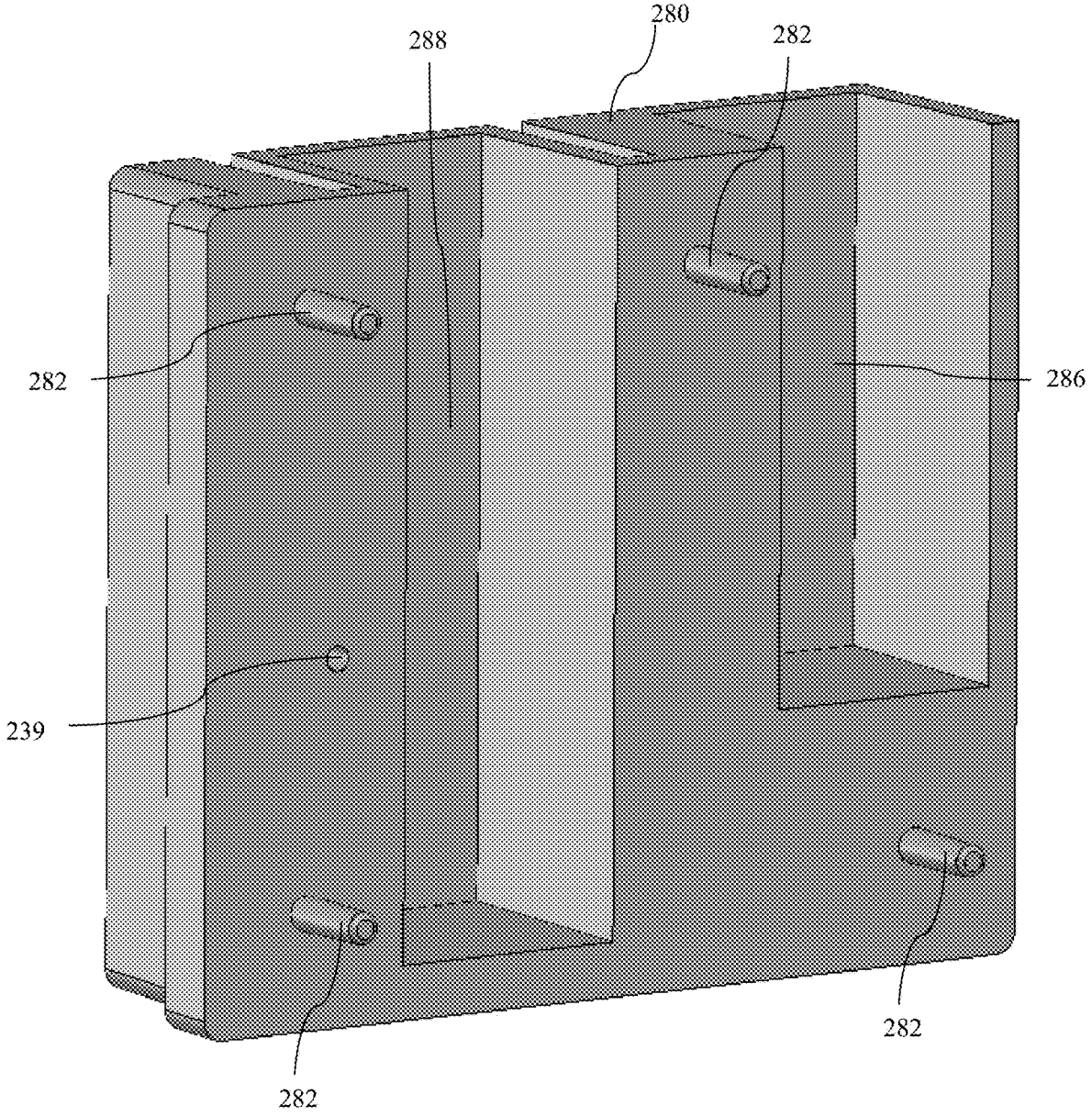
FIG. 14A is a side perspective view of the chamber plate of the cartridge in FIG. 11A according to certain embodiments of the present invention.
Figure 14B:
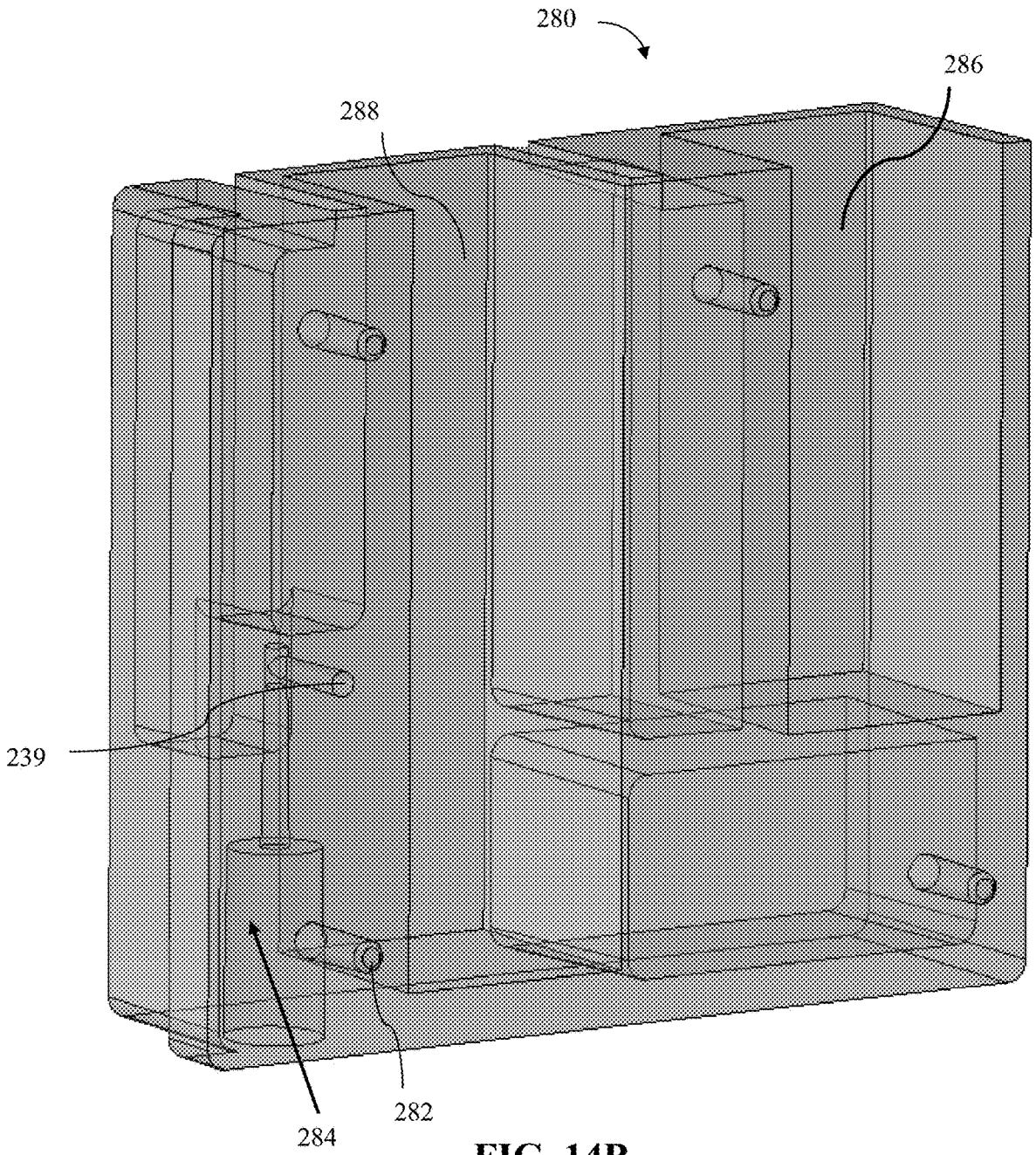
FIG. 14B is a side transparent perspective view of the chamber plate of FIG. 14A according to certain embodiments of the present invention.

As shown from FIGS. 12A-13, fluid outlet 222" provides a fluid connection between reagent bubble 222 and capture chamber 286, which is shown in FIGS. 14A and 14B, fluid outlet 226" provides a fluid connection between reagent bubble 226 and sample chamber 288, also shown in FIGS. 14A and 14B, fluid outlet 230" provides a fluid connection between reagent bubble 230 and capture chamber 286, and fluid outlet 234" provides a fluid connection between reagent bubble 234 and capture chamber 286. In some aspects, fluid outlet 222" provides a fluid connection between Taurine bubble 222 and capture chamber 286, fluid outlet 226" provides a fluid connection between acid bubble 226 and sample chamber 288, fluid outlet 230" provides a fluid connection between base bubble 230 and capture chamber 286, and fluid outlet 234" provides a fluid connection between NDA bubble 234 and capture chamber 286.

Referring now to the fluid connectivity of gas flow provided by air channel plate 268 into chamber plate 280, as shown in FIGS. 12F and 13, air channel 239, air channel inlet 239', air channel 239*a* and air channel outlets 239" provide a fluid connection between an external fluid inlet 284 and sample chamber 288. Specifically, external fluid inlet 284 allows an external fluid, such as atmospheric air, to flow into air channel 239 of the chamber plate 280 to the air channel inlet 239' of the air channel plate 268 through air channel 239*a* and through one or more air channel outlets 239" and into the sample chamber 288. In some aspects, the one or more air channel outlets 239" are configured proximate the lower portion of the sample chamber 288. In some aspects, atmospheric air, compressed air, pressurized air, nitrogen or any other pressurized inert gas may be provided through the external fluid inlet 284 into sample chamber 288 via air channel 239, air channel inlet 239', air channel 239*a* and air channel outlets 239". In some aspects, the gaseous medium introduced into the sample chamber 288 serves to agitate the sample and any reagents contained in the sample chamber 288 during normal operation.

Air channel plate 268 may also have one or more air channels between the sample chamber 288 and the capture chamber 286. In some aspects, air channel plate 268 comprises at least one air channel 238 providing a fluid connection between the headspace of sample chamber 288 and capture chamber 286 via sample chamber outlet 238', air channel 238 in air channel plate 268 and capture chamber inlet 238". In some aspects, sample chamber outlet 238' provides fluid connection to air channel 238 via an aperture through air channel plate 268 with air channel 238 being a channel on the side of air channel plate 268 that operably engages with channel spacer plate 260. In some aspects, capture chamber inlet 238" provides fluid connection to air channel 238 via an aperture through air channel plate 268 with air channel 238 being a channel on the side of air channel plate 268 that operably engages with channel spacer plate 260. In some aspects, fluid chamber 238 provides fluid connection between the head space in sample chamber 288 and the capture chamber 286, such that the capture chamber inlet 238" is located proximate the lower portion of capture chamber 286 proximate the reagents or solution within the capture chamber 286 to agitate or bubble the headspace gas through the reagents. In such aspects, the headspace gas bubbled through the reagents in the capture chamber 286 facilitates capture of the desired chemical component with the one or more reagents. Gas outlet 290, as shown in FIGS. 14A and 14B allow gas within the capture chamber 286 to exit without building up unwanted pressure.

As shown in FIGS. 14A and 14B, capture chamber 286 and sample chamber 288 are generally rectangular in shape, although other geometric shapes are contemplated, such as cylinder and the like. In some aspects, capture chamber 286 and sample chamber 288 have optimized dimensions to increase surface area of each chamber 286 and 288. In some aspects, capture chamber 286 and sample chamber 288 have optimized dimensions to increase recovery of gases and solutions in capture chamber 286 and chemical capture cartridge 200. In some aspects, the volume and surface area of sample chamber 288 is larger than the volume and surface area of capture chamber 286.

In some aspects, capture chamber 286 comprises at least one side having a clear portion to enable excitation of the desired detectible complex and detection of a signal. In some aspects, capture chamber 286 comprises at least two sides each having a clear portion to enable excitation of the desired detectible complex and detection of a signal. In some aspects, capture chamber 286 comprises a first side having a clear portion and an adjacent side having a clear portion. In some aspects, the capture chamber 286 contains at least three sides having a clear portion. In some aspects, the capture chamber 286 contains at least four sides having a clear portion. In some aspects, the clear portion comprises glass, optical glass, pyrex glass, UV quartz, IR quartz, or sapphire. In some aspects, the capture chamber 286 is comprised of a material that provides the ability to provide an excitation source and detect a signal by the sensing device 300. In some aspects, the excitation light source is applied in a perpendicular configuration to the detector in sensing device 300.

Figure 17:
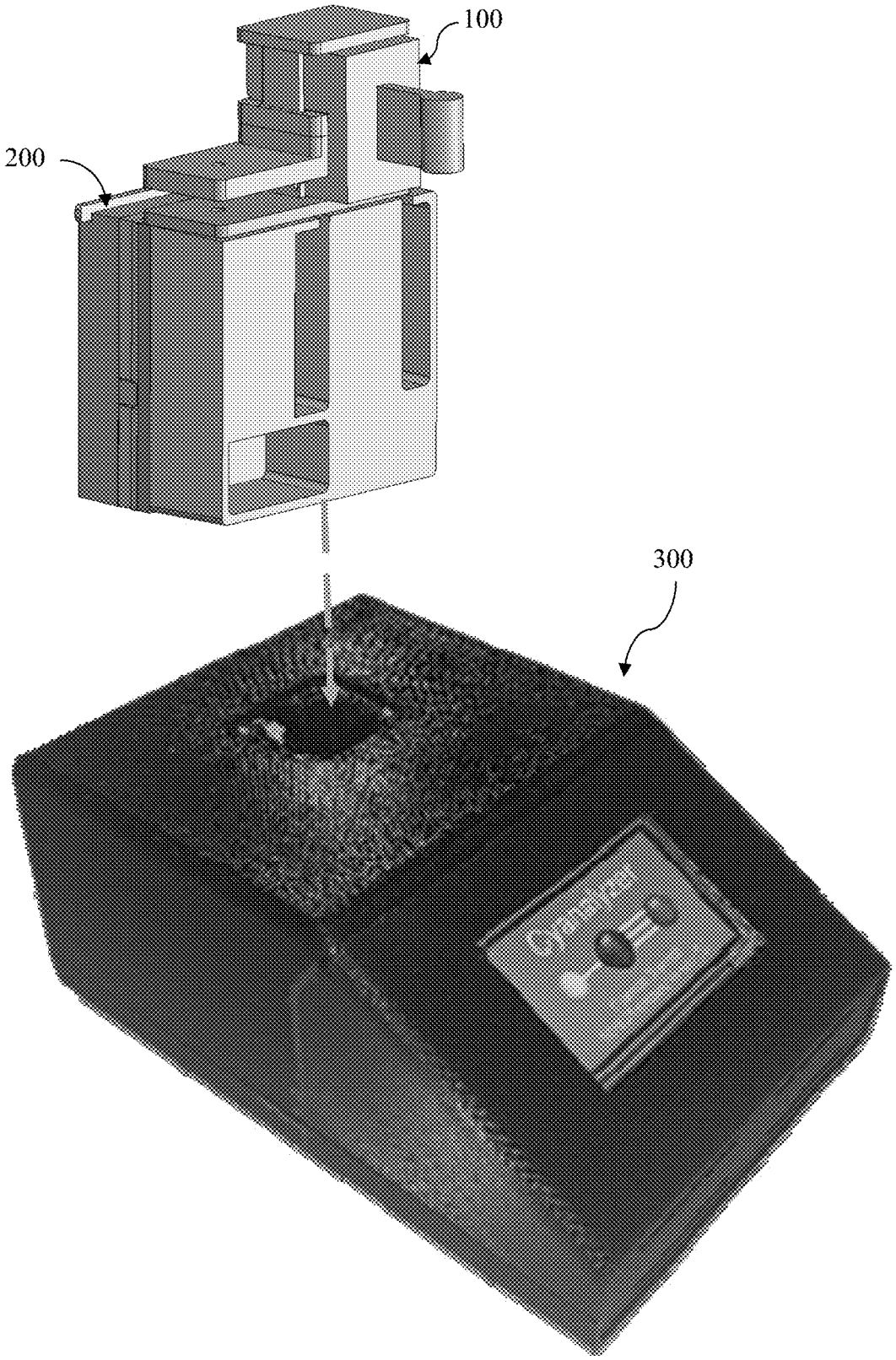
FIG. 17 is a perspective view of a sensing device according to certain embodiments of the present invention, which can receive a sample collection device operably coupled to a chemical capture cartridge, which is shown to be capable of receiving the sample collection device of FIG. 2A operably coupled to the chemical capture cartridge of FIG. 11A.

During normal use, sample collection device 100 is used to obtain a sample and then the sample collection device 100 is operably coupled to chemical capture cartridge 200 by inserting capillary cap 180 into the top of sample chamber 288, as shown in FIGS. 15A-15D and 16A-16C. The chemical capture cartridge 200 having the sample collection device 100 operably coupled thereto may then be inserted into sensing device 300, as shown in FIG. 17.

According to certain aspects, sensing device 300 can be used to determine the presence of a particular analyte or chemical component or compound. In some aspects, the analyte may be cyanide. In some aspects, the diagnostic testing of the presence of absence of a particular component or analyte begins with preparing a sample. In some aspects, a sample may be a liquid sample such as blood, saliva, water, or oils. According to an alternative embodiment, a sample may be a solid such as dirt or debris from a chemical exposure site. In some aspects, preparing a sample comprises collecting and adding a sample to capillary tube 192. In some aspects, preparing sample may comprise using a swab to gather saliva from a subject. In some aspects, preparing a sample may comprise drawing blood from subject to be drawn into capillary tube 192. For instance, blood may be taken from a patient by a finger stick to cause the subject to bleed. A liquid sample may be drawn into capillary tube 192 of sample collection device 100. In some aspects, while the sample is being obtained in capillary tube 192, plunger 110 is in the unpressed position.

In some aspects the volume of a sample collected may range from a sub microliter to about 300 microliters, preferably about 10 to about 100 microliters, preferably about 25 to about 75 microliters, more preferably about 50 microliters. In some aspects, the volume of sample collected may be adjusted according to the dimensions of capillary 192. In some aspects, the overall volume deposition can be adjusted by tuning the capillary volume and the volume of wash necessary for sample delivery, or addition of sample directly in the sample chamber 288.

In certain aspects relating to cyanide detection, the volume of sample collected in capillary tube 192 is between about 5 μL and 300 μL, in some aspects between about 10 μL and 150 μL, in some other preferable aspects between about 20 μL and 60 μL, and in some other most preferable aspects about 25 μL. In some aspects, the cyanide sample is a blood sample in an amount between about 5 μL and 300 μL, in some aspects between about 10 μL and 150 μL, in some other preferable aspects between about 20 μL and 60 μL, and in some other most preferable aspects about 25 μL.

In some alternative aspects, instead of using sample collection device 100, a desired sample may be added directly into sample chamber 288 of chemical capture cartridge 200. In such aspects, sample collection device 100 may still be operably coupled, such as to provide solution from reagent bubble 194 during the process of depressing plunger 110, and as a cap for sample and capture chambers 288, 286. In some alternative aspects, sample collection device 100 may not be used and sample chamber 288 and capture chamber 286 may be sealed with means for sealing, such as appropriate sealing caps.

In some preferred aspects, the sample is a liquid sample such as blood, saliva, water, or oil that is collected using sample collection device 100 and inserted into sample chamber 288 by operably coupling sample collection device 100 with chemical capture cartridge 200. For example, a sample may be contained within capillary tube 192 and sample collection device is operably coupled to chemical capture cartridge 200 by operably engaging capillary cap 180 with the receiving portion of sample chamber 288, such that sample chamber 288 is capped with capillary cap 180. According to an alternative embodiment, a sample may be a solid such as dirt or debris from a chemical exposure site. In this alternative embodiment, after the sample is added to sample chamber 288, the chemical capture cartridge 200 may still be capped using sample collection device 100. In such instances, sample collection device 100 may be used to deliver a desired reagent from into sample chamber 288 by depressing plunger 110.

The chemical capture cartridge 200 having coupled collection device 100 (or another appropriate cap in the instance of a solid sample added without using the sample collection device 100) may then be inserted into the cartridge receiving portion of sensing device 300. Once chemical capture cartridge 200 is properly inserted into sensing device 300, plunger 110 may be moved from the undepressed position to the depressed position. In some aspects, depression stop 170 must be removed to depress plunger 110 and insert the sample contained within capillary tube 192 into sample chamber 288.

In some aspects, by depressing plunger 110, capillary holder 191 having capillary aperture 184 holding at least a portion of capillary tube 192 is forced up into aperture 160 to a location such that capillary holder 191 seals air channel 158 and operably engages valve 197. The depression of plunger 110 also ruptures reagent bubble 194 forcing the reagent through valve 197 and into capillary tube 192, which flushes the sample out of the capillary tube 192 and sample chamber 288. As previously discussed, plunger 110 in the depressed position forms a sealed sample collection device 100 that also serves as a sealed cap to the sample chamber 288. The depressing of plunger 110 can be by manual actuation or automated. In some aspects, closing a lid of the sensing device containing the chemical capture cartridge 200 having coupled collection device 100 may provide the actuating force to depress plunger 110.

In some aspects after the sample is added to the sample chamber 288, reagents may be added to the respective sample chamber 288 and capture chamber 286. In some aspects, the addition of the reagents to the sample chamber 288 and capture chamber 286 may be done simultaneous or about simultaneous with plunger 110 being depressed to deposit sample into the sample chamber 288. In some aspects, the addition of the reagents to the sample chamber 288 and capture chamber 286 is automated by the sensing device 300 upon the sensing device 300 being actuated. In some aspects, the sensing device 300 is actuated by pressing a start button. In some aspects, bubble protector slide 210 is slidably removed from bubble protector plate 220 and pressure is exerted on bubble plate 212 such that reagent bubbles 222, 226, 230 and 234 are depressed to force the respective reagents into the respective chamber. In some aspects, the bubble protector slide 210 is slidably removed from bubble protector plate 220 prior to chemical capture cartridge 200 being inserted into sensing device 300. In some aspects, the bubble protector slide 210 is slidably removed from bubble protector plate 220 after chemical capture cartridge 200 is inserted into sensing device 300.

In some aspects, reagent bubble 226 results in a first reagent being provided into sample chamber 288 to react with the sample. In some aspects, depressing reagent bubbles 222, 230 and 234 results in at least three reagents being provided into capture chamber 286. One of ordinary skill in the art will appreciate that it is contemplated that one or more reagents may be provided to the sample chamber 288 to react with the sample, and one or more reagents may be provided to the capture chamber 286. In some aspects, the reaction of the at least one or more reagents in the sample chamber 288 with the sample can cause gas evolution 410 in the headspace of the sample chamber 288. The injection of air or another inert gas 412 into sample chamber 288 allows the headspace gas to be transferred from the sample chamber 288 to the capture chamber 286. In some aspects, air is injected into sample chamber 288 via air inlet 284. In some aspects, up to about 100 mL of air or other inert gas is delivered through air introduction inlet 284. In some aspects, air or another inert gas is delivered through air introduction inlet 284 and flows continuously into sample chamber 288 with the head space gas continuously flowing into capture chamber 286 with excess gas venting out of capture chamber 286 during the sensing cycle. In some aspects, air injection forces the gas in the headspace of sample chamber 288 to flow into capture chamber 286 proximate the one or more reagents in the capture chamber 288. In some aspects, the headspace gas in sample chamber 288 flows into capture chamber 286 and is bubbled through a mixture of two or more reagents, which captures the desired analyte to form a complex that may be detected.

In some aspects with respect to cyanide detection, reagent bubble 226 results in an acid reagent being provided into sample chamber 288 to react with the sample. In some aspects, depressing reagent bubbles 222, 230 and 234 results in taurine, a base reagent and NDA, respectively, being provided into capture chamber 286. In the case of cyanide detection, the reaction of the acid reagent with the cyanide within the sample can cause HCN gas evolution 410 in the headspace of the sample chamber 288. The injection of air or another inert gas 412 into sample chamber 288 allows the headspace gas to be transferred from the sample chamber 288 to the capture chamber 286. In some aspects, air is injected into sample chamber 288 via air inlet 284. In some aspects, up to about 20 mL of air or other inert gas is delivered through air introduction inlet 284. In some aspects, air or another inert gas is delivered through air introduction inlet 284 and flows continuously into sample chamber 288 with the head space gas continuously flowing into capture chamber 286 with excess gas venting out of capture chamber 286 during the sensing cycle. In some aspects, air injection forces HCN gas in the headspace of sample chamber 288 to flow into capture chamber 286 proximate the reagents in the capture chamber 288. In some aspects, the HCN headspace gas in sample chamber 288 flows into capture chamber 286 and is bubbled through a mixture of base reagent, taurine, and NDA, which captures the cyanide to form a NDA-Taurine-CN complex.

In some aspects, sensing device 300 contains an exciting LED to cause the desired complex in the capture chamber 286 to emit a detectible signal. In some aspects, the detectible signal is fluorescence. In some aspects related to cyanide detection, an LED at a wavelength range of about 410 nm is used to excite the NDA-Taurine-CN complex, and the resulting fluorescence is then measured by a sensor in the sensing device 300. The reaction of cyanide in the form of HCN gas in the capture chamber 286 containing NDA and Taurine in the presence of a base reagent to form florescent β-isoindole is shown in Scheme 1 below.

Scheme 1

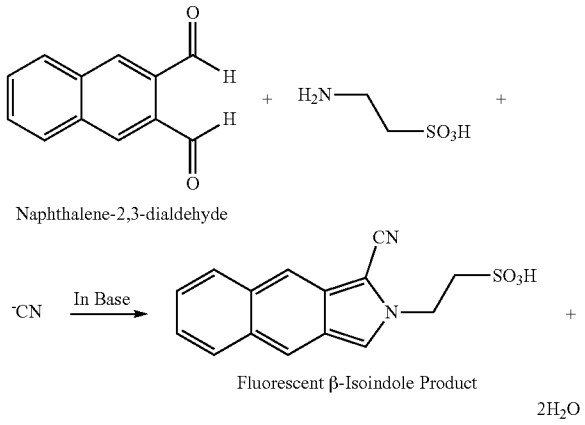

The sensing device 300 can provide a signal of the presence or absence of the desired analyte. In some aspects, the sensing device 300 contains software with a calibration table to provide a readout of the amount of the desired analyte in the sample.

In some aspects, the time between starting the detection process once the capture cartridge 200 device is inserted into the sensing device 300 and the detection process is started and the signal or readout from the sensing device 300 is preferably less than 2 minutes, in some aspects less than 90 seconds, and more preferably about 60 seconds or less.

While the foregoing description has been in the context of cyanide detection, it is contemplated that sample collection device 100, chemical capture cartridge 200 device and/or sensing device 300 may be configured to be used with other analytes, such as other TICs. In some aspects, sensing device 300 may be configured to have more than one LED to excite various complexes, such that sample collection device 100, chemical capture cartridge 200 device and sensing device 300 can be universally used for detecting various analytes.

For example, sample collection device 100, chemical capture cartridge 200 device and sensing device 300 may be used for $H_2S$ detection in a sample. In some aspects, the LED in sensing device 300 would be modified or selected and different reagents may be used in chemical capture cartridge 200. An example reagent specific for $H_2S$ may be 4-Azido-7-nitro-2,1,3-benzoxadiazole (NBD-Azide).

Examples of TICs and corresponding potential fluorometric probes that may be used with the sample collection device 100, chemical capture cartridge 200 device and sensing device 300, including cyanide, are listed in Table 2.

TABLE 2

Proposed chemistry for TIC analyte diagnostic detection.

| Toxic Chemical | Sample Chamber Reaction[a] | Gaseous Species | Capture Chamber Reaction | Captured Species | Fluorometric Probe[b] |
|---|---|---|---|---|---|
| Cyanide | Acidification | HCN | Basification | $CN^-$ | NDA-Taurine |
| Cyanide (via $SCN^-$ analysis) | $KMnO_4$/Acid | HCN | Basification | $CN^-$ | NDA-Taurine |
| Hydrogen Sulfide ($H_2S$) | Acidification | $H_2S$ | Basification | $HS^-$ | Azide Reagent |
| Ammonium | Basification | $H_3N$ | Acidification | $NH_4^+$ | O-Phthaldehyde |
| Carbon Disulfide ($CS_2$) | NA | $CS_2$ | Amine Reaction | $CS_2$ | Amino fluorescent agent |
| Hydrogen Fluoride (HF) | Acidification | HF | Basification | $F^-$ | Indole-azadiene |
| Azide ($N_3^-$) | Acidification | $HN_3$ | Basification | $N_3^-$ | Naphthalimide/alkyne |
| Sulfur Dioxide ($SO_2$) | Acidification | $SO_2$ | Basification | $H_2SO_3^-$ | Cyanine-based dye; α,β-unsaturated |
| Chlorine ($Cl_2$) | $KMnO_4$/Acid | HOCl | Basification | $^-OCl$ | Fluorescein derivative |
| Phosgene ($COCl_2$) | NA | $COCl_2$ | Amine Reaction | $COCl_2$ | Amino fluorescent agent |
| 1,3-butadiene | NA | Butadiene dioxide | Thiol Reaction | Butadiene dioxide | Di-thiol fluorescent agent |
| Arsine ($AsH_3$) | NA | $AsH_3$ | Thiol Reaction | $AsH_3$ | Thiol fluorescent agent |
| Phosphine ($PH_3$) | NA | PH3 | Thiol Reaction | $PH_3$ | Thiol fluorescent agent |
| Formaldehyde ($CH_2O$) | NA | $CH_2O$ | NA | $CH_2O$ | Naphthalene derivative |
| Methyl Isocyanate (MIC) | NA | MIC | Thiol Reaction | MIC | Thiol or Thioic Acid fluorescent agent |

[a]References indicate the reaction in the sample chamber will produce the specified gaseous species.
[b]References indicate the fluorometric probe or type of probe which will produce a fluorescent product in the sensor.

In some aspects, a TIC can be detected using the foregoing disclosed sample collection device 100, chemical capture cartridge 200 device and/or sensing device 300. Analysis of a desired analyte comprises sample preparation for deposition into the chemical capture cartridge 200. The sample collection device 100 can be used to obtain a sample in the microliter range, in some aspects a blood sample, which is then deposited into chemical capture cartridge 200 where microdiffusion and reaction with a selective fluorometric reagent occurs. Chemical capture cartridge 200 is placed in sensing device 300 that uses a fluorometric reader. During diagnostic testing, sensing device 300 delivers the carrier gas via a predetermined sequence and fluorometric analysis is conducted (i.e., sensing device 300 contains a select LED and photodiode pair to excite the sample and measure the fluorescent emission, respectively). For instance, in some aspects for the analysis of cyanide, a blood sample is placed in the sample chamber 288 and acidified to convert all CN to HCN(g). The gaseous HCN is then transferred into the capture chamber 286 via a carrier gas that is inserted proximate the reagents in capture chamber 286, such that the carrier gas is bubbled through the reagent solution in capture chamber 286. HCN(g) is captured in basic solution by conversion to non-volatile $CN^-$. The fluorescence signal is then measured after reaction of CN with a fluorescent probe.

In some aspects, the analytical diagnostic process to detect the presence or absence of an analyte comprises obtaining a sample of whole blood, which can be obtained by a fingerstick of a subject and collecting the whole blood sample in capillary tube 192 of sample collection device 100. In some aspects, the whole blood sample is about 15 μL to about 50 μL, preferably about 20 μL to about 40 μL, and more preferably about 25 μL. Sample collection device 100 is operably coupled to chemical capture cartridge 200 device, which are then inserted into sensing device 300. Plunger 110 is depressed using water in reagent bubble 194 to wash the whole blood sample into sample chamber 288 and sensing device 300 is actuated. In some aspects, wash solution in reagent bubble 194 also functions to dilute the whole blood sample. In some aspects, sensing device 300 is actuated by pressing a button to initiate analysis. Upon actuation of sensing device 300, the remaining analysis steps can be automated by sensing device 300. In some aspects, the analysis steps conducted by sensing device 300 include depressing reagent bubbles 222, 226, 230 and 234 to release the respective reagents into sample chamber 288 and capture chamber 286.

In some aspects relating to cyanide detection, an acid reagent is released into sample chamber 288, and a base reagent, NDA and taurine are released into capture chamber 286. In some aspects, the acid reagent liberates cyanide from the biological sample in sample chamber 288, the base reagent captures the liberated cyanide in capture chamber 286, and NDA and Taurine produce a cyanide selective fluorometric mixture in capture chamber 286. During the analysis process, approximately at least 50 mL and up to about 200 mL, preferably at least 75 mL and up to about 150 mL, and more preferably at least 100 mL and up to about 120 mL ambient air is transferred through the air introduction inlet 284, which flows into sample chamber 288 and then conducts headspace transfer into capture chamber 286 via air channel 239, air channel inlet 239', air channel **239*a* and air channel outlets 239". In some aspects, excess pressure formed from headspace transfer is released from capture chamber 286 through air outlet 290. In some aspects, the headspace gas of sample chamber 288 is bubbled through reagent mixture in capture chamber 286**.

In some aspects, ambient air is continuously introduced into sample chamber 288 for at least 15 seconds and up to less than 60 seconds, preferably at least 35 seconds and up to about 55 seconds, more preferably at least 40 seconds and up to about 50 seconds.

In some other aspects, ambient air is continuously introduced into sample chamber 288 for at least 15 seconds and up to less than about 5 minutes, preferably at least 20 seconds and up to about 4 minutes, more preferably at least 40 seconds and up to about 2 minutes or less.

In some aspects, ambient air is introduced into sample chamber 288 in a sequence comprising a continuous phase followed by a pulsing phase prior to a resting phase where no ambient air is introduced before fluorescence analysis. In some aspects, the continuous phase is for at least 15 seconds and up to less than 50 seconds, preferably at least 20 seconds and up to about 45 seconds, preferably at least 25 seconds and up to about 35 seconds, more preferably about 30 seconds. In some aspects, the pulsing phase is at least 5 seconds and up to about 30 seconds, preferably at least 10 seconds and up to about 20 seconds, more preferably about 12 seconds, wherein each pulse is about 0.5 seconds followed by about 2 seconds of rest. In some aspects, the resting phase with no ambient air introduction prior to fluorescence analysis is at least 5 seconds up to about 30 seconds, preferably at least 10 seconds up to about 20 seconds, more preferably about 15 seconds. In some aspects, the sequence comprises the continuous phase for about 30 seconds followed by the pulsing phase for about 12 seconds followed by the resting phase for about 15 seconds.

In some aspects, upon headspace transfer into capture chamber 286 allows the analyte to react and form a detectible compound. In some aspects relating to cyanide detection, the biological sample in sample chamber 288 is acidified to convert CN to HCN(g) in the headspace. The gaseous HCN headspace is then transferred into the capture chamber 286 and bubbled through the reagent solution in capture chamber 286, such that HCN(g) is captured in basic solution by conversion to non-volatile $CN^-$, which then reacts with cyanide to produce a fluorescent CN-NDA-taurine product to form a detectible complex. In some aspects, a fluorescence signal can be measured after reaction of CN with a fluorescent probe to form a detectible complex and excitation of the detectible complex at an appropriate wavelength and detection at an appropriate wavelength. In some aspects, the CN-NDA-taurine complex is irradiated with 410 nm light via an LED and the fluorescence is measured via a photodiode at 510 nm. In some aspects, the measured fluorescence signal can generate a signal on the sensing device 300. In some aspects, the measured fluorescence signal can be converted to concentration and displayed to the analyst and determined if it is above ("Exposure Detected") or below ("No Exposure") the threshold value. In some aspects, the sensing device 300 has a limit of detection of about 5 μM. In some aspects, the sensing device 300 has a linear range of about 10 μM to about 200 μM. In some aspects, the threshold is set at about 5 μM above the maximum cyanide concentration seen in the blood of cigarette smokers. In some aspects, the threshold value is about 15 μM. In some aspects, the period of time for analysis upon initiating analysis on the sensing device is less than 90 seconds, in some aspects at least 30 seconds up to about 90 seconds, preferably at least 30 seconds and up to about 60 seconds, in some aspects about 60 seconds.

In some aspects, sensing device 300 may contain an irradiating means for exciting the detectible complex that contains a wavelength range or an array of wavelengths such that sensing device 300 may be used for detecting various analytes. For example, sensing device 300 may contain two or more LEDs each having a different wavelength that may be chosen by the analyst prior to actuating sensing device 300. In some other aspects, sensing device 300 may have a light source that provides a broad wavelength spectrum such that a wavelength range or specific wavelength may be chosen by the analyst prior to actuating sensing device 300.

In some aspects, sensing device 300 may contain an array of photodiodes for measuring fluorescence at various wavelengths. In some aspects, the analyst may choose the desired wavelength range or wavelength prior to actuating sensing device 300. In some aspects, sensing device 300 may automate the desired photodiode based upon the irradiating wavelength range or wavelength chosen prior to actuation.

Sensing device 300 is preferably a size such that it is portable to be used out at a desired location in the field. In some aspects, the size of sensing device 300 can be up to about 30 cm in length, up to about 30 cm in width, and up to about 30 cm in height, such that it is about 9000 $cm^3$. In some other aspects, the size of sensing device 300 is up to about 28 cm in length, up to about 20 cm in width, and up to about 12 cm in height, such that it is up to about 6700 $cm^3$. In some preferred aspects, the size of sensing device 300 is up to about 20 cm in length, up to about 14 cm in width, and up to about 10 cm in height, such that it is up to about 2800 $cm^3$. More preferably, the size of sensing device 300 is up to about 19.6 cm in length, up to about 13.2 cm in width, and up to about 9.5 cm in height, such that it is up to about 2500 $cm^3$.

EXAMPLES

The present invention can further be understood by the following examples, which are intended for exemplary purposes without unduly limiting or importing limitations into the claimed subject matter.

Calibration of Sensing Device

Figure 18:
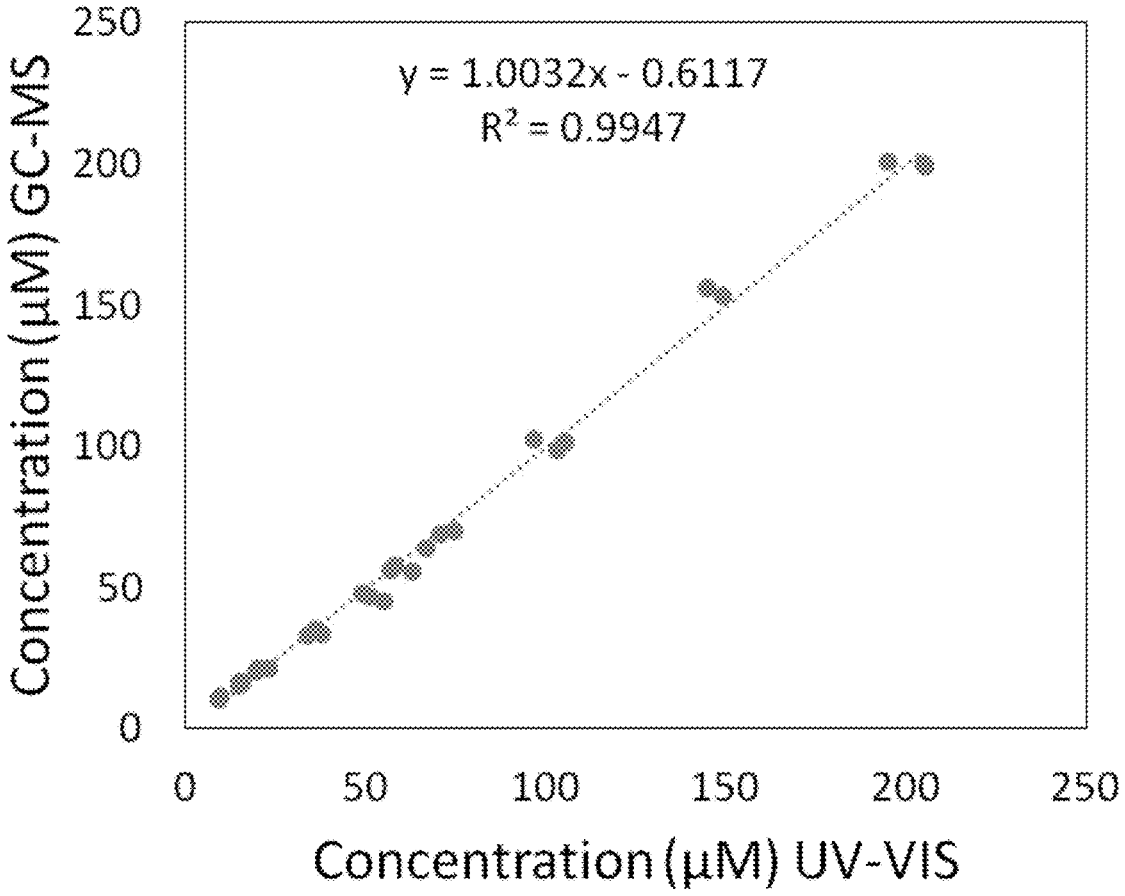
FIG. 18 is a calibration curve from cyanide spiked rabbit whole using GC-MS and UV-Vis analysis methods.
Figure 19:
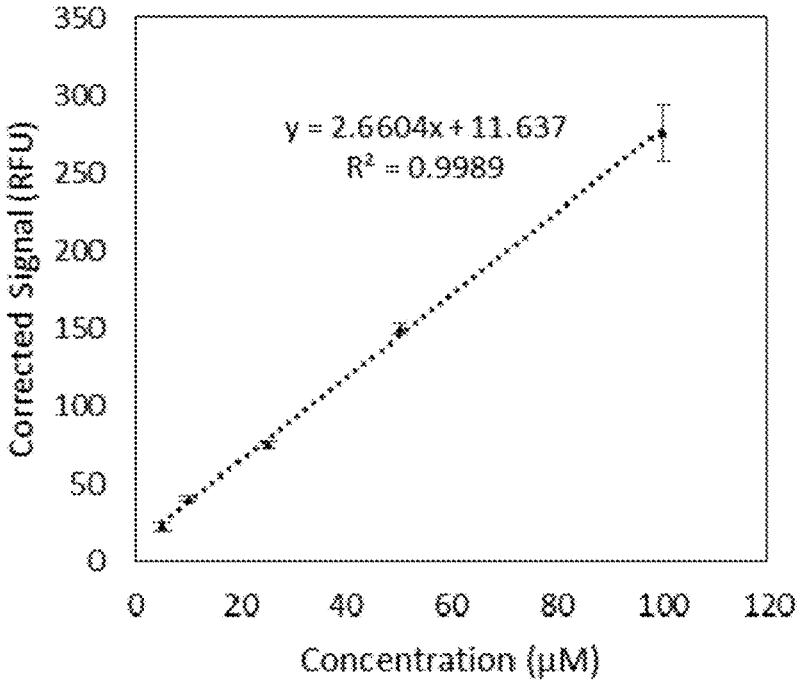
FIG. 19 is a calibration curve from cyanide spiked rabbit whole blood using a sample collection device, a chemical capture cartridge, and a sensing device according to certain embodiments of the present invention.

The concentration accuracy of a sensing device for cyanide detection was verified by using both a laboratory-based GC-MS method and direct UV-Vis analysis using rabbit whole blood spiked with cyanide at concentrations ranging from 2 μM to 100 μM. Calibration curves for the range of samples were generated by using both a conventional GC-MS and UV-Vis analysis method, both with $R^2$>0.9, as shown in FIG. 18. The samples of rabbit whole blood spiked with cyanide were also analyzed using the sample collection device, chemical capture cartridge device and sensing device of the present invention. Specifically, 25 μL of each spiked sample was obtained using sample collection device and introduced into chemical capture cartridge. Sensing device was actuated to release an acid reagent into the sample chamber, and a base reagent, NDA and taurine into the capture chamber. Ambient air, 120 mL, was introduced into the chemical capture cartridge by bubbling it into the sample within the sample chamber and headspace transfer into capture chamber by bubbling through the reagent mixture in capture chamber. Ambient air was introduced by a sequence having a continuous flow for about 30 seconds followed by a pulsing flow for about 12 seconds followed by a resting phase of no ambient air flow for about 15 seconds prior to excitation by an LED at 410 nm light via and fluorescence measured via a photodiode at 510 nm. A calibration curve from cyanide spiked rabbit whole blood is shown in FIG. 19.

Analysis Protocol and Instrument Sequence (≤60 Seconds Analysis Time)

A blood sample (25 μL of blanks, samples, and standards) was placed in the sample chamber of the chemical capture cartridge. De-ionized water ("DI") (80 μL) was placed in the sample chamber. The chemical capture cartridge was then inserted into the sensing device and the "start" button was pressed. Pushing of the start button induced simultaneous injection of 200 μL each of all reagents (listed in Table 4). After reagent injection, headspace transfer of cyanide was performed by turning on the pump to deliver air (200 mL/min through the cartridge) for 34.12 seconds. Following headspace transfer, pulsed bubbling (0.5 seconds on and 2 seconds rest) was performed for 12.5 seconds. A 13.38 second delay was carried out to allow the NDA-taurine-cyanide reaction to occur. Fluorescence of the capture chamber solution was then measured and recorded. The measured results were compared to UV-VIS measurements for validation, which correlated with an $R^2$>0.9.

TABLE 4

Reagents for Analysis Protocol

| Ingredient or Step | Chamber | Parts |
|---|---|---|
| Sample Collection Device | | |
| Blood | Sample | 25 μL |
| De-ionized water | Sample | 80 μL |
| Reagents | | |
| 2M $H_2SO_4$ in 1:1 $H_2O$:EtOH | Sample | 200 μL |
| 0.1M NaOH | Capture | 200 μL |
| 0.002M NDA | Capture | 200 μL |
| 0.1M Taurine | Capture | 200 μL |

In-Vivo Cyanide Diagnostic Analysis

Figure 20:
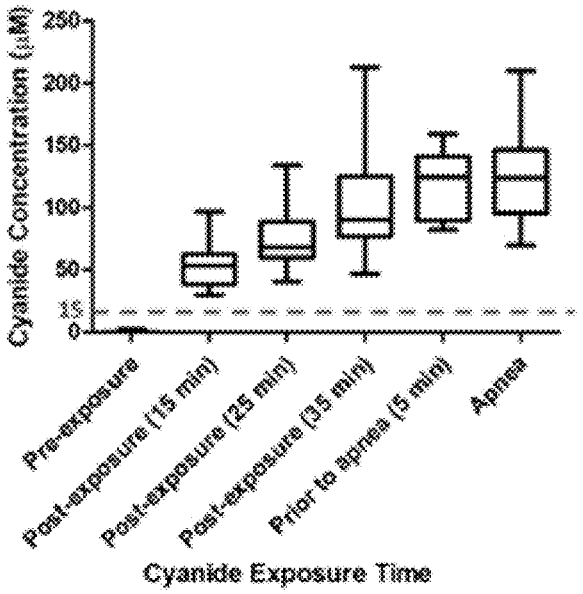
FIG. 20 is a graph of blood cyanide determined from cyanide exposed rabbits using a sample collection device, a chemical capture cartridge, and a sensing device according to certain embodiments of the present invention.

The chemical capture cartridge and sensing device used in the Calibration of Sensing Device above were also used to diagnose CN exposure in-vivo using the blood CN concentrations of rabbits following cyanide exposure. New Zealand white rabbits (3.5-5.5 kg) were anesthetized, intubated, ventilated and then exposed intravenously to a lethal dose of CN (6.8 mM NaCN in 0.9% NaCl at 1 mL/min) in a laboratory setting. Blood was drawn from the rabbits just prior to exposure (pre-exposure) and after approximately 15, 25, 30, 35 min after CN infusion, and approximately 5 min prior to apnea (blood also drawn at apnea when appropriate). Each sample was flash frozen in liquid nitrogen and stored at −80° C. until analysis. As shown in FIG. 20, all pre-CN exposure blood samples (N=27) produced concentrations significantly below the cutoff and all post-cyanide exposure samples showed elevated levels of CN in the blood, above the cutoff (15 μM) and considered "cyanide exposed". Validation showed that the sensor met or surpassed all the desired criteria for a forensic cyanide analyzer, producing 100% accuracy (i.e., no false positives or negatives) in determination of CN in exposed animal samples (N=88 exposed, N=27 non-exposed), as shown in Table 3.

TABLE 3

Cyanide Sensing Parameters.

| Sensor Parameter | Desired Value | Sensing Device |
|---|---|---|
| Diagnostic Accuracy* | ≥99% | 100% (N = 51 samples; 14 non-exposed, 37 exposed) |
| Analysis Time* | ≤60 s | 60 s |
| Detection Limit at Biol. Relevant Conc.* | ≤10 μM | 2 μM |
| Size* | Handheld | ✓ |
| Precision | ≤20% RSD | ≤8% RSD |
| Accuracy | 100 ± 20% | 100 ± 12% |
| Sample Volume | ≤50 μL | 15 μL |
| Cyanide Recovery | >75% | 75% (aq); 55% (blood) |
| Linear Range | At least 15-75** μM | 10-200 μM |
| Interferents | None | None Known |
| Reagent Stability | Months | ≥70 days |
| Sample Prep and Fluorometric Analysis | Automated | Single button push |
| Rapid Calibration | ≤5-point calibration | 2-point calibration |

$H_2S$ Diagnostic Analysis

The sensing device used in the Calibration of Sensing Device above was modified to add the optical components necessary for $H_2S$ and a fluorometric reagent 4-Azido-7-nitro-2,1,3-benzoxadiazole (NBD-Azide) specific for $H_2S$ was used. The fluorometric reagent was tested, and was found to selectively react with $H_2S$. Detection of aqueous $H_2S$ was conducted by adding solid NBD-Azide to the sample cartridge and a solution of NaOH at pH 8.5 with 100% ethanol (3:7) with 0.01% SLS was optimum for capturing and analyzing gaseous $H_2S$. $H_2S$ was also measured from spiked blood sample at 500 μM, which validated that the sensing device could be used for an analyte besides cyanide.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A testing assembly for the detection of a desired chemical analyte in a sample, the testing assembly comprising:

a sample collection device;

a chemical capture cartridge comprising:

a chamber plate having a sample chamber and a capture chamber;

a reagent plate having at least a first reagent bubble and a second reagent bubble, the first reagent bubble comprising a first liquid reagent and the second reagent bubble comprising a second liquid reagent; and at least one reagent channel plate located between the chamber plate and the reagent plate;

wherein the at least one reagent channel plate comprises at least a first reagent channel that is configured to provide fluid communication between the sample chamber of the chamber plate and at least the first reagent bubble;

wherein the at least one reagent channel plate comprises at least a second reagent channel that is configured to provide fluid communication between the capture chamber of the chamber plate and at least the second reagent bubble; and wherein the sample chamber configured to provide a headspace gas that is capable of being in fluid communication with the capture chamber; and a sensing device;

wherein the sample collection device is configured to obtain the sample, insert the sample into the sample chamber of the chemical capture cartridge, and provide a cap for at least the sample chamber of the chemical capture cartridge;

wherein the sample chamber of the chemical capture cartridge is configured to react the sample with at least the first liquid reagent to provide a headspace gas having the desired chemical analyte, the headspace gas having the desired chemical analyte capable of being transferred to the capture chamber, and the capture chamber of the chemical capture cartridge is configured to react the desired chemical analyte with at least the second liquid reagent to provide a desired detectable complex; and wherein the sensing device comprises an excitation source and a detector, wherein the excitation source is configured to cause the desired detectable complex to emit a detectible signal, the detector is configured to detect the detectible signal, and the sensing device is capable of providing a signal indicating the presence or absence of the desired chemical analyte.

2. The testing assembly of claim 1, wherein the sample collection device comprises:

a plunger having at least one elongated leg extending from a top portion and operably connected with a first body, a second body and a third body, wherein the second body is located between the first and third bodies, the first body having a central aperture containing a valve, the second body having a central aperture that is capable of receiving a capillary holder projection of the third body;

a capillary tube located within the capillary holder projection of the third body, the capillary tube having a proximate end extending out a bottom portion of the third body and a distal end extending through the capillary holder projection; and a wash solution contained within a wash solution bubble, the wash solution bubble located between the plunger and the first body.

3. The testing assembly of claim 2, wherein the plunger is configured to be operated between an undepressed position and a depressed position, wherein the capillary tube in the undepressed position is configured to not operably engage with the valve, and wherein the capillary tube in the depressed position is configured to operably puncture the valve and wash solution bubble.

4. The testing assembly of claim 3, wherein the capillary holder projection is configured to operably slide within a central aperture of the second body when the plunger is converted from the undepressed position to the depressed position.

5. The testing assembly of claim 3, wherein the second body comprises an air channel configured to provide an external fluid connection between the capillary tube and an exterior atmosphere when the plunger is in the undepressed position.

6. The testing assembly of claim 4, wherein the external fluid connection allows capillary action of the sample collection device to draw the sample within the capillary tube in the undepressed position.

7. The testing assembly of claim 6, wherein the external fluid connection is configured to be sealed by the capillary holder projection in the depressed position.

8. The testing assembly of claim 7, wherein a volume of the sample is between about 5 microliters and about 300 microliters.

9. The testing assembly of claim 4, wherein the wash solution bubble is configured to rinse the sample in the capillary tube into the sample chamber when the plunger is converted from the undepressed position to the depressed position.

10. The testing assembly of claim 1, wherein a volume of the sample is between about 5 microliters and about 300 microliters.

11. The testing assembly of claim 1, wherein the chemical capture cartridge further comprises at least one air channel plate located between the at least one reagent channel plate and the chamber plate.

12. The testing assembly of claim 11, wherein the at least one air channel plate comprises an external gas flow channel, wherein the external gas flow channel provides a fluid connection between the sample chamber and an external gas source.

13. The testing assembly of claim 12, wherein the external gas flow channel comprises at least one air channel outlet proximately located the lower portion of the sample chamber that contains fluid during normal operation.

14. The testing assembly of claim 13, wherein the at least one air channel plate further comprises a headspace gas channel, wherein the headspace gas channel providing a fluid connection between the headspace of the sample chamber and the capture chamber.

15. The testing assembly of claim 14, wherein the headspace gas channel comprises at least one headspace gas outlet proximately located the lower portion of the capture chamber that contains fluid during normal operation.

16. The testing assembly of claim 1, wherein the sample comprises a liquid sample selected from the group consisting of blood, saliva, water and oil.

17. The testing assembly of claim 16, wherein the desired chemical analyte in the sample is a toxic industrial chemical selected from the group consisting of cyanide, hydrogen sulfide, ammonia, hydrofluoric acid, carbon disulfide, azide, sulfur dioxide, chlorine, phosgene, 1,3-butadiene, arsine, phosphine, formaldehyde and methyl isocyanate.

18. The testing assembly of claim 1, wherein the desired detectable complex is a fluorometric probe that is capable of providing a fluorescence wavelength.

19. A testing assembly for the detection of cyanide in a sample, the testing assembly comprising:

a sample collection device capable of collecting a sample volume between about 5 microliters and about 300 microliters;

a chemical capture cartridge comprising:

a chamber plate having a sample chamber for receiving the sample and a capture chamber;

a reagent bubble plate having a plurality of reagent bubbles, each reagent bubble containing between about 5 microliters and about 5 milliliters of a separate reagent including at least one acid reagent, at least one base reagent, at least one napththalene-2-3-dialdeyde (NDA) reagent, and at least one taurine reagent;

at least one reagent channel plate located between the chamber plate and the reagent plate, wherein the at least one reagent channel plate comprises at least one reagent channel configured to provide fluid communication between the sample chamber of the chamber plate and the at least one acid reagent bubble, and wherein the at least one reagent channel plate comprises at least one reagent channel configured to provide fluid communication between the capture chamber of the chamber plate and each of the at least one base, NDA and taurine reagent bubbles; and at least one air channel plate located between the at least one reagent channel plate and the chamber plate, wherein the at least one air channel plate comprises an external gas flow channel configured to provide a fluid connection between an external gas source and the sample chamber, and wherein the at least one air channel plate comprises a headspace gas channel configured to provide a fluid connection between the headspace of the sample chamber and the capture chamber; and a sensing device;

wherein the sample collection device is configured provide a cap for at least the sample chamber of the chemical capture cartridge and discharge the sample into the sample chamber;

wherein the sample chamber of the chemical capture cartridge is configured to react the sample with at least the acid reagent to provide a headspace gas comprising hydrogen cyanide, a volume of the external gas source is configured to transfer the headspace gas from the sample chamber to a mixture of the base, NDA and taurine reagents in the capture chamber to form a detectible cyanide complex with NDA and taurine;

wherein the sensing device comprises an excitation source and a detector for indicating the presence or absence of cyanide; and wherein the testing assembly is capable of providing an analysis in less than about 60 seconds with a detection limit of about 2 μM.

20. A device for the detection of cyanide in a sample, the device comprising:

a chamber plate having a sample chamber for receiving a sample and a capture chamber;

a reagent bubble plate having a plurality of reagent bubbles, each reagent bubble containing between about 5 microliters and about 5 milliliters of a separate reagent, the separate reagents including at least one acid reagent, at least one base reagent, at least one napththalene-2-3-dialdeyde (NDA) reagent, and at least one taurine reagent;

at least one reagent channel plate located between the chamber plate and the reagent plate, wherein the at least one reagent channel plate comprises at least one reagent channel configured to provide fluid communication between the sample chamber of the chamber plate and the at least one acid reagent bubble, and wherein the at least one reagent channel plate comprises at least one reagent channel configured to provide fluid communication between the capture chamber of the chamber plate and each of the at least one base, NDA and taurine reagent bubbles; and at least one air channel plate located between the at least one reagent channel plate and the chamber plate, wherein the at least one air channel plate comprises an external gas flow channel configured to provide a fluid connection between an external gas source and the sample chamber, and wherein the at least one air channel plate comprises a headspace gas channel configured to provide a fluid connection between the headspace of the sample chamber and the capture chamber;

wherein the sample chamber of the chemical capture cartridge is configured to react the sample with at least the acid reagent to provide a headspace gas comprising hydrogen cyanide, and the hydrogen cyanide in the headspace gas is capable of reacting with the mixture of the base, NDA and taurine reagents in the capture chamber to form a detectible cyanide complex.

* * * * *